US011930876B2

(12) United States Patent
Santiago et al.

(10) Patent No.: US 11,930,876 B2
(45) Date of Patent: Mar. 19, 2024

(54) POSITION-SPECIFIC HELMET PROTECTION

(71) Applicant: VICIS IP, LLC, New York, NY (US)

(72) Inventors: Cord Santiago, Seattle, WA (US); Kurt Fischer, Edmonds, WA (US); Travis Glover, Seattle, WA (US); Valerie Carricaburu, Bellevue, WA (US); Adam Frank, Seattle, WA (US); Andre Stone, Lynnwood, WA (US); Jason Neubauer, Sammamish, WA (US); Per Reinhall, Seattle, WA (US); David Marver, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 598 days.

(21) Appl. No.: 16/984,677

(22) Filed: Aug. 4, 2020

(65) Prior Publication Data

US 2021/0007432 A1 Jan. 14, 2021

Related U.S. Application Data

(63) Continuation of application No. PCT/US2019/016654, filed on Feb. 5, 2019.

(60) Provisional application No. 62/626,580, filed on Feb. 5, 2018.

(51) Int. Cl.
*A42B 3/06* (2006.01)
*A42C 2/00* (2006.01)

(52) U.S. Cl.
CPC ..... *A42B 3/063* (2013.01); *A42C 2/007* (2013.01)

(58) Field of Classification Search
CPC ..... A42B 3/124; A42B 3/063; A42C 2/007
See application file for complete search history.

(56) References Cited

U.S. PATENT DOCUMENTS

| | | | |
|---|---|---|---|
| 4,937,888 | A | 7/1990 | Straus |
| D592,808 | S | 5/2009 | Murphy et al. |
| D598,609 | S | 8/2009 | Durocher |
| 7,743,640 | B2 | 6/2010 | Lampe et al. |
| D628,347 | S | 11/2010 | Chen |
| D670,447 | S | 11/2012 | Emrich et al. |
| D672,920 | S | 12/2012 | Durocher et al. |
| D677,006 | S | 2/2013 | Pfanner et al. |
| 8,418,270 | B2 | 4/2013 | Desjardins et al. |
| 8,756,719 | B2 | 6/2014 | Veazie |
| D778,504 | S | 2/2017 | Collette et al. |
| D804,729 | S | 12/2017 | Bouchard-Fortin et al. |

(Continued)

FOREIGN PATENT DOCUMENTS

| | | | | |
|---|---|---|---|---|
| GB | 2606179 A | * | 11/2022 | ..... A42B 3/064 |
| WO | 2018013996 A2 | | 1/2018 | |

OTHER PUBLICATIONS

PCT, International Search Report and Written Opinion, Appl. No. PCT/US2019/016654, dated Apr. 12, 2019, 9 pgs.

(Continued)

*Primary Examiner* — Tajash D Patel
(74) *Attorney, Agent, or Firm* — Lorenz & Kopf, LLP

(57) ABSTRACT

Disclosed are devices and methods for optimizing a protective helmet or other item of protective clothing with one or more enhanced principal impact zones and/or impact elements that incorporate protective features that can be particularized to a specific player-position and/or the individual behavior of a specific player or wearer.

18 Claims, 44 Drawing Sheets

(56) References Cited

U.S. PATENT DOCUMENTS

| | | | | |
|---|---|---|---|---|
| D836,253 | S | 12/2018 | Erb et al. | |
| D860,547 | S | 9/2019 | Daoust et al. | |
| 11,229,254 | B1 * | 1/2022 | Matteucci | A42B 3/063 |
| 2009/0307827 | A1 | 12/2009 | Aspray | |
| 2012/0017358 | A1 | 1/2012 | Princip et al. | |
| 2016/0255900 | A1 * | 9/2016 | Browd | A42B 3/125 |
| 2016/0278470 | A1 | 9/2016 | Posner et al. | |
| 2017/0303622 | A1 | 10/2017 | Stone et al. | |
| 2017/0303623 | A1 | 10/2017 | Sicking et al. | |
| 2018/0184745 | A1 * | 7/2018 | Stone | A42B 3/063 |
| 2018/0249778 | A1 * | 9/2018 | Brandt | B32B 9/047 |
| 2018/0343953 | A1 | 12/2018 | Erb et al. | |
| 2021/0000209 | A1 | 1/2021 | Neubauer et al. | |
| 2022/0110398 | A1 | 4/2022 | Reinhall et al. | |

OTHER PUBLICATIONS

Center for Applied Biomechanics at Univ. of Virginia and the NFL Engineering Committee [online], "NFL Video Review Webinar," Nov. 9, 2017, retrieved Jan. 31, 2022, <https://event.on24.com/eventRegistration/EventLobbyServlet?target=reg20.jsp&referrer-&eventid=1530677&sessionid=1&key=6F9DE2082FAA88BD475651BE77CA1B6A&regTag=&sourcepage=register> www.playsmartplaysafe.com, 1 page.

asphaltandrubber.com [online], "Gear Review: Shoei Neotec II Modular Helmet," Apr. 2, 2018, retrieved on Feb. 4, 2021, retrieved from URL<https://www.asphaltandrubber.com/reviews/shoei-neotec-ii-modular-helmet-review/>, 9 pages.

grainger.com [online], "Partial Crown, Headgear, Pinlock Faceshield Assembly", upon information and belief, available no later than Feb. 4, 2021, retrieved on Feb. 4, 2021, retrieved from URL<https://www.grainger.com/product/HONEYWELL-FIBRE-METAL-Headgear-Gray-15W971?searchQuery=15w971&searchBar=true>, 1 page.

International Preliminary Report on Patentability in Appln. No. PCT/US2019/016654, dated Aug. 20, 2020, 8 pages.

NFL.com [online], "Video Review Webinar," upon information and belief, available no later than Apr. 19, 2021, retrieved on Feb. 17, 2022, retrieved from URL<https://www.nfl.com/photos/video-review-webinar#1018d96b-56a4-4996-a531-232b7043bd0d>, 45 pages.

nflcommunications.com [online], "New Video Review Aims to Help Improve Designs for Protective Equipment," Nov. 19, 2017, retrieved on Feb. 18, 2022, retrieved from URL<https://nflcommunications.com/Documents/11.9.17%20Video%20Review%20Webinar%20News%20Release%20v2.pdf>, 3 pages.

teammotorcycle.com [online], "Icon Variant Double Stack Helmet Visor," Oct. 28, 2020, retrieved on Feb. 4, 2021, retrieved from URL<https://www.teammotorcycle.com/icon-variant-double-stack-helmet-visor>, 2 pages.

youtube.com [online], "Fox Rampage Pro Carbon | An Icon Redefined," Mar. 28, 2019, retrieved on Feb. 4, 2021, retrieved from URL<https://www.youtube.com/watch?v=wFBY-PFM4_k&feature=emb_logo>, 4 pages.

* cited by examiner

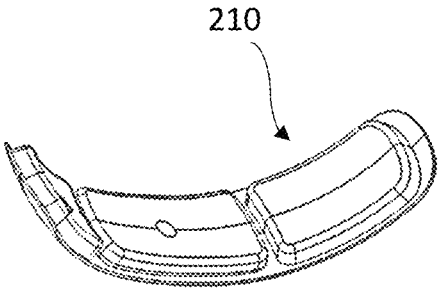
FIG. 16A
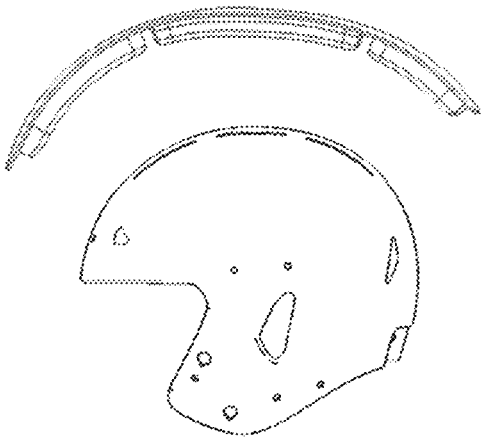
FIG. 16B
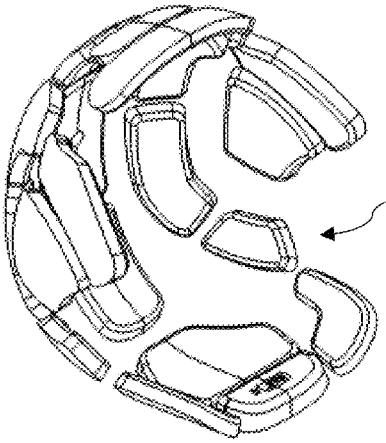
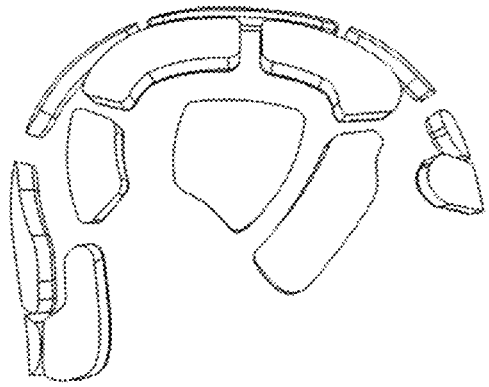
FIG. 17A
FIG. 17B

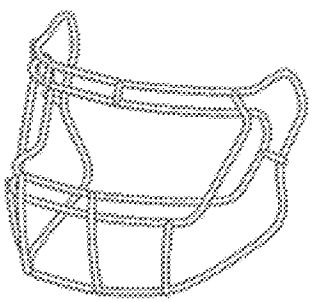
FIG. 27A
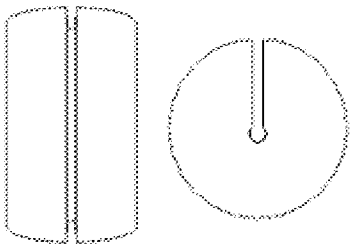
FIG. 27B
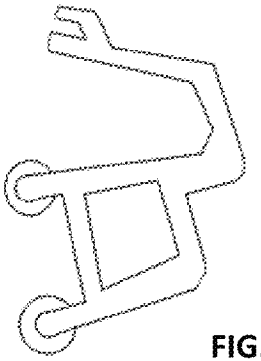
FIG. 27C
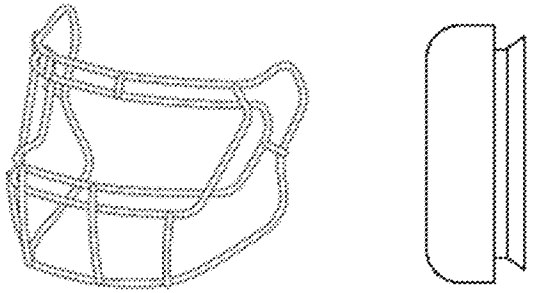
FIG. 28A
FIG. 28B
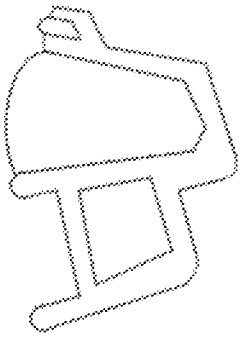
FIG. 28C

POSITION-SPECIFIC HELMET PROTECTION

CROSS-REFERENCE TO RELATED APPLICATIONS

This application claims the claims the priority of Patent Cooperation Treaty Application Serial No. PCT/US2019/016654, entitled "Position-Specific Helmet Protection," filed on Feb. 5, 2019, which claims the benefit of U.S. Provisional Patent Application Ser. No. 62/626,580, entitled "Position-Specific Helmet Protection," filed Feb. 5, 2018, the disclosure of which is incorporated by reference herein in its entirety.

TECHNICAL FIELD

The present invention relates to devices and methods for optimizing a protective helmet or other item of protective clothing with one or more enhanced principal impact zones and/or impact elements that incorporate protective features that can be particularized to a specific player-position and/or the individual behavior of a specific player. More specifically, the present invention relates to devices and methods that can be utilized to enhance and/or alter protective helmets and/or other protective clothing, including a potential to retrofit an existing commercially available helmet, modify existing commercially available helmet designs, and/or re-design a new helmet to provide player and/or or position-specific protections.

BACKGROUND OF THE INVENTION

Many modern organized sports employ helmets that are designed to provide the players with significant head protection, including a desire to provide adequate protection from traumatic brain injuries (TBI). Since safety is a primary concern, helmets have continually evolved in an attempt to reduce the risk and rate of concussions and/or other repetitive brain injuries, which can potentially end a player's career early and lead to long-term brain damage. This is especially true in American football, where the essential character of the athletic contest involves repeated player contacts, impacts and tackling. However, most current sport helmet designs fail to protect against some of the most dangerous impacts within a game.

Recently, there has been increased public attention on TBI's in American football, and their long-term effects on players. Such public attention has impelled large sports organizations and other researchers to conduct a comprehensive review and analysis of "impact data" in an attempt to understand how particular types and degrees of impacts can cause concussions or other player injuries during games. In 2017, NFL publicly released a data set webinar compiled from its own comprehensive review revealing differences in the source, activity type, play type, position, location, severity, and frequency of impacts each player position experienced on the field that led to a concussion diagnosis, the disclosure of which is herein incorporated by reference in its entirety (Video Review Webinar, Center for Applied Biomechanics at Univ. of Virginia and the NFL Engineering Committee, www.playsmartplaysafe.com).

As a result, there is an opportunity to move away from universal helmet structure designs into optimized helmet structure designs that are tailored to the particular demands of each player position. Such optimized helmet design can further mitigate impact forces by directing additional protection where its most needed for each player position—i.e., a position-specific helmet.

BRIEF SUMMARY OF THE INVENTION

In various embodiments, the present invention includes that the realization that individual players and/or player positions in a given athletic competition (including, but not limited to American football) may be prone to experiencing at least one of the various factors or a combination of two or more factors revealed in the attached figures and/or the 2017 NFL study (i.e., a "position-specific" purpose), the disclosure of which is incorporated by reference herein in its entirety. It should be understood that the manufacture of a position-specific (PS) helmet or retrofitting of commercially available (CA) helmet with position-specific protections may require a method for the initial ranking of the particular factors to concentrate most relevant supplemental impact protective elements into the helmet design. The method of initial ranking may comprise the steps of including and/or ranking one or more primary factors and/or impact zones, along with various combinations of less-frequent secondary factors and/or impact zones. Subsequently, the ranking can further include even less frequent tertiary factors and/or impact zones, quaternary factors and/or impact zones, and so on. In such cases, it is possible to improve the impact performance of a given helmet or other new protective structure helmet designs in a specific manner to accommodate the most frequent and/or most devastating types of injuries for a particular player and/or player position. In various embodiments, such "improvements" could include features that might improve, degrade and/or not affect helmet performance against other less-frequent impact types and/or impact zones.

In various embodiments, an optimized helmet design or a position-specific (PS) helmet can incorporate additional or supplemental protection elements that may be tailored to the particular demands of each player and/or player position, which could include (1) retrofitting a commercially available helmet with or without minor modifications (2) retrofitting a commercially available helmet with significant helmet modifications and/or (3) designing a new, customized helmet system incorporating player-specific and/or position-specific protective features and/or attributes.

In one exemplary embodiment, a position-specific helmet may incorporate a supplemental impact protective element. The position-specific helmet can comprise a helmet, and a supplemental impact protective element. The helmet may comprise an outer layer. The helmet may further comprise an inner layer and/or an impact mitigation layer, the impact mitigation layer disposed between the inner and outer layer. The helmet may further comprise a comfort liner. Furthermore, the helmet may comprise a commercially available helmet and/or a custom helmet design. The supplemental impact protective element may be coupled to a portion of the helmet, the coupling to a portion of the helmet may comprise one or more specific regions of the helmet. The coupling may further comprise within the one or more specific regions or within proximity to the one or more specific regions. The specific regions may comprise one frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination thereof. The supplemental impact protective element may comprise a supplemental impact protective system, one or more one or more supplemental impact protection elements individual assemblies, one or more supplemental impact protective pads, one or more supplemental impact protective bumpers, one or more supplemental impact domes, and/or any combination(s) thereof.

In another exemplary embodiment, a position-specific helmet may comprise a modular helmet assembly. The modular helmet assembly may comprise a plurality of helmet modular portions. Each of the plurality of helmet modular portions may correspond to one or more various specific regions. The specific regions can comprise a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof. One or more of the helmet modular portions may comprise a supplemental impact protective element and/or a supplemental impact protective material. Each of the plurality of helmet modular portions may be removably connected to each of the adjacent plurality of helmet modular portions.

In another exemplary embodiment, a position-specific helmet may comprise a recessed helmet assembly. The position-specific helmet may comprise a helmet and a supplemental impact protective element. The helmet may comprise an outer layer. The helmet may further comprise an inner layer and/or an impact mitigation layer, the impact mitigation layer disposed between the inner and outer layer. The helmet may further comprise a comfort liner. Furthermore, the helmet may comprise a commercially available helmet and/or a custom helmet design. The outer layer, inner layer, impact mitigation layer, and/or comfort liner may comprise a first surface and a second surface. The first and/or second surfaces may comprise one or more recesses and/or cavities. The recesses and/or cavities are sized and configured to receive the supplemental impact protective element. The supplemental impact protective element may be sized and configured to be partially and/or fully positioned with the recesses and/or cavities of the first and/or second surfaces. The supplemental impact protective element may comprise a supplemental impact protective system, one or more one or more supplemental impact protection elements individual assemblies, one or more supplemental impact protective pad, one or more supplemental impact protective bumpers, one or more supplemental impact domes, and/or any combination(s) thereof.

In another exemplary embodiment, a position-specific helmet may comprise a latticed framework. The position-specific helmet may comprise a helmet, a supplemental impact protective element, and a lattice framework. The helmet may comprise an outer layer. The helmet may further comprise an inner layer and/or an impact mitigation layer, the impact mitigation layer disposed between the inner and outer layer. The helmet may further comprise a comfort liner. Furthermore, the helmet may comprise a commercially available helmet and/or a custom helmet design. The lattice framework maybe removably connected to the outer layer and/or inner layer. The supplemental impact protective element may be coupled to the lattice framework and/or to the helmet. The supplemental impact protective element may comprise a supplemental impact protective system, one or more one or more supplemental impact protection elements individual assemblies, one or more supplemental impact protective pads, one or more supplemental impact protective bumpers, one or more supplemental impact domes, and/or any combination(s) thereof.

In another exemplary embodiment, a method to manufacture a position-specific helmet may be desirable. The method comprises the steps of: collecting player performance data for the player, the player performance data comprising data regarding a series of impact events occurring to the protective helmet of the player; analyzing the player performance data to determine at least one position-specific region on the protective helmet where a plurality of the series of impacts events occur; securing a supplemental impact protective element to the protective helmet onto and/or in proximity to the at least one position-specific region.

In another exemplary embodiment, the a method to manufacture a position-specific helmet may further comprise the steps of securing the supplemental impact protective element to the protective helmet in proximity to the at least one common location comprises attaching a supplemental impact protective element to an outer surface of the protective helmet at least partially over the one common location; securing the supplemental impact protective element to the protective helmet in proximity to the at least one common location comprises attaching a supplemental impact protective element to an inner surface of the protective helmet at least partially under the one common location; securing the supplemental impact protective element to the protective helmet in proximity to the at least one common location comprises replacing at least a portion of an existing impact protection layer of the protective helmet in proximity to the one common location; the step of securing the supplemental impact protective element to the protective helmet in proximity to the at least one common location comprises creating an additional opening at least a portion of the protective helmet and securing at least a portion of the supplemental impact protective element to the protective helmet using the additional opening; and/or the step of securing the supplemental impact protective element to the protective helmet in proximity to the at least one common location comprises attaching the supplemental impact protective element to the protective helmet without substantially altering the protective helmet, and/or any combination thereof.

BRIEF DESCRIPTION OF THE SEVERAL VIEWS OF THE DRAWINGS

FIGS. 16A-16B depict views of one exemplary embodiment of a ridge assembly with a base membrane;

FIG. 17A-17B depict various views of one embodiment of a supplemental impact protection system without a base membrane;

FIGS. 27A-27C depict views of one exemplary embodiment of an impact protective tube that may be affixed to at least a portion of a facemask frame;

FIGS. 28A-28C illustrate views of an alternate exemplary embodiment of a flanged impact protective element that may be affixed to at least a portion of a facemask frame;

DETAILED DESCRIPTION OF THE INVENTION

The various optimized position and/or player-specific helmet components and designs provided herein are depicted with respect to American football, but it should be understood that the various devices, methods and/or components may be suitable for use in protecting players in various other athletic sports, as well as other occupations that require protection, such as law enforcement, military, construction and/or informal training session uses. For example, the embodiments of the present invention may be suitable for use by individuals engaged in athletic activities such as baseball, bowling, boxing, cricket, cycling, motorcycling, golf, hockey, lacrosse, soccer, rowing, rugby, running, skating, skateboarding, skiing, snowboarding, surfing, swimming, table tennis, tennis, or volleyball, or during training sessions related thereto.

Position-Specific Helmets

The term "position-specific helmets" should not be limited to tailored helmet designs for only a player's position and/or individual play-type, but may include supplemental impact protective elements that address or tailor the helmet and/or other protective garment to accommodate the at least one of the various factors or a combination of two or more factors revealed in the attached figures and/or the 2017 NFL study (i.e., a "position-specific" purpose), the disclosure of which is incorporated by reference herein in its entirety. The factors may include, but not limited to, locations and/or degrees of impact or other forces, including (but not limited to). Such factors may include one or more of the following: source of impact, angle of impact, player activity type, play type, player position, location of impact, angle of impact, severity of impact, and/or frequency of impacts.

Figure 1:
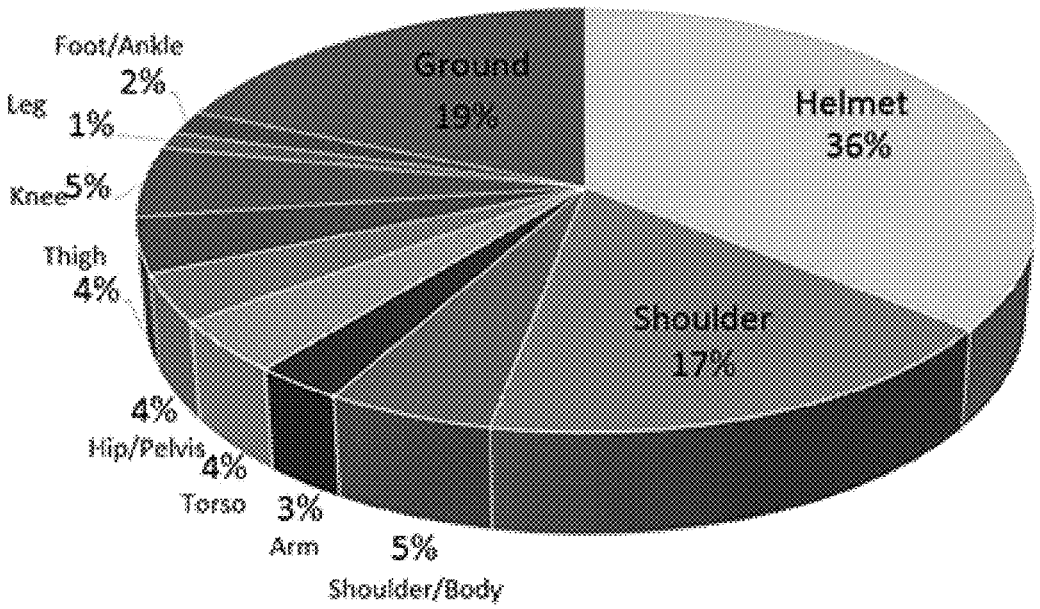
FIG. 1 illustrates a pie graph of one exemplary distribution of helmet impact sources to the body.

In at least one exemplary embodiment, a "position-specific" helmet design can be optimized based on the distribution of helmet impact sources, such as shown in FIG. 1, which depicts exemplary sources of concussion-causing impacts to player helmets during the 2015 to 2016 NFL playing season (n=325 concussions). Impact sources may include helmet-to-body, helmet-to-helmet, helmet-to-ground. In the NFL study, helmet-to-body impacts were 45%, and this was the highest proportion for the source of impact, with helmet-to-helmet accounting for 36%, and a lower proportion for helmet-to-ground impacts at 19%. Helmet-to-body impacts collectively included helmet-to-foot/ankle, leg, knee, thigh, hip/pelvis, torso, arm, shoulder/body, and shoulder. The speed, direction, and magnitude of forces can be collected at each impact source and analyzed to tailor impact protective elements for the specific impact source.

In one exemplary embodiment, a method of designing a position specific helmet and/or associated supplemental protective pad or element system could include aggregating data on helmet impacts and/or other player performance data; analyzing aggregated data, ranking aggregated data, and designing one or more associated supplemental impact protective element systems to make a position-specific helmet. The aggregated data might include data obtained from game films, medical records, player anecdotal information and/or helmet-monitoring sensors and/or systems, which might include real-time and/or retrospective review and assessment of "hit data" for an individual player and/or player position. The aggregated data may further comprise data from the 2017 NFL Study. If desired, assessment could be performed in real-time and/or on a seasonal and/or partial seasonal basis (i.e., after each game). Upon assessment, one or more supplemental protective pad components could be incorporated into a CA helmet for use by the player, which could include removal and/or replacement of damaged and/or defective helmet components (if desired).

Figure 2:
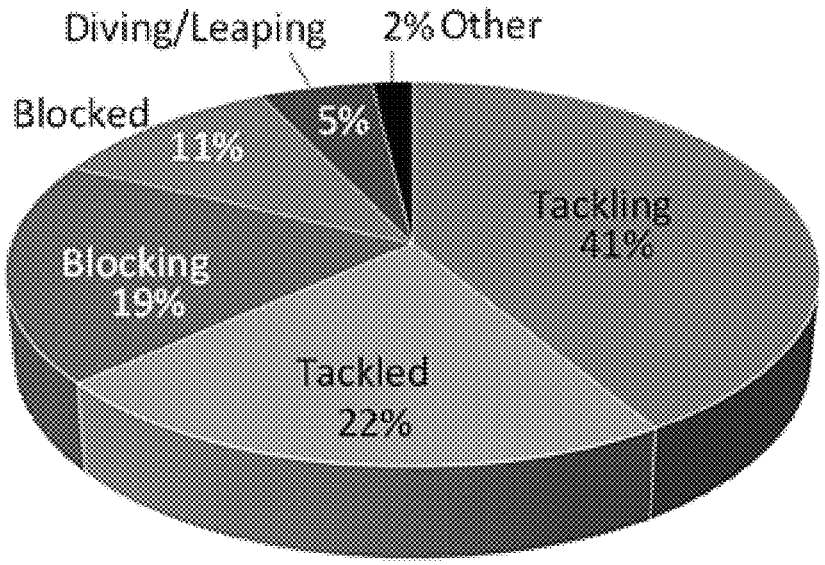
FIG. 2 illustrates a pie graph of exemplary distributions of the types of player activity during impact.

In another exemplary embodiment, a "position-specific" helmet can be optimized based on player performance data comprising the player activity type, such as a graph of the concussed player activity shown in FIG. 2. The player impact type can include tackling (41%), being tackled (22%), blocking (19%), being blocked (11%), diving/leaping (5%), and/or any combination thereof. The speed, direction, and magnitude of force can be collected during each player activity and analyzed to tailor impact protective elements for the specific player and/or player position activity, with the helmet optionally subject to further assessment and/or modification (as described herein) on an as-needed basis. Such a feedback-based system could significantly improve helmet and player performance.

Figure 3A:
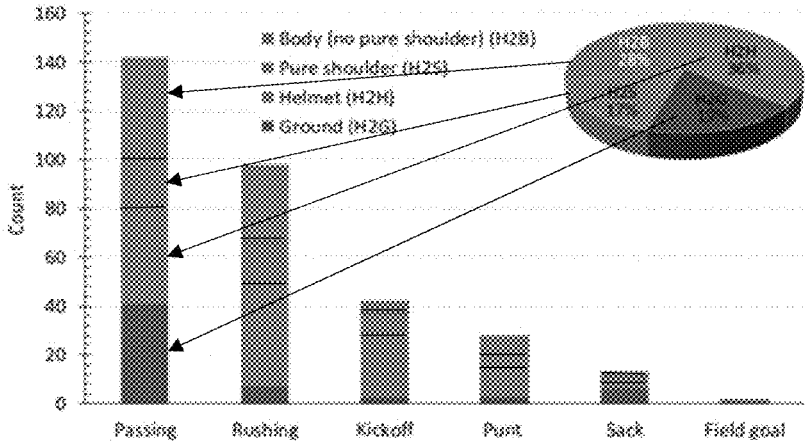
FIGS. 3A-3B illustrate bar graphs of exemplary frequencies of impacts relative to the impact source, the player activity, and/or the player position.
Figure 3B:
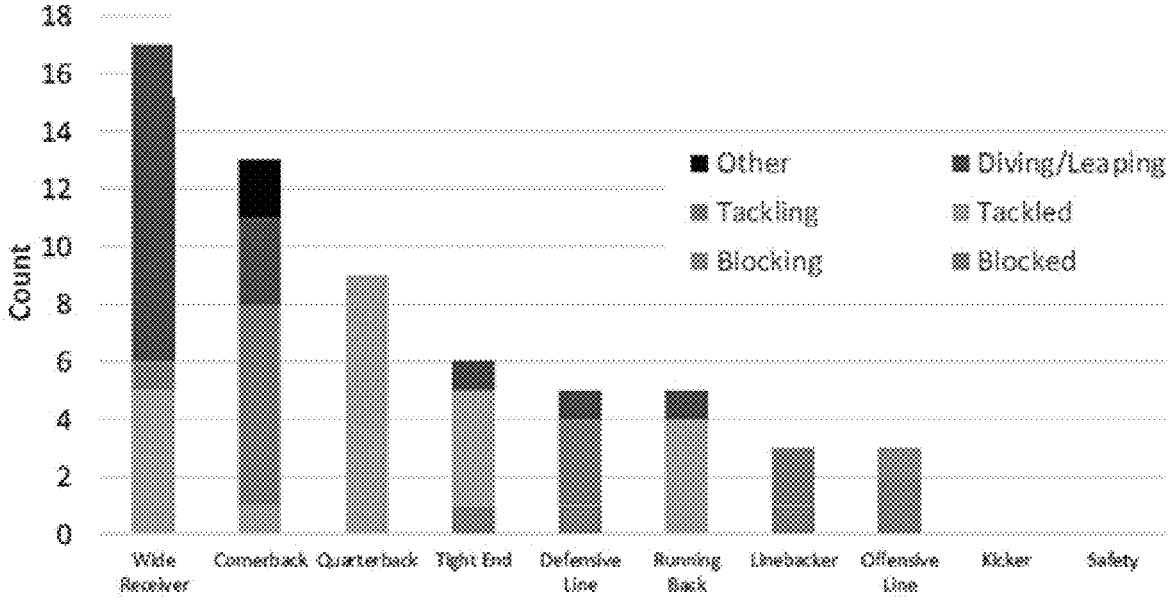

In another exemplary embodiment, a "position-specific" helmet can be optimized based on the player performance data comprising frequency of impact, such as shown in a "video review summary of play types" (FIG. 3A) or a list of "Head to Ground (H2G) concussed player activity during the NFL 2015-2016 season—n=61" (FIG. 3B). For example, the frequency of impact can be compared to the player activity type and/or to player position. Alternatively, various of the remaining factors may be considered to help optimize a position-specific helmet to rank the importance or the need for such optimized position-specific helmet (which could include assessment of low-frequency impact types).

In various exemplary embodiments, a "position-specific" helmet can be optimized based on the player performance data comprising a player position and/or a play-type. The player positions can include cornerback (22%), wide receivers (15%), linebackers (11%), Offensive line (11%), safety (10%), running back (10%), tight end (8%), defensive line (6%), quarterback (5%), kicker (1%), and/or any combination thereof. The speed, direction, and magnitude of impact and/or player force can be collected during each player activity and analyzed to tailor impact protective elements for the specific player position.

Figure 4:
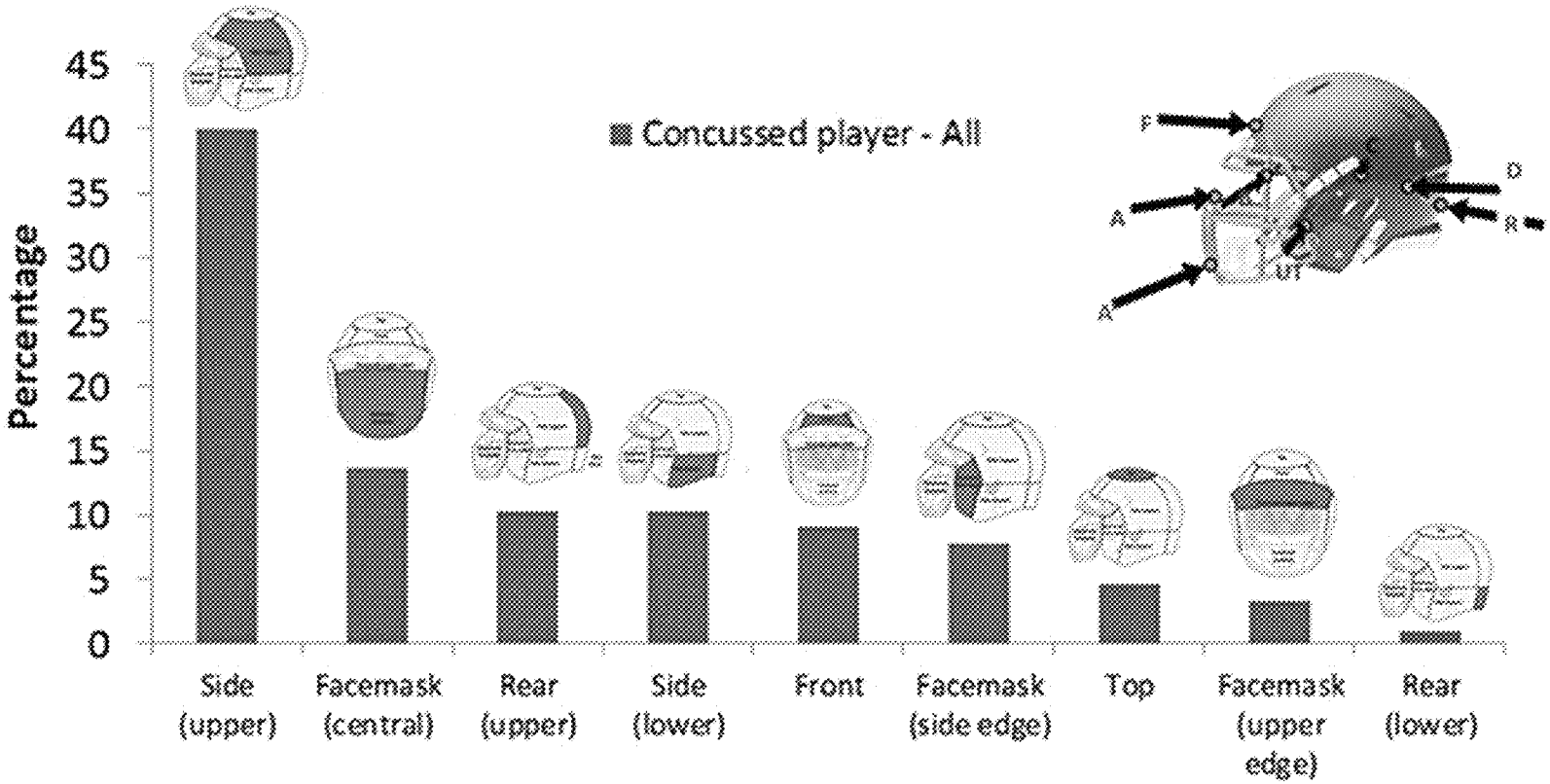
FIG. 4 illustrates a bar graph of exemplary impact locations for all impact types.

In another exemplary embodiment, a "position-specific" helmet can be optimized based on the player performance data comprising location of impact, such as shown in a chart of "impact locations—all impact types—for the NFL 2015-2016 playing season (n=325)" shown in FIG. 4. The location of impacts can include upper side (40%), facemask (13%), rear (10%), lower side (10%), front (8%), facemask, side edge (7%), top (5%), facemask, upper edge (3%), rear (1%), and/or any combination(s) thereof. The speed, direction, and magnitude of forces can be collected at location of impact and analyzed to tailor impact protective elements for the specific player position.

Figure 5A:
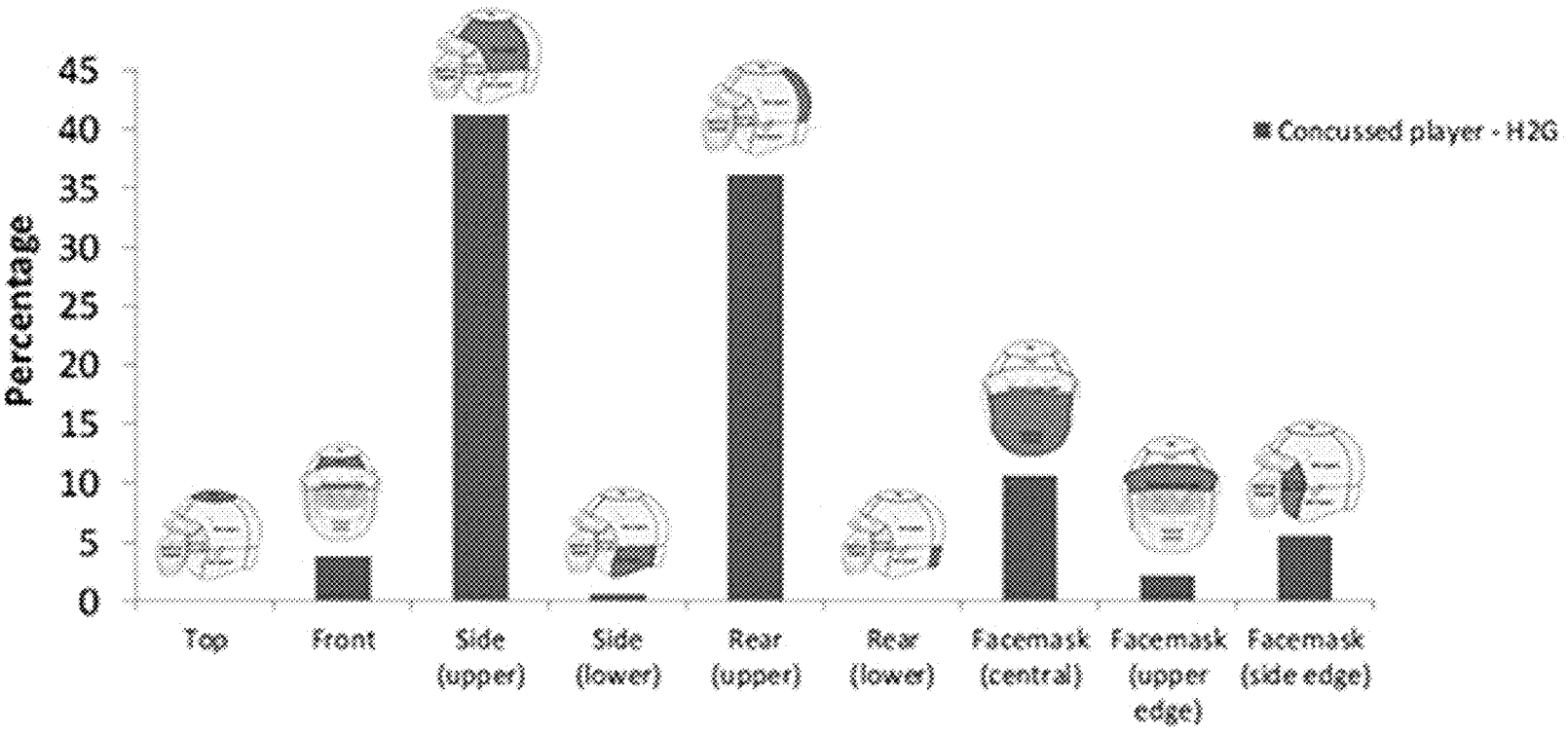
FIGS. 5A-5B illustrate bar graphs of exemplary impact locations relative to the impact source.
Figure 5B:
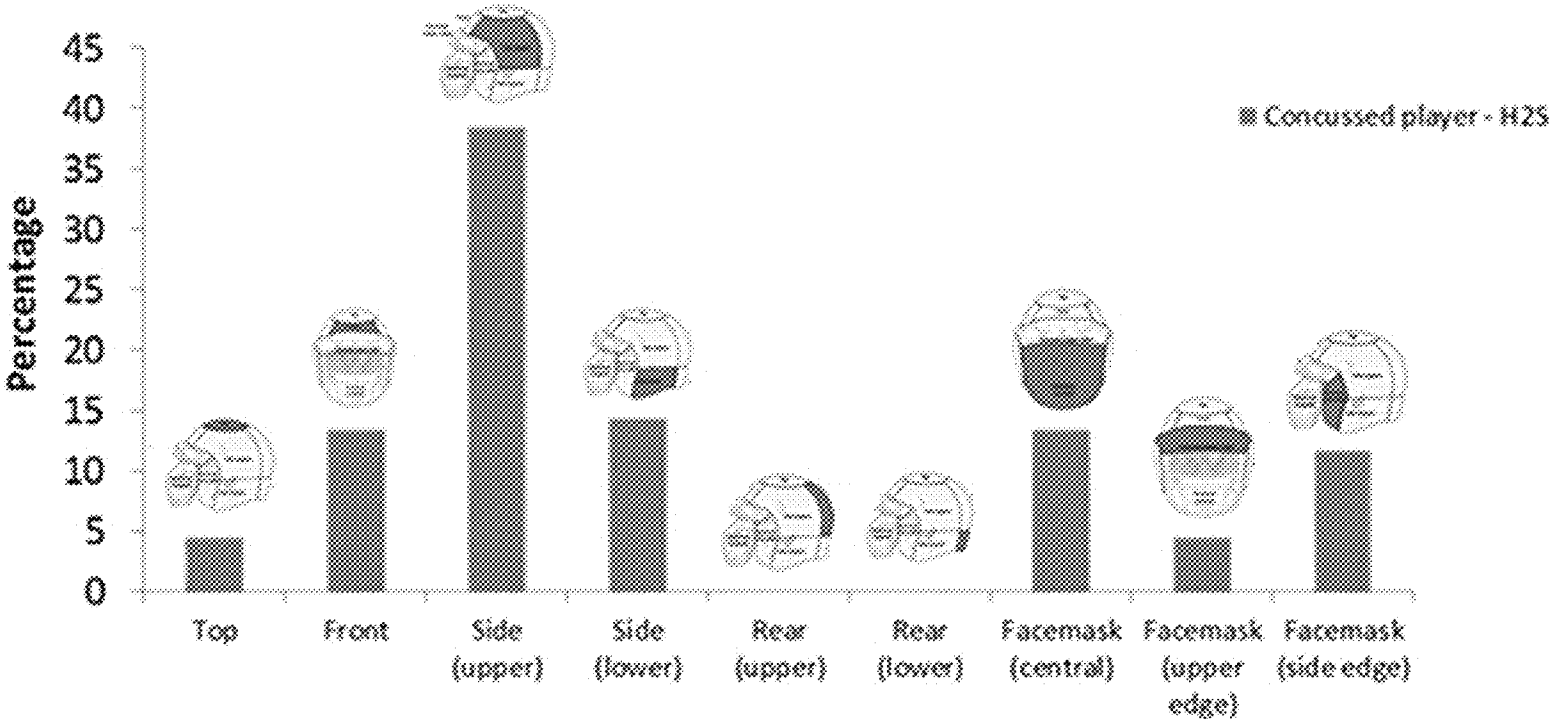
Figure 5C:
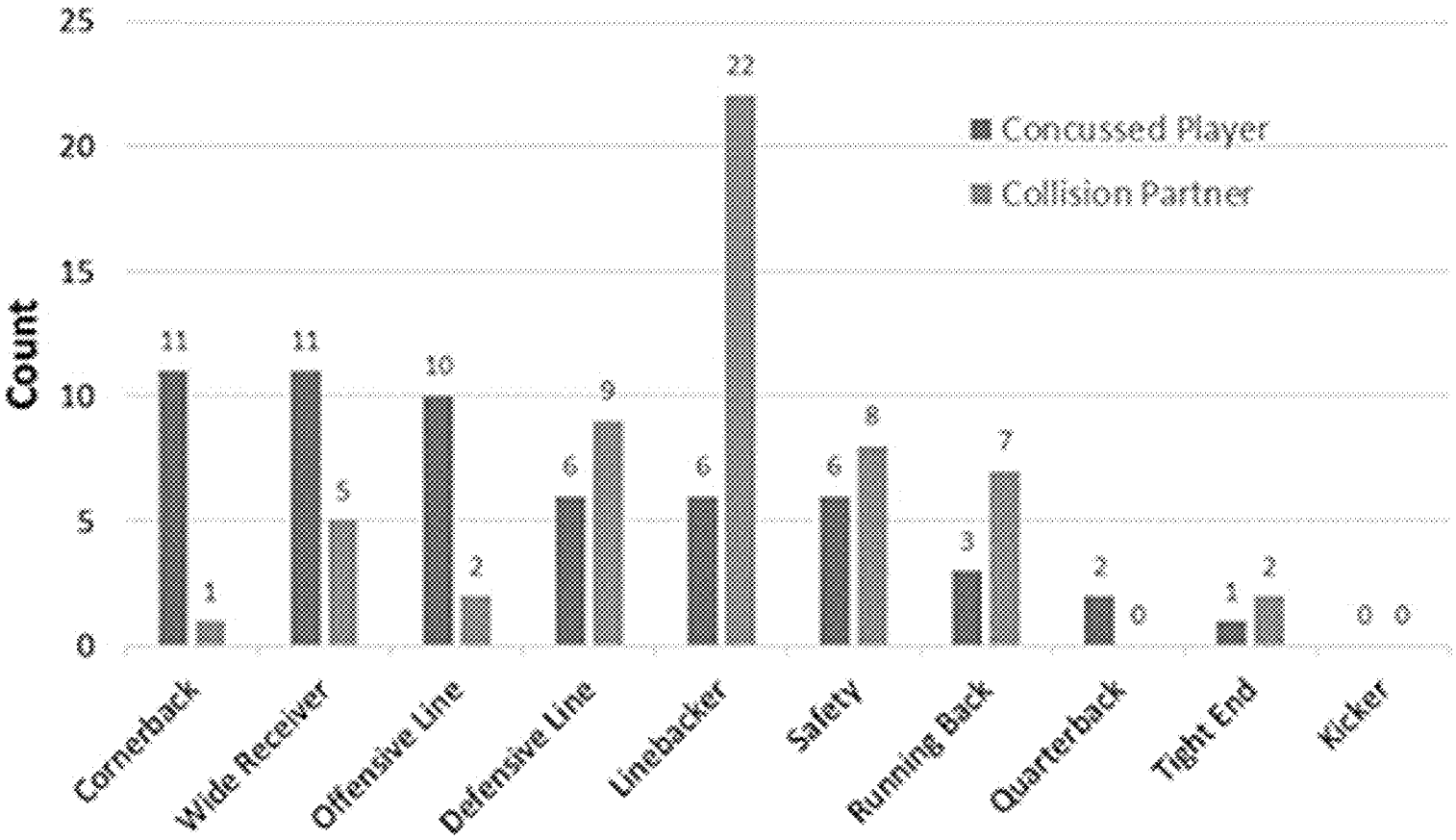
FIGS. 5C-5D illustrate bar graphs of exemplary impact frequencies relative to the player position and impact source.
Figure 5D:
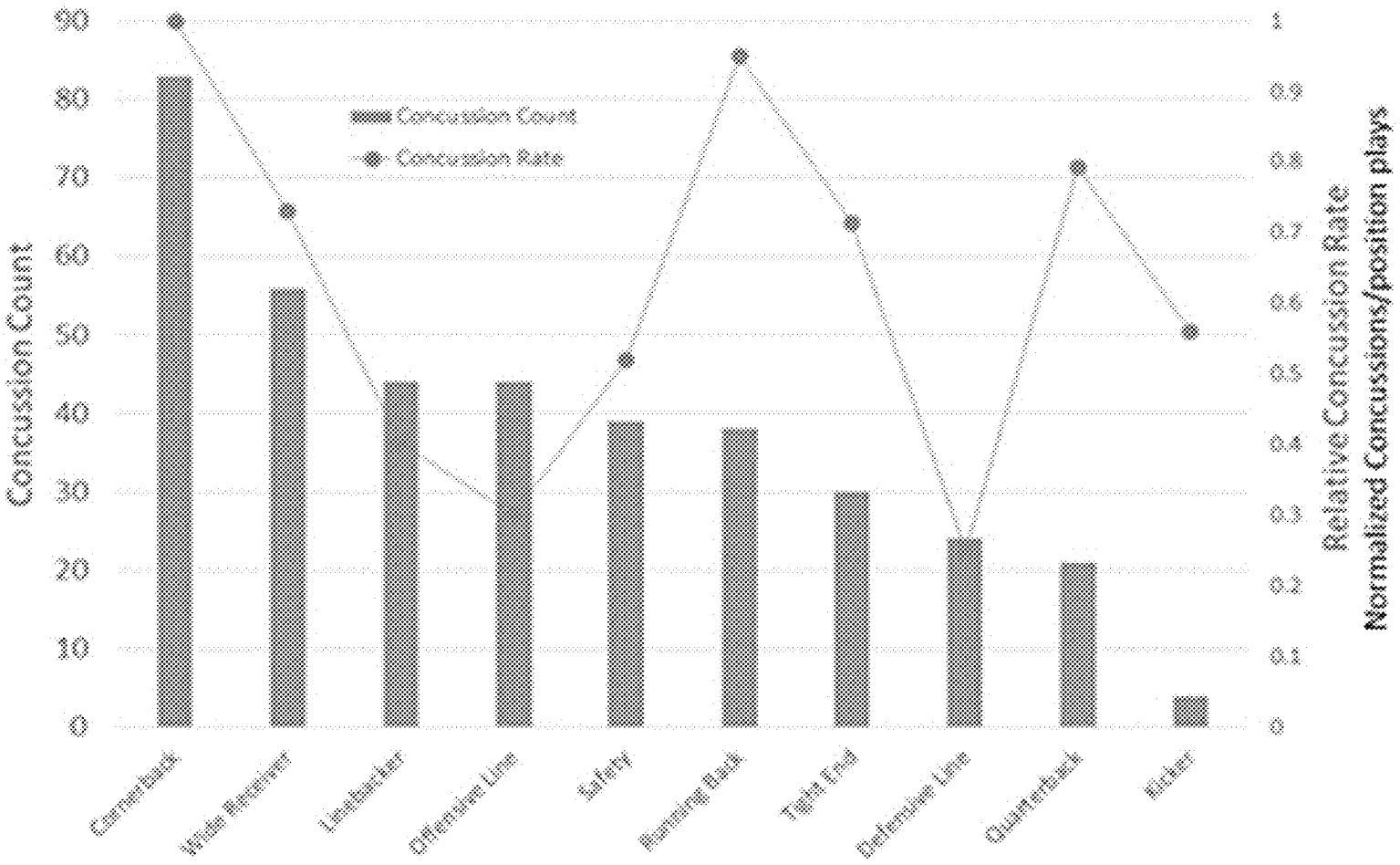
Figure 6A:
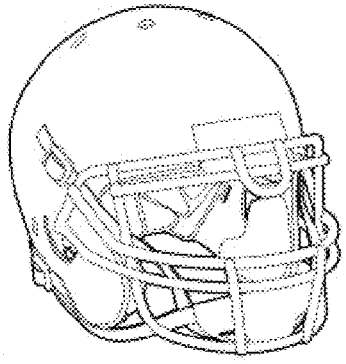
FIGS. 6A-6C, 7A-7D, 8A-8D, and 9A-9D depict different types of commercially available helmets with different shapes, orientations, positions, and/or configurations of existing protective features.
Figure 6B:
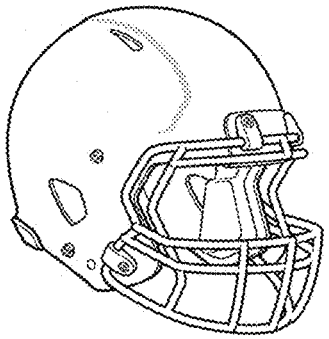
Figure 6C:
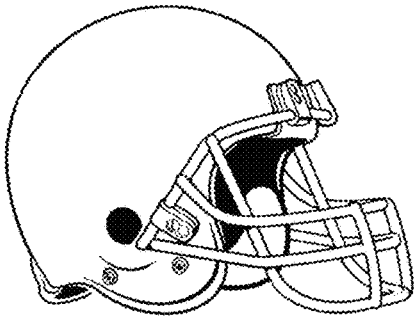
Figure 7A:
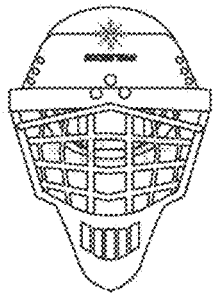
Figure 7B:
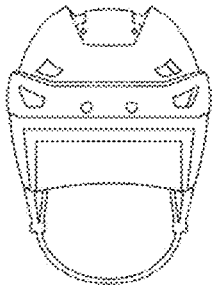
Figure 7C:
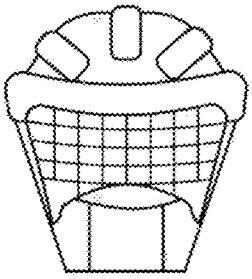
Figure 7D:
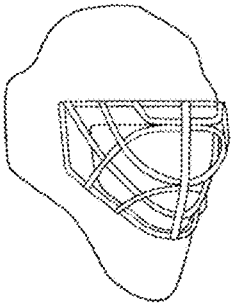
Figure 8A:
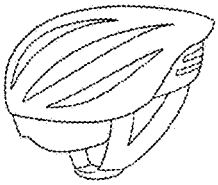
Figure 8B:
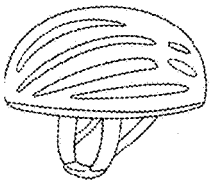
Figure 8C:
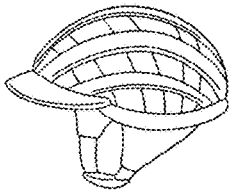
Figure 8D:
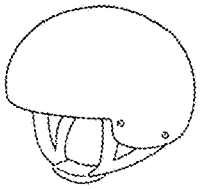
Figure 9A:
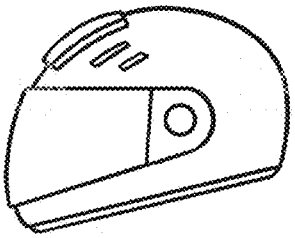
Figure 9B:
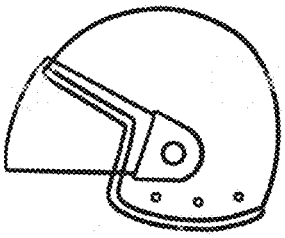
Figure 9C:
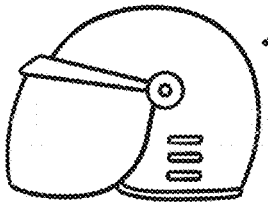
Figure 9D:
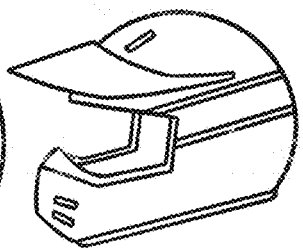

In various alternative embodiments, combinations of two or more factors involving player performance data can be considered for a given position-specific impact protective element design. For example, the player activity type with source of impact data may be used to tailor a position-specific helmet. FIG. 5A illustrates a bar graph of "Head 2 Ground (H2G) impact locations for the NFL 2015-2016 player season (n=61)," FIG. 5B illustrates a bar graph of "Head 2 Shoulder (H2S) impact locations for the NFL 2015-2016 player season (n=56)," FIG. 5C illustrates a bar graph of "Player and Collision Partner Position for Helmet to Shoulder Impacts for the NFL 2015-2016 player season (n=56)," and FIG. 5D illustrates a bar graph of "Concussions by Player Position for the NFL 2015-2016 player season (n=383)." These graphs depict various of the proportional source of impacts related to a player activity, player position and/or player to location of impact, including frequency of impacts relative to the impact source and/or player position.

Described herein are many specific embodiments, but these should not be construed as limitations on the scope of any inventions or of what may be claimed, but rather as descriptions of factors specific to various implementations of the present inventions. Certain factors described herein in the context of separate implementations can also be implemented in a single implementation. Conversely, various factors described in the context of a single implementation can also be implemented in multiple implementations separately or in any suitable subcombination. Furthermore, the factors as described above may be recited as acting in certain combinations and even initially claimed as such, one or more factors from a claimed combination can in some cases be excised from the combination, and the claimed combination may be directed to a subcombination or variation of a subcombination.

Retrofitting Commercially Available Helmets With or Without Minor Modifications

In various embodiments, retrofitting a commercially available helmet (CA helmet) into a position-specific helmet (PS helmet) may be accomplished without any CA helmet modifications and/or with minor" CA helmet modifications. "Without any CA helmet modifications" is defined as using methods or mechanisms for attaching and/or securing components that affix additional or supplemental impact protection elements related to a "position-specific" factor (or combination of "position-specific" factors) to a CA helmet without modifying the helmet design or helmet structure. "Minor CA helmet modifications" is defined as using methods or mechanisms that affix impact protection elements related to a "position-specific" factor (or combination of "position-specific" factors) to a CA helmet with making minor modifications to the CA helmet design or helmet structure, such as by adding minor amounts of additional structure, removing minor amounts of helmet structure and/or making helmet modifications that do not significantly affect the durability and/or the performance of the CA helmet to a significant degree. In various embodiments, the supplemental impact protection elements may be affixed with at least one of static, dynamic, permanent and/or detachable (i.e., connectedly removable) elements.

In one embodiment, the supplemental impact protection elements may be affixed to existing features on a CA helmet to eliminate the need to make minor modifications. FIGS. 6A-6C, 7A-7D, 8A-8D, and 9A-9D depicts a non-exhaustive list of different types of commercially available helmet designs to show that the amount, shape, orientation, position, and/or configuration of various existing features can vary, based on the helmet manufacturer and/or helmet design.

Furthermore, it should be understood that manufacturers design CA helmets with varying configurations that may reasonably protect the player. Each manufacturer may optionally include one or more of helmet outer layer, the impact absorbing layer, the inner layer, a comfort pad liner, and/or any combination thereof. It is contemplated that a commercially available (CA) helmet from ANY manufacturer or other item of protective clothing can be retrofitted, modified and/or redesigned to incorporate one or more of various components and/or systems described herein. For example, some CA helmet designs may (1) incorporate an outer layer with inflatable bladder pads as an impact absorbing layer and/or impact foam inside of the outer layer, optionally including comfort foam liner assembly (including helmet designs commercially available from RIDDELL, Inc. of Elyria, Ohio, USA), (2) incorporate an outer layer with an impact absorbing layer comprising Thermoplastic Polyurethane Elastomeric cones (or other shapes) disposed inside of the outer layer, optionally with inflatable and/or comfort foam liner assembly (including helmet designs commercially available from SCHUTT SPORTS MANUFACTURING CO. of Litchfield, Illinois, USA), (3) incorporate an outer layer with an impact absorbing layer that includes bonnet holding shock absorbers, optionally with a comfort foam pad liner assembly (including helmet designs commercially available from XENITH. LLC of Detroit, Michigan, USA), and/or (4) incorporate an outer layer encompassing an interface layer and/or impact absorbing structures, with an inner layer and optional comfort pad liner assemblies or individual pads such as impact foam and/or comfort foam (including helmet designs commercially available from VICIS, Inc. of Seattle, Washington, USA). It should be understood that these specific CA helmets are merely exemplary embodiments, and supplemental protective devices, systems and/or pads such as those described herein could be utilized with virtually any helmet design from any manufacturer (which all helmet designs of different configurations are representative of a "CA helmet"), with varying results.

Figure 10:
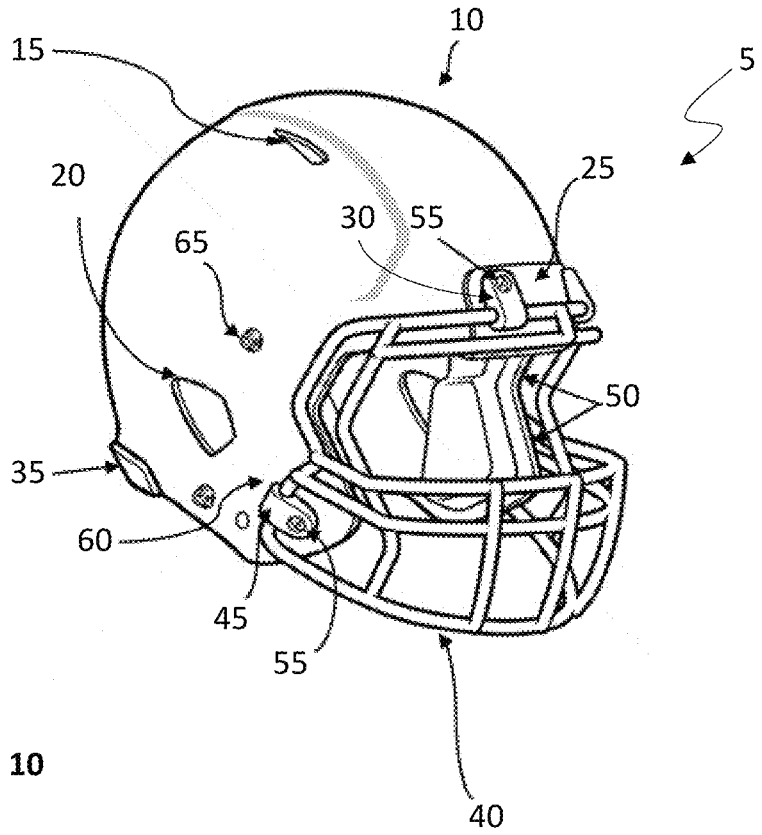
FIG. 10 depicts a front perspective view of one embodiment of a football helmet.

In many embodiments, there may be common features that exist between the different CA helmet designs that may be accessible from the outer layer, from the impact absorbing and/or attenuating layer, from various other inner layer(s), via the comfort pad liner assembly and/or via individual comfort pads, and/or any combination thereof. FIG. 10 depicts a front perspective view of one embodiment of a football helmet 5, illustrating examples of existing features that may be available on from the helmet outer layer 10 for attachment and/or securement of PS components and/or modules. These existing features can include one or more vent holes 15 (front, top, middle, rear, right side, left side, jaw flap, etc.), ear holes 20, a front bumper 25, front bumper connectors 30, a back bumper 35, back bumper connectors (not shown), a visor (not shown), visor connectors (not shown), a facemask 40, facemask connectors 45, a chin strap and chin strap connectors (not shown), at least a portion of the edge or ledge of the helmet 50, threaded screw holes 55, and/or any and all combinations thereof. For example, existing features may include at least two or more combinations of vent holes (front, top, middle, rear, right side, left side, jaw flap 60, etc.), ear holes, front bumper, front bumper connectors, back bumper, back bumper connectors, visor, visor connectors, facemask, facemask connectors, chin strap, chin strap connectors, at least a portion of the edge or ledge of the helmet, threaded screw holes, attachment snaps 65 and/or any combination thereof.

Figure 11:
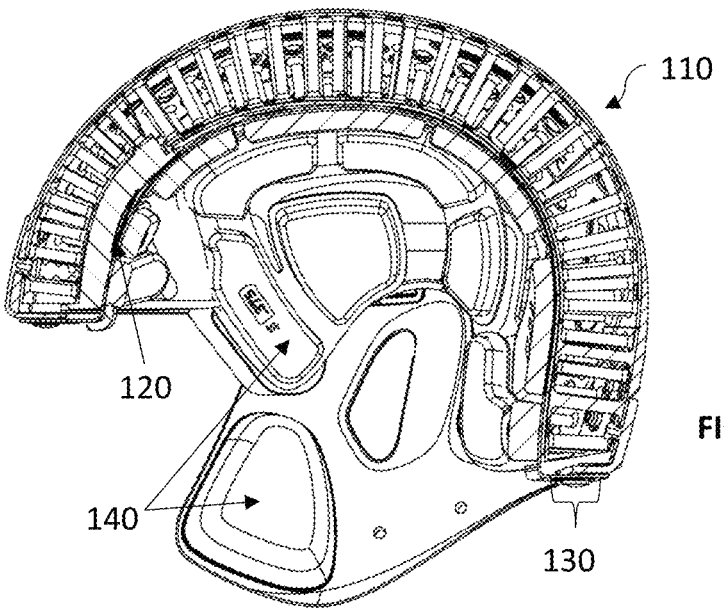
FIG. 11 depicts a cross-sectional view of a commercially available (CA) helmet.

FIG. 11 depicts a cross-sectional view of an alternate embodiment of a CA helmet design. This embodiment illustrates a CA helmet outer layer 110, a CA helmet inner layer 120, a CA helmet impact absorbing or reflex layer 130, a comfort pad liner assembly 140 and/or any combination thereof. Conversely, the CA helmet may have at least one of a CA helmet outer layer, a CA helmet inner layer, a CA helmet impact absorbing layer, a comfort pad liner assembly and/or any combination thereof.

In one exemplary embodiment, the CA helmet may comprise a CA helmet outer layer. The CA helmet outer layer may have a first impact mitigating structure affixed to the inner surface of the CA helmet outer layer, where the impact mitigating structures forms an impact absorbing layer. Alternatively, a second impact mitigating structure (covered, uncovered, with foam layer or without foam layer) may be affixed to the first impact mitigating structure and may form the inner layer. The CA helmet outer layer may be manufactured from a polymer. The polymer may be relatively rigid. Conversely, the polymer can be pliable enough to locally deform with subject to an incident force.

In another exemplary embodiment, the CA helmet may comprise a CA helmet outer layer with inflatable bladder pads and/or impact foam inside of the outer shell, optionally including comfort foam liner elements. The CA helmet outer layer may be manufactured from a polymer. The polymer may optionally be relatively rigid.

In another exemplary embodiment, the CA helmet may comprise a CA helmet outer layer with internally positioned Thermoplastic Polyurethane Elastomeric cones (or other shapes) inside of the shell, optionally with inflatable and/or comfort foam liner elements. The CA helmet outer layer may be manufactured from a polymer. The polymer may optionally be relatively rigid.

In another exemplary embodiment, the CA helmet may comprise a CA helmet outer layer with an interior bonnet holding shock absorbers, optionally with a comfort foam liner. The CA helmet outer layer may be manufactured from a polymer. The polymer may optionally be relatively rigid.

In another embodiment, the CA helmet may comprise a CA helmet outer layer and inner layer, where the impact absorbing layer is disposed between the outer and inner layer. The CA helmet outer layer may be manufactured from a polymer. The polymer may be relatively rigid. Conversely, the polymer can be pliable enough to locally deform with subject to an incident force. The CA helmet inner layer may be relatively rigid or deformable (e.g. a foam layer). If CA helmet inner layer is relatively rigid, it may help prevent projectiles or intense impacts from fracturing the skull. The CA helmet inner layer may be five times more rigid than the CA helmet outer layer.

Where more than one shell is provided, the impact mitigating structure may be disposed between shells forming an impact absorbing layer. The impact absorbing layer may comprise one or a plurality of impact mitigating structures, such as filaments that are disposed within the impact absorbing layer. Conversely, the impact absorbing layer may comprise any of the impact mitigating structures disclosed herein.

Figure 12A:
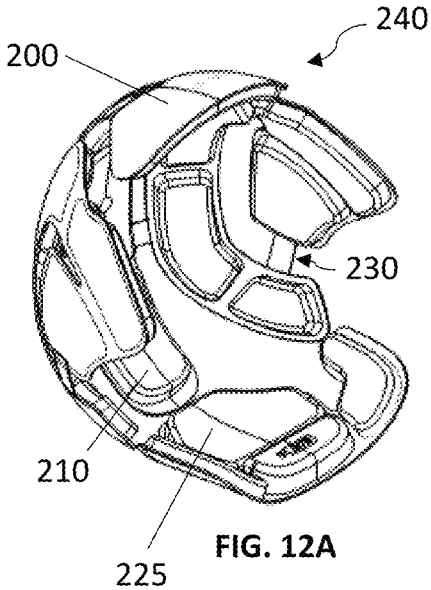
FIGS. 12A-12B depict various views of one embodiment of a full helmet system incorporating impact protection elements with a base membrane.
Figure 12B:
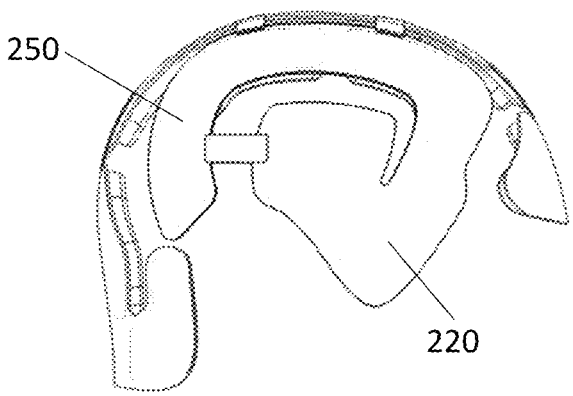
Figure 14A:
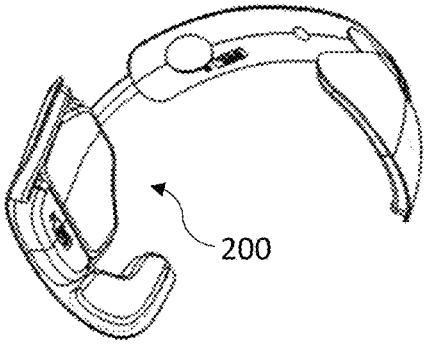
FIGS. 14A-14C depict various views of one exemplary embodiment of a front and back assembly with a base membrane.
Figure 15A:
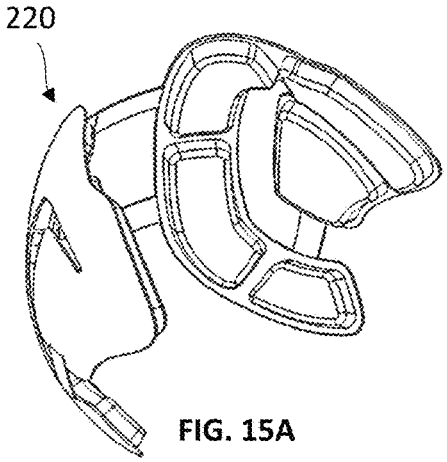
FIGS. 15A-15C depict various views of one exemplary embodiment of a right and left assembly with a base membrane.

FIGS. 12A and 12B depict various views of one embodiment of a position-specific helmet comprising a supplemental impact protection elements system 240 with a base membrane 250. The supplemental impact protection elements system can include at least one of a front-back impact protection assembly 200 (depicted separately in FIG. 14A), a ridge impact protection assembly 210 (depicted separately in FIG. 16A), a right-left impact protection assembly 220 (depicted separately in FIG. 15A), and/or any combination thereof. Each supplemental impact protection element within each assembly may include at least one or more individual impact protection pads 225 and at least one base membrane 250. Optionally, each of the assemblies may be linked by a flexible linkage 230. The flexible linkage may be elastic, and the flexible linkage may include through-holes to allow affixation to the commercially, available helmet existing features.

Figure 13:
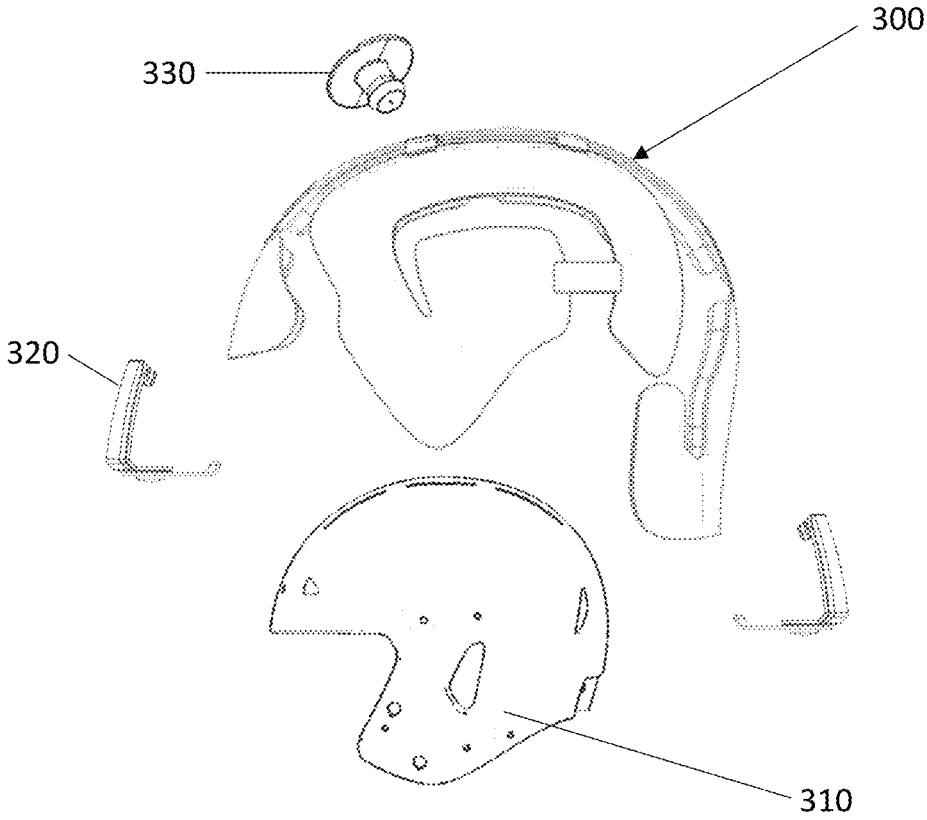
FIG. 13 depicts a side view of one exemplary embodiment of a supplemental impact protection system being affixed over a CA helmet outer layer.

For example, FIG. 13 depicts of one embodiment of a supplemental impact protection element system 300 being affixed over a CA helmet outer layer 310, to desirably achieve a desired PS helmet design. The supplemental impact protection element system may be sized and/or configured to accommodate the outer layer of the CA helmet and can be positioned on top of the surface of the outer layer of the CA helmet. The at least one individual impact protection pads on each assembly may have a first surface and a second surface. The first surface may conform to the curvature of the helmet, with the first surface affixed to and/or through the helmet. The second surface may be affixed to the base membrane. Furthermore, the supplemental impact protection element system may be additionally affixed by attaching to the existing front and back bumpers 320 and/or using the insert or grommet 330 through any existing features on the CA helmet. Conversely, some minor modifications may be necessary, and a secondary drilled hole or threaded-hole or adhesive may be added to ensure that the impact protection element(s) are fully secure.

The addition of the base membrane potentially allows a new outer layer to be provided over the CA helmet, which could include a provision for uniformity of helmet design, color, surface texture, and/or application of graphics, text and/or logos. The base membrane may be manufactured from a polymer similar to the outer layer helmet or different than that of the outer helmet layer. The base membrane may also have impact resistant coatings or layers to dissipate and/or decrease the magnitude of the impact force. The base membrane may be affixed to at least a portion of the at least one of the individual impact protection pads. The base membrane may be rigid, flexible or substantially rigid or flexible.

Figure 14B:
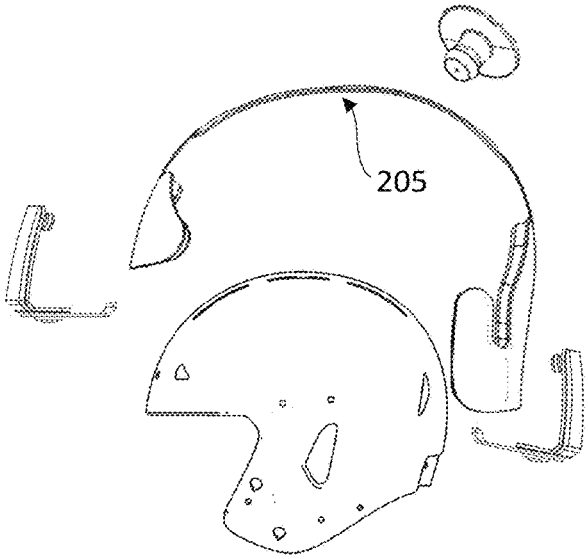
Figure 15B:
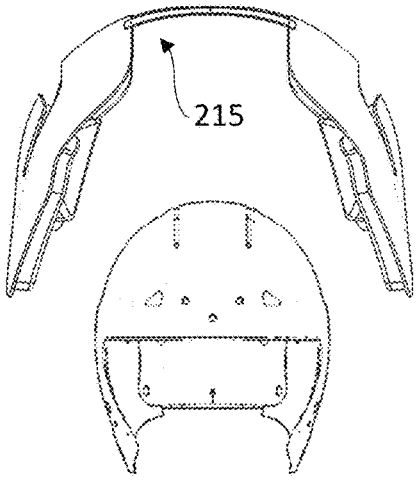
Figure 14C:
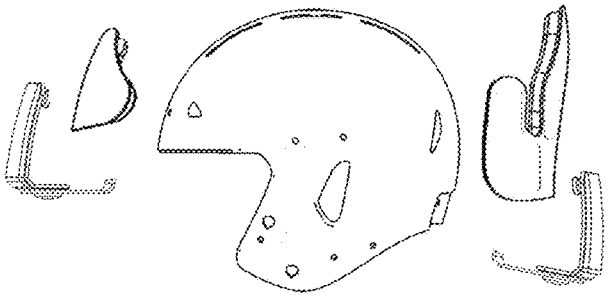
Figure 15C:
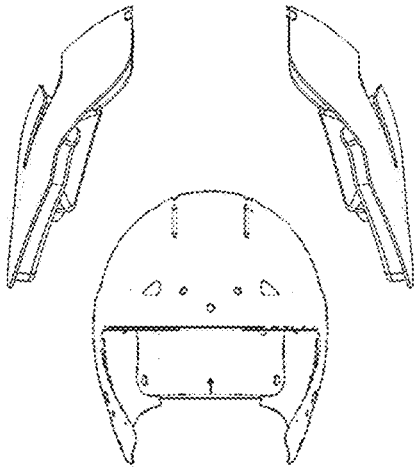

The supplemental impact protection element system may be broken down into various individual impact protective element assemblies and may be desirably positioned in a variety of positions and/or orientations to manufacture a PS helmet design. For example, the position-specific helmet may comprise one or more supplemental impact protection elements helmet individual assemblies. The one or more supplemental impact protection element helmet individual assemblies may include at least one of a front-back impact protection assembly 200 (FIG. 14A) which may include a flexible connection 205 (FIG. 14B) or not include a flexible connection (FIG. 14C) connecting the front and back pad assemblies. Similarly, the supplemental impact protection elements helmet individual assemblies may include at least one of a right-left impact protection assembly 220 (FIG. 15A) which may include a flexible connection 215 (FIG. 15B) or not include a flexible connection (FIG. 15C) connecting the right and left pad assemblies. The flexible connection 205, 215 may comprise a leather material, a 2 way-stretch fabric, a 4-way stretch fabric, and/or any elastic material. Similarly, the supplemental impact protection elements helmet individual assemblies may include at least one of a ridge impact protection assembly 210 (FIG. 16A) which may optionally include a base membrane. Of course, the supplemental impact protection element system may comprise any combination(s) thereof.

For example, the one or more supplemental impact protection element individual assembly may comprise a frontal protection assembly 1100 as shown in FIGS. 57A-57G and 58. The frontal protection assembly comprises a base membrane 1110, one or more impact protection pads 1130, and/or a bumper assembly 1120. The one or more impact protection pads 1130 may comprise one or more impact mitigation structures. The one or more impact mitigation structures may comprise one or more of filaments, laterally supported filaments, auxetic structures, zig-zag structures, chevron structures, herringbone structures, and/or any combination thereof. The one or more impact protection pads may further comprise a first layer and a second layer. The first and/or second layer may comprise polycarbonate, a 2-way stretch fabric, a 4-way fabric, a foam layer, and/or any combination thereof.

In various embodiments, each of the supplemental impact protective elements within each assembly can include at least one or more individual impact protection pads and optionally at least one base membrane (not shown), with the at least one or more individual impact protection pads desirably optionally affixed to the base membrane (if present). Each of the at least one or more individual impact protection pads may be sized and configured to the CA helmet. Each of the at least one or more individual impact protection pads may be sized and configured differently than the proximate individual impact protection pads.

In various optional embodiments, each of the supplemental impact protective element assemblies may be linked by a flexible linkage, such as shown in 12A, 14A and 15A. The flexible linkage may be elastic to allow for size adjustments, and the flexible linkage may include through-holes to allow affixation to the CA helmet's existing features using attachment mechanisms known in the art.

As previously noted, the addition of a base membrane can desirably allow for a new outer layer over the CA helmet, providing uniformity of helmet design, color, surface texture, and/or application of graphics, text and/or logos. The base membrane may be manufactured from a polymer similar to the outer layer helmet or different than that of the outer layer helmet. The base membrane may also have at least one impact resistant coating disposed on a surface or be coupled to at least one foam layer to dissipate and/or decrease the magnitude of the impact force. The base membrane may be affixed to at least a portion of the at least one of the individual impact protection pads. The base membrane may be rigid, flexible or substantially rigid or flexible. In addition, the base membrane may be "floating" (i.e., not affixed to the CA helmet) or may be further affixed to and/or through the CA helmet (as well as affixed to layer within the helmet).

FIGS. 17A-17B depict various views of at least one alternative embodiment of a supplemental impact protection element system without a base membrane. The supplemental impact protection element system without a base membrane includes at least one individual impact protection pad(s) 400. The at least one individual impact protection pad(s) 500 comprises impact mitigating structures. Each individual impact protection pad may be regionally placed on a CA helmet to create a desired PS helmet. The at least one individual impact protection pad(s) may be regionally placed in different locations. The different locations may comprise in at least one of the front and/or back (FIG. 18A-18B), right and/or left (FIG. 19A-19B), ridge (FIG. 20A-20B), mid-back region, a parietal region (or midline), and a temporal region (right and/or left sides), the orbit region (not shown), the mandible (front, right and/or left side) region (not shown), the maxilla region (not shown), the nasal region (not shown), zygomatic region (not shown), the ethmoid region (not shown), the lacrimal region (not shown), the sphenoid region (not shown), and/or any combination thereof of the CA helmet. The at least one or more individual impact protection pads may be desirably positioned within a region. Each of the at least one or more individual impact protection pads may be sized and configured to one or more locations within and/or on the CA helmet. Each of the at least one or more individual impact protection pads may be sized and configured differently than the proximate individual impact protection pads. Optionally, each of the assemblies may be linked by a flexible linkage (not shown). The flexible linkage may be elastic to allow for size adjustments, and the flexible linkage may include through-holes to allow affixation to the commercially, available helmet existing features.

Figure 17C:
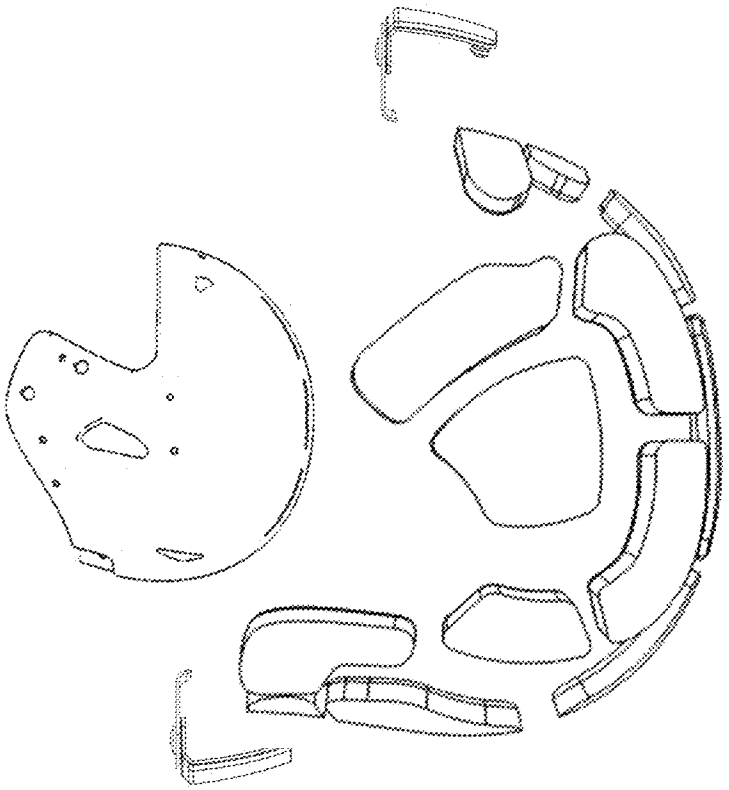
FIG. 17C depicts a side view of one alternate embodiment of a supplemental impact protection system without a base membrane being affixed over a commercially available (CA) helmet outer layer.
Figure 18A:
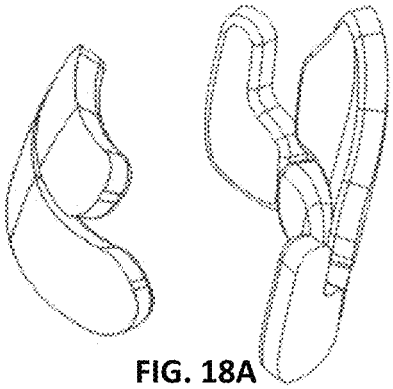
FIGS. 18A-18B depict views of one exemplary embodiment of a front and back assembly without a base membrane.
Figure 18B:
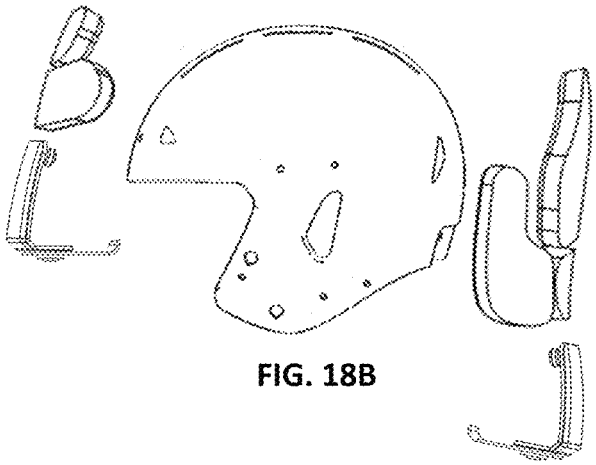
Figure 19A:
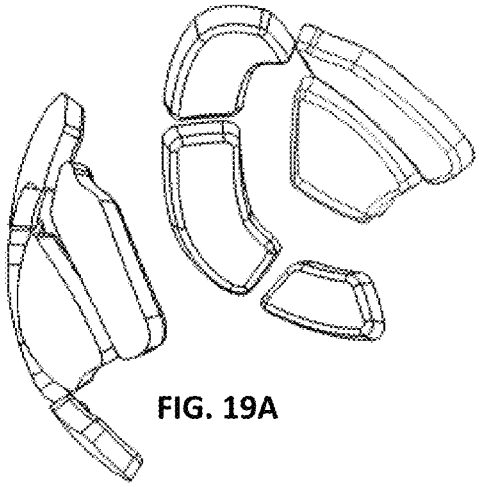
FIGS. 19A-19B depict view of one exemplary embodiment of a right and left assembly with a base membrane.
Figure 19B:
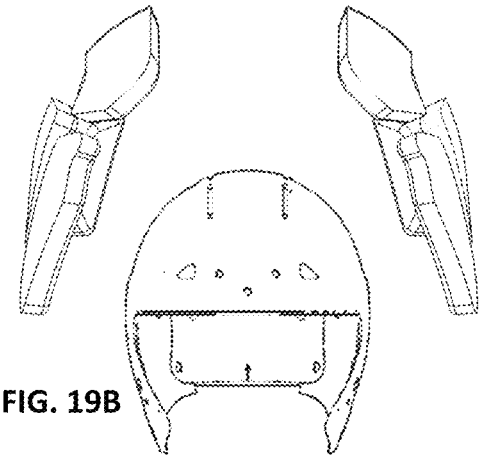
Figure 20A:
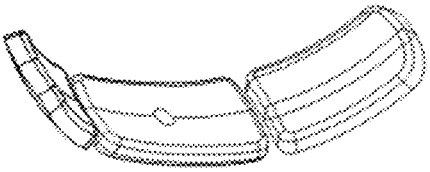
FIGS. 20A-20B depict views of one exemplary embodiment of a ridge assembly with a base membrane.
Figure 20B:
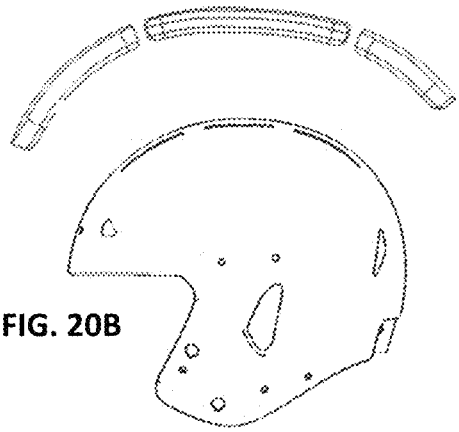

For example, FIGS. 18A-18B, 19A-19B, 20A-20B depict different embodiments of position-specific helmet comprising at least one individual impact protection pad(s) positioned regionally on a CA helmet outer layer. The at least one individual impact protection pad(s) on each assembly may have a first surface and a second surface. The first surface may conform to the curvature of the helmet, with the first surface affixed to the helmet. Furthermore, each of the at least one individual impact protection pad(s) may be additionally affixed by attaching the existing front and back bumpers (as shown in FIGS. 17C and 18B) and/or using the insert or grommet through any existing features on the CA helmet. Conversely, some minor modifications may be necessary, and a secondary drilled hole or threaded-hole or adhesive may be added to ensure that the at least one individual impact protection pads are fully secure.

Figure 21A:
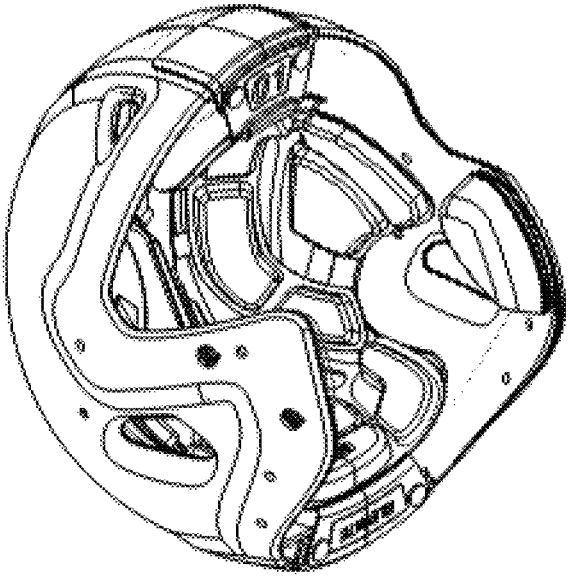
FIGS. 21A-21B depict views of one exemplary embodiment of a commercially available (CA) helmet design.
Figure 21B:
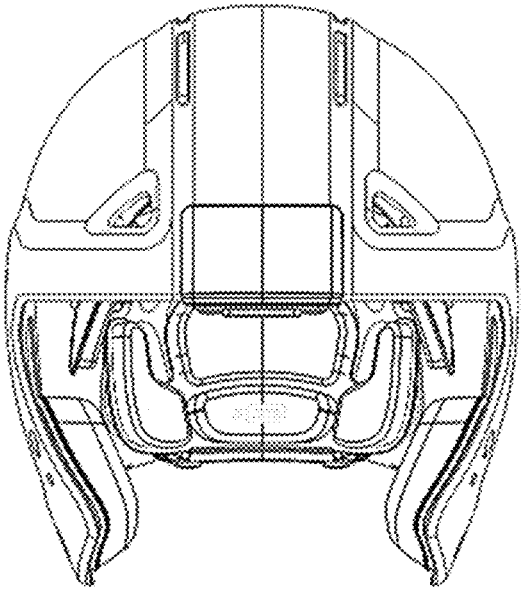
Figure 22A:
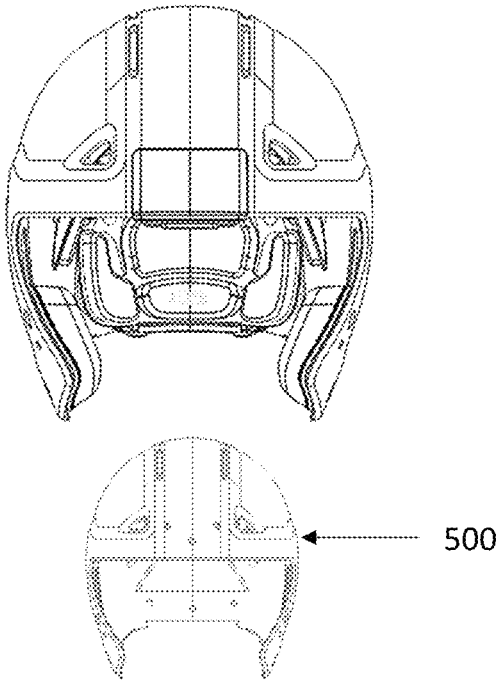
FIGS. 22A-22C depict various exemplary embodiments of supplemental impact protection systems nesting within CA helmets, thereby creating various desired "position-specific" (PS) helmet designs.

In another exemplary embodiment, the nesting of at least one CA helmet with a supplemental impact protective element may desirably achieve a desired PS helmet design. "Nesting" of helmet components can be understood as placing a CA helmet over another impact protective element and/or portions thereof, or placing the impact protective element structure over the CA helmet and/or portions thereof, or various combinations thereof. FIGS. 21A-21B depict a CA helmet design that includes an outer layer. The CA helmet design may further comprise an inner layer, an impact absorbing or mitigation layer, a comfort pad liner system, and/or any combination thereof. In one example, a CA helmet can be nested over a supplemental helmet outer layer 500, such as shown in FIG. 22A. In this embodiment, the CA helmet would desirably be sized and configured somewhat larger than the supplemental impact protective element structures, and positioned over the smaller sized outer layer of the supplemental helmet outer layer. The supplemental helmet outer layer could alternatively be a CA helmet outer layer adapted for a "position-specific" purpose, or it can be a CA helmet outer layer. Conversely, the supplemental helmet outer layer may be nested over a CA (not shown). In this embodiment, the supplemental helmet outer layer could desirably be sized and configured larger than the CA helmet, and positioned over the smaller sized CA helmet. The supplemental helmet outer layer can alternatively be a CA helmet outer layer adapted for a "position-specific" purpose or a CA helmet outer layer. Adapted for a "position-specific" purpose could include manufacturing a custom CA outer layer material with specific impact properties, affixing the CA helmet outer layer external surface or internal with at least one or more individual impact protection pads or impact protection pad helmet assemblies, and/or any combination thereof.

Figure 22B:
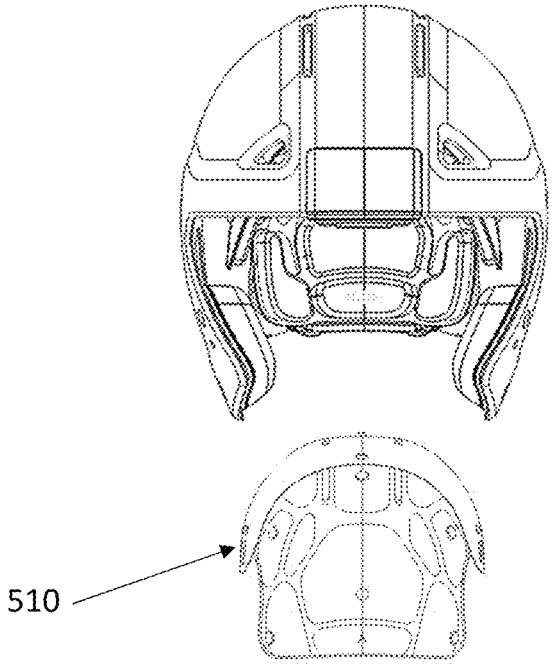
Figure 22C:
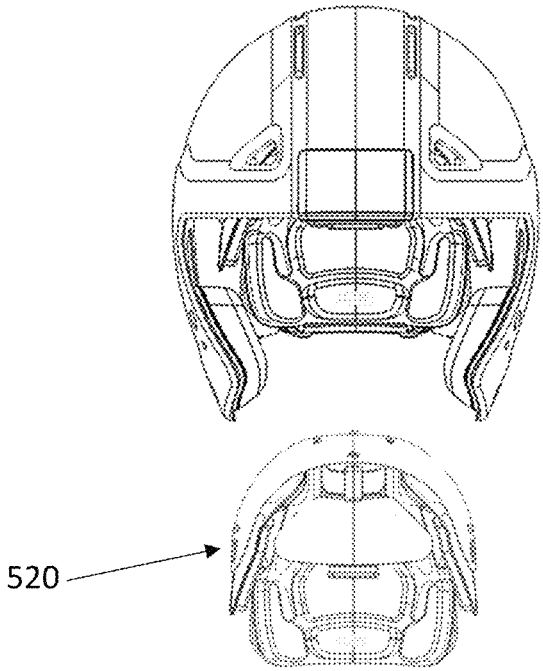

In another example, a CA helmet could alternatively be nested over a helmet inner layer 510, such as shown in FIG. 22B. The CA helmet would desirably be sized and configured larger than the helmet inner layer, and positioned over the smaller sized helmet inner layer. The helmet inner layer can be CA helmet inner layer adapted for a "position-specific" purpose or can be a CA helmet inner layer. Conversely, the helmet inner layer may be can be nested over a CA helmet (not shown). The helmet inner layer could be sized and configured larger than the CA helmet, and positioned over the smaller sized CA helmet. The helmet inner layer can be a CA helmet inner layer adapted for a "position-specific" purpose, which could include manufacturing a custom CA inner layer material with specific impact properties, affixing the CA helmet inner layer external surface or internal with at least one or more individual impact protection pads or impact protection pad helmet assemblies, and/or any combination thereof. FIG. 22C illustrates a CA helmet inner layer internal surface affixed with a supplemental impact protection element system 520 for a position-specific purpose. Alternatively, at least one at least one or more individual impact protection pads could be positioned regionally or impact protection helmet assemblies can be affixed to the inner or outer surface of the CA helmet inner layer for a "position-specific" purpose.

Figure 24:
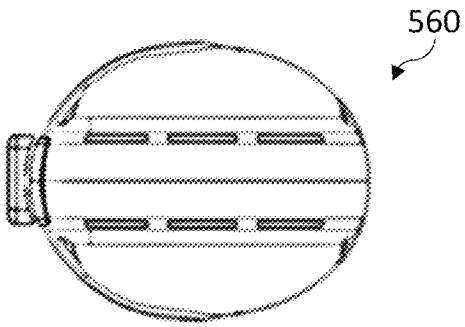
FIG. 24 depicts a top view of one exemplary embodiment of retrofitting impact protective elements to a CA helmet.
Figure 23B:
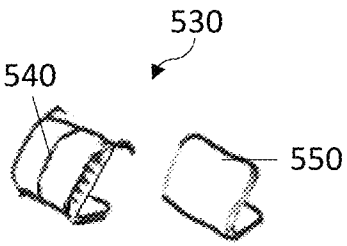
FIGS. 23A-23B depict one exemplary embodiment of enhancing existing bumper designs with retrofitted impact protective elements to create a desired PS helmet design.
Figure 23A:
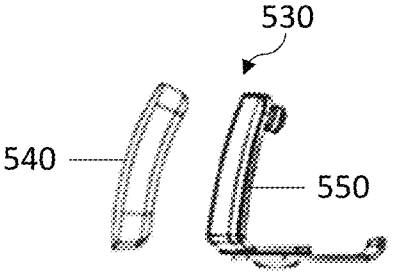

In another exemplary embodiment, replacement or retrofitted supplemental impact protective elements can be affixed to existing bumpers to achieve a desired PS helmet. FIGS. 23A-23B illustrate at least one individual supplemental impact protective pad 540 that may be affixed to the front and/or back bumper 550. The at least one individual supplemental impact protective pad 540 may align with the perimeter of the front and/or back bumper 550. Alternatively, the at least one individual supplemental impact protective pad 540 may be positioned below the perimeter of the front and/or back bumpers 550 (not shown) or can be extended beyond the perimeter of the front and/or back bumper 550 (not shown). Also, the at least one individual supplemental impact protective pad may be affixed to the external surface of the front and/or back bumper, with the front or back bumper in turn affixed to the existing features of the CA helmet. Conversely, the at least one individual supplemental impact protective pad 540 can be affixed to the internal surface of the front and/or back bumper, where the at least one impact protective pads is positioned in between the bumper and the CA helmet outer layer (not shown). Then, the front and/or back bumper can be affixed to the existing features of the CA helmet, such as shown in FIG. 24 to create a position-specific helmet 560.

Figure 26:
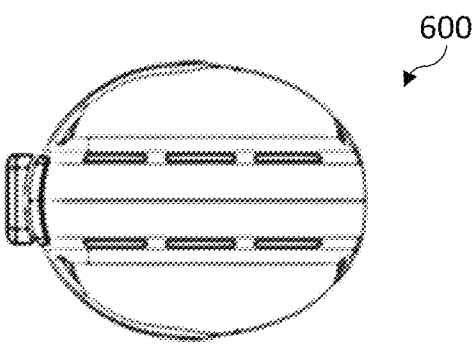
FIG. 26 depict a top view of one exemplary embodiment of retrofitting tunable zoned impact protective elements to a CA helmet.
Figure 25B:
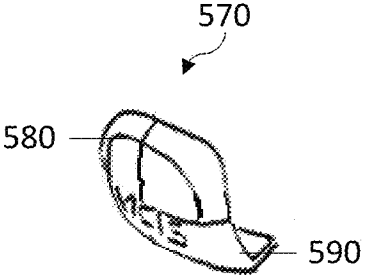
FIGS. 25A-25B depict views of an alternate embodiment of enhancing existing bumpers with retrofitted tunable zoned impact protective elements to create a desired PS helmet design.
Figure 25A:
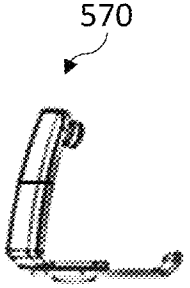

In another embodiment, FIGS. 25A-25B and 26 illustrates a plurality of individual supplemental impact protective pads 580 affixed to an external surface of the bumper 590, the external surface may include the front surface, top surface, and side surfaces. Each of the plurality of individual supplemental impact protective pads 580 may be specifically tuned to a "position-specific" purpose. Each of the individual supplemental impact protective pads 580 may be tuned differently than those of proximate and/or adjacently positioned individual supplemental impact protective pads 580. Furthermore, at least one or more of the individual impact protective pads may have a cavity, surface depression and/or other feature allowing a radio and/or communication unit to be positioned within the cavity (not shown).

In another exemplary embodiment, replacement or retrofitted supplemental impact protective elements may be affixed to an existing facemask and/or visor to achieve a desired PS helmet. FIGS. 27A-27C illustrate one exemplary embodiment of a supplemental impact protective tube that may be affixed to at least a portion of the facemask frame. The supplemental impact protective tube may include a slot that extends along the longitudinal length and may have slotted width that extends below the top surface to facilitate placement. A plurality of supplemental impact protective tubes may be affixed to the entirety of the facemask or just a portion of the facemask thereof. Alternatively, FIGS. 28A-28C illustrate an alternate embodiment of at least one flanged individual supplemental impact protective pad affixed to at least a portion of a facemask openings. The at least one flanged individual supplemental impact protective pad may conform to the shape and configuration of the at least a portion of the facemask opening.

The at least one flanged individual supplemental impact protective pad may comprise a first portion and a second portion. The at least one flanged individual supplemental impact protective pad may further comprise an impact mitigation structure, the impact mitigation structure disposed between the first portion and the second portion. Each of the first portion, the impact mitigation structure, and/or the second portion may comprise the same material and/or different materials. Alternatively, the one or more impact mitigation bumpers may comprise multi-unit pieces that are coupled together to create the usable bumper. The multi-unit bumper may comprise a first portion, an impact mitigation structure, and/or a second portion, the impact mitigation structure disposed between the first portion and the second portion. Each of the first portion, the impact mitigation structure, and/or the second portion may comprise the same material and/or different materials. The impact mitigation structure is coupled to the first and second portion. Coupling may be methods and/or mechanical structures known in the art. The first and/or second portion may comprise a flanged member, and the first and/or second portion may comprise a main body.

Figure 29A:
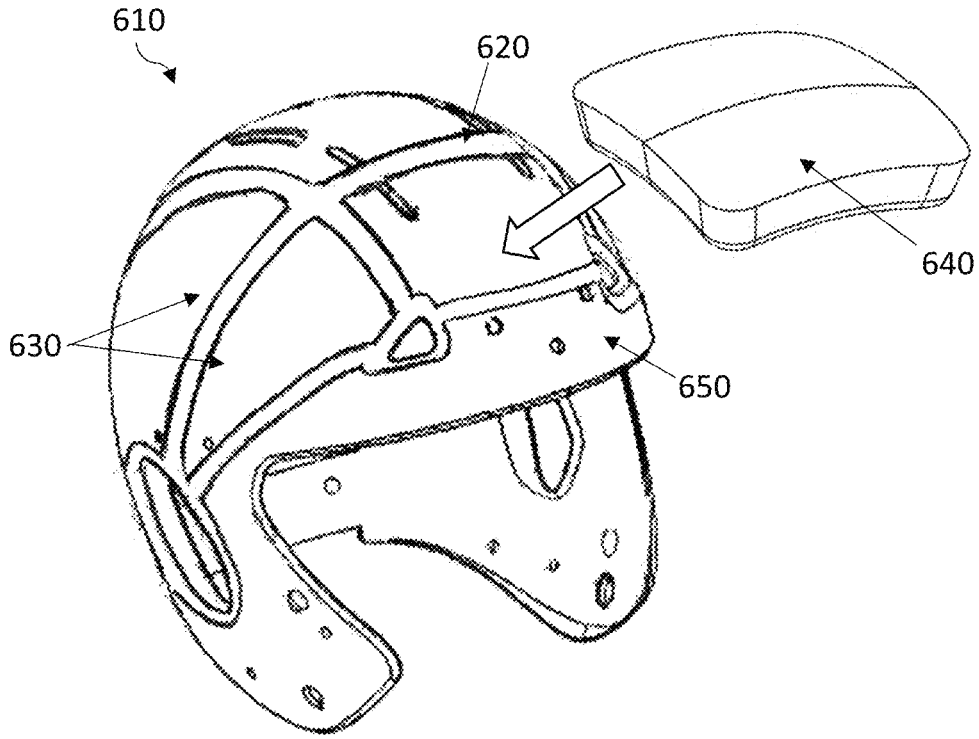
FIGS. 29A-29B depict various views of exemplary embodiments of latticed framework designs with at least one individual impact protection element surrounding at least a portion of the CA helmet, thereby creating a desired PS helmet design.
Figure 29B:
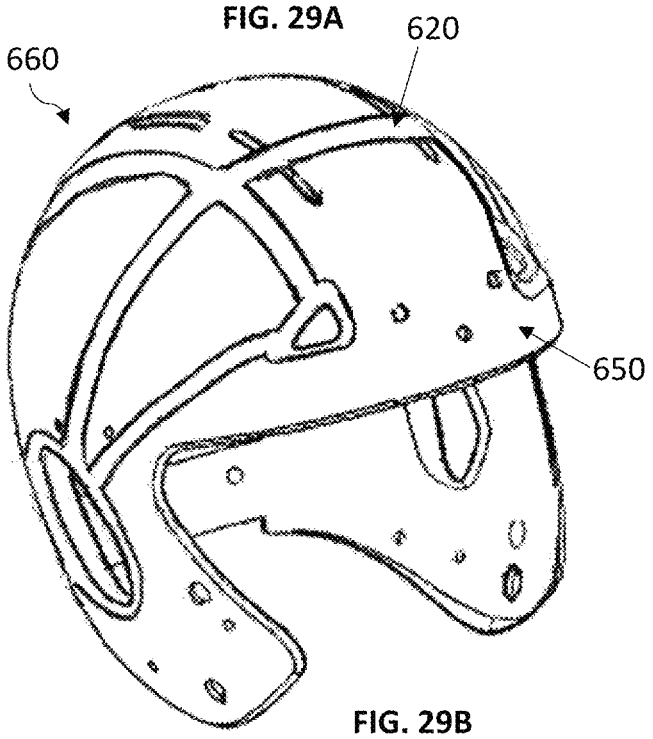

In another exemplary embodiment, a position-specific helmet 610 may comprise one or more supplemental impact protective elements 640 and at least one latticed framework 620 surrounding at least a portion of the CA helmet 650, with the framework including one or more openings, voids, depressions, pockets or other features 630 for accommodating at least one individual impact protection pad 640, such as shown in FIGS. 29A-29B, to achieve a desired PS helmet. The latticed framework as shown in FIGS. 29A-29B may be customized to a shape and configuration of the CA helmet. The latticed framework may comprise longitudinal members arranged to form a pattern of open spaces between the longitudinal patterns. The latticed framework may be affixed to existing features on the helmet or with minor modifications to the CA helmet to withstand expected impact forces. The latticed framework may be manufactured from a metal or polymer. The polymer may be the same as the CA helmet outer layer or different than the CA helmet outer layer. The latticed framework may be rigid, substantially rigid, flexible or substantially flexible.

Furthermore, at least a portion of the latticed framework 620 may be spaced apart from the CA helmet outer layer (not shown), or at least a portion of the latticed framework 620 may contact the CA helmet outer layer (as shown in FIGS. 29A-29B). The open spaces 630 within the latticed framework 620 may be shaped and configured to fit at least one individual supplemental impact protection pad 640 or at least one individual impact protection pad assemblies as shown in FIGS. 14A-14C, 15A-15C, and/or 16A-16B. Each of the at least one individual supplemental impact protection pads or impact protection pad assemblies may be affixed to the latticed framework. The at least one individual supplemental impact protection pads 640 may include flanges that extend beyond the perimeter of the at least one individual supplemental impact protection pads to affix to the latticed framework. Alternatively, at least a portion of the at least one supplemental individual impact protection pads may comprise a base membrane.

Figure 30A:
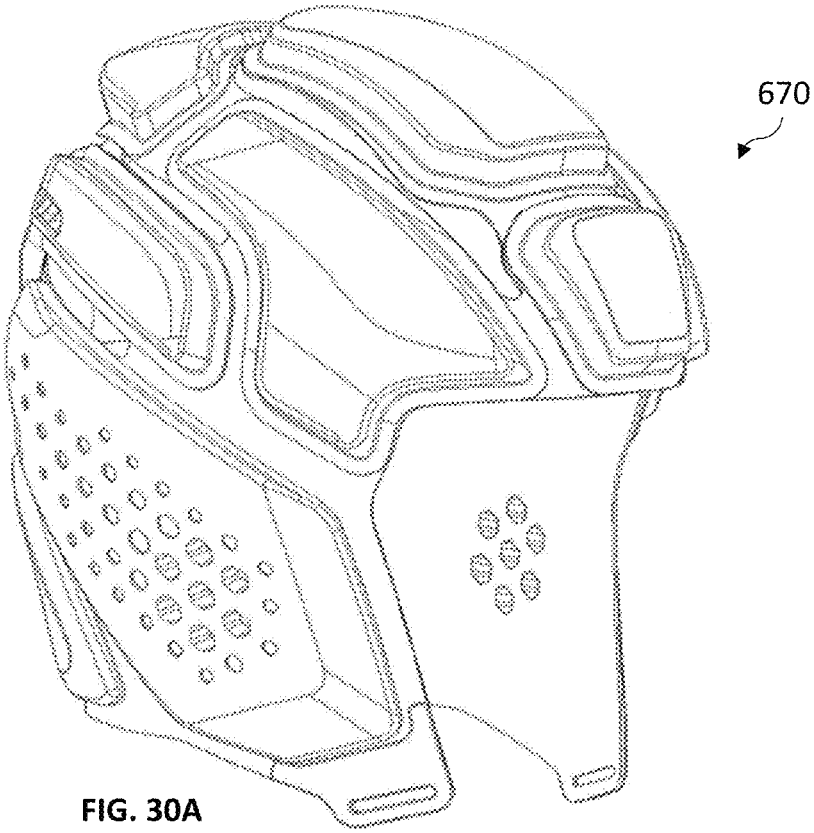
FIGS. 30A-30D depict various exemplary embodiments of a head cap with impact mitigating structures which can be utilized to create a desired PS helmet design.
Figure 30B:
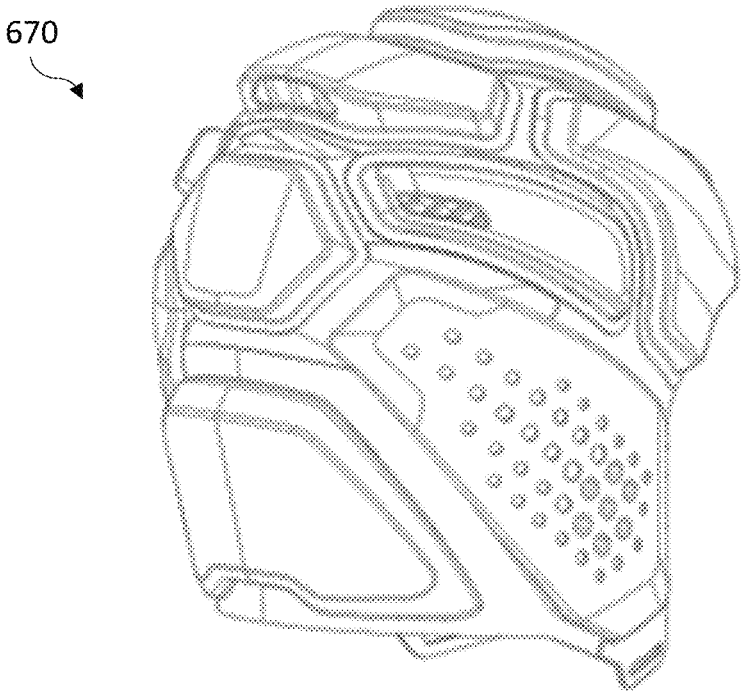
Figure 30C:
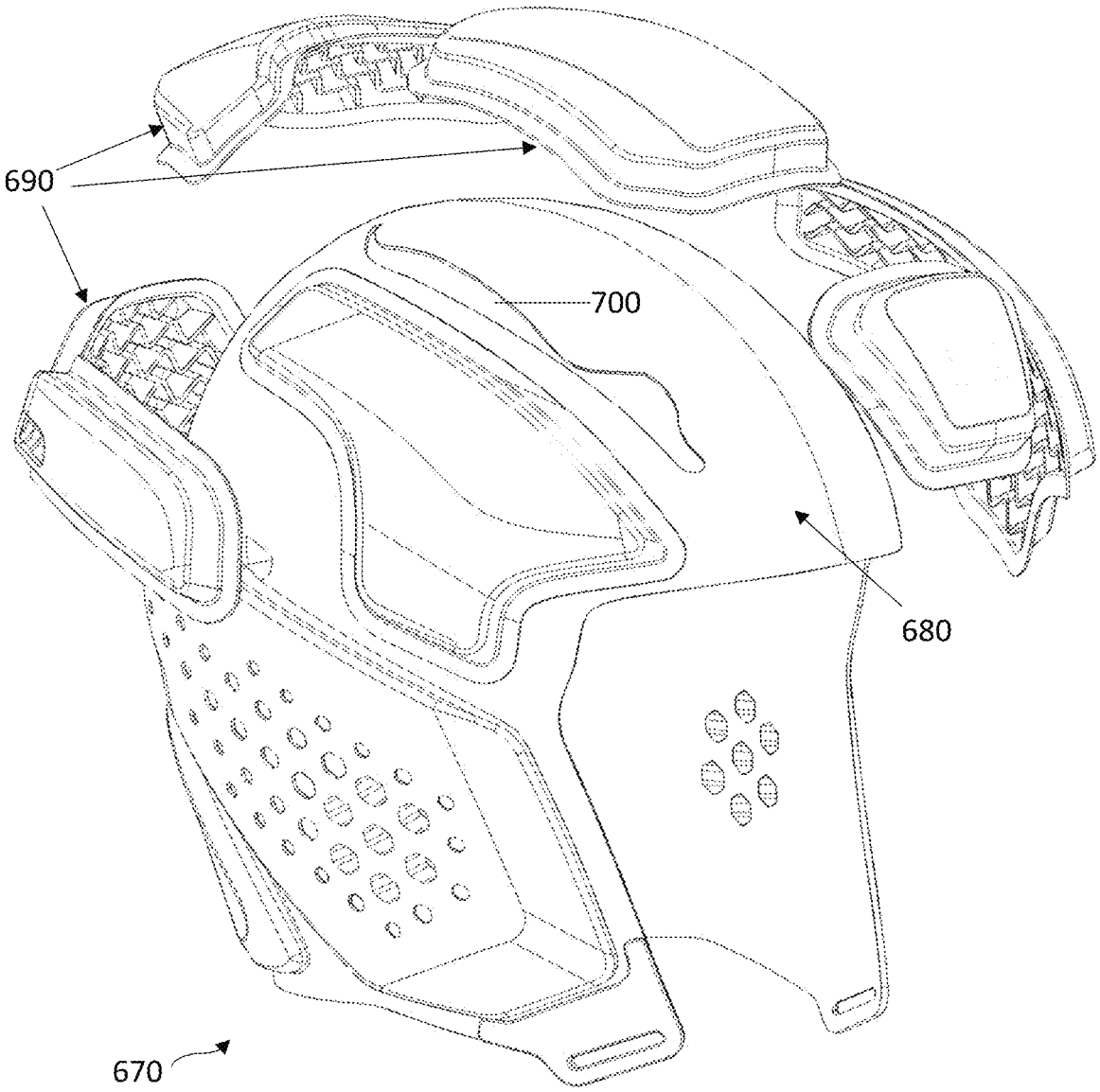
Figure 30D:
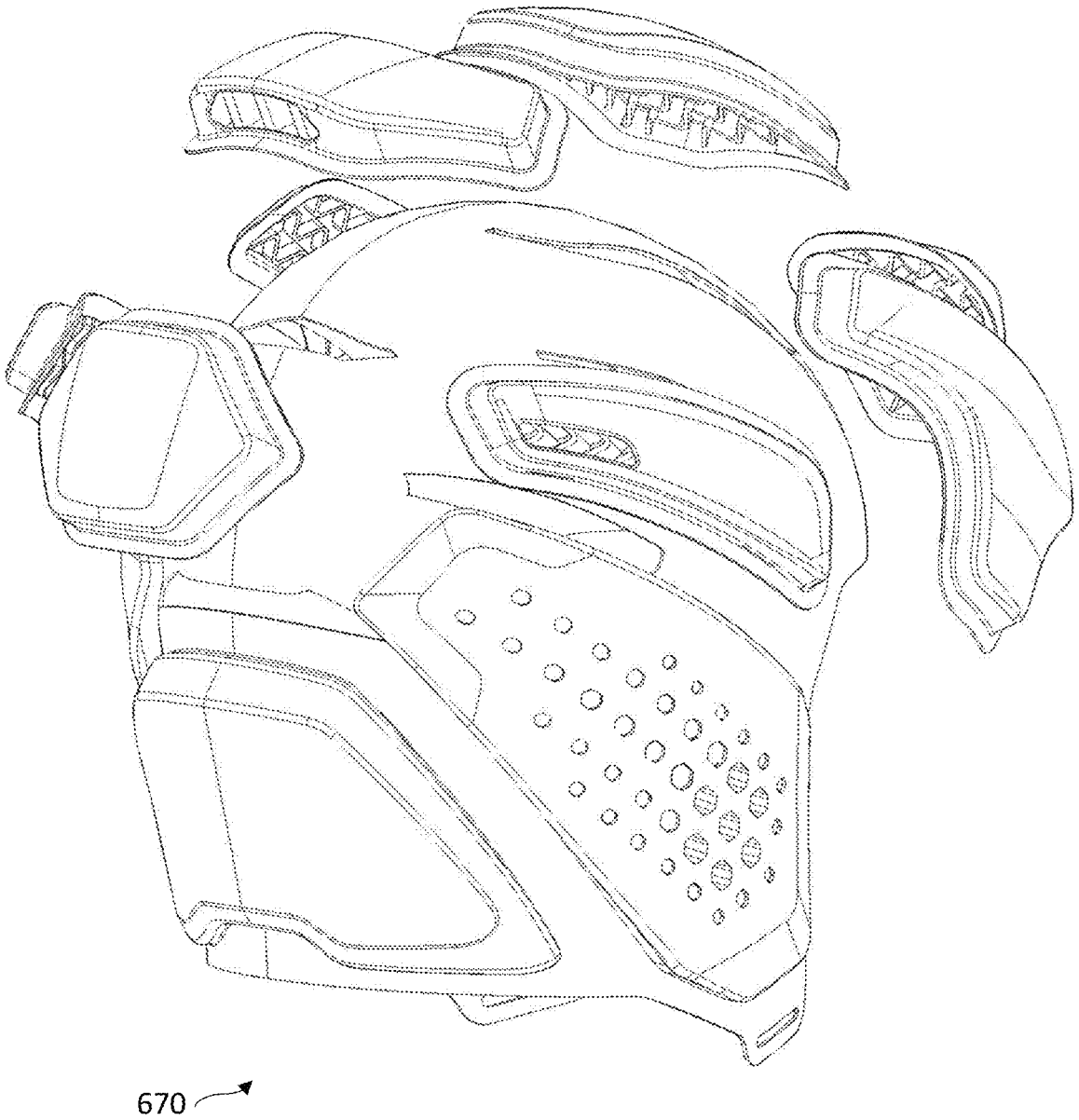

In another exemplary embodiment, a position-specific helmet 670 may comprise a flexible helmet assembly. The flexible helmet assembly can comprise one or more supplemental impact protective elements 690,730 and a head cap 680 as shown in FIGS. 30A-30D. The supplemental impact mitigation elements 690, 730 may comprise one or more impact mitigating structures, such as shown in FIGS. 30A and 30B, to achieve a desired PS helmet 670. Each of the one or more supplemental impact protective elements 690, 730 may be removably coupled to the head cap 680 and/or permanently coupled to the head cap 680. As best seen in FIGS. 30C and 30D, the head cap 680 may comprise at least one of a foam layer, a 2-way stretch material, a 4-way stretch material, and/or any elastic material. Furthermore, the head cap 680 may further comprise breathable and/or sweat wicking layer. The head cap 680 may further comprise vents 700 allowing moist air to dissipate. The impact mitigating structures may comprise an array of impact absorbing filaments, laterally supported filaments, zig-zag structures, chevron structures, herringbone structures, auxetic structures and/or any combination thereof, which include embodiments such as those depicted in FIGS. 30C, 30D, 31A-31C, 32 and 33. The supplemental impact protective elements 690, 730 may further comprise a first layer and/or a second layer. The first layer and/or a second layer may comprise a polycarbonate material, a 2-way-stretch material, a 4-way stretch material, a foam layer and/or any combination thereof.

Figure 31A:
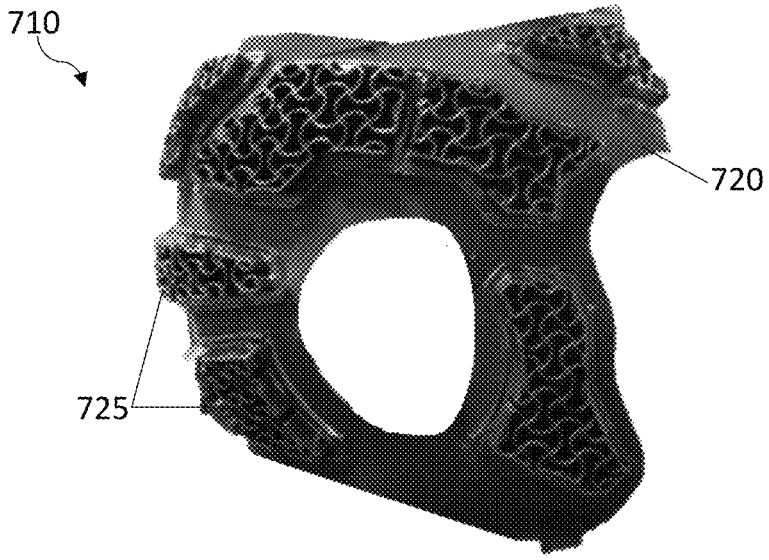
FIG. 31A-31C depicts one embodiment of head cap with segmented auxetic structures and suggested regional locations which can be utilized to create a desired PS helmet design.
Figure 31B:
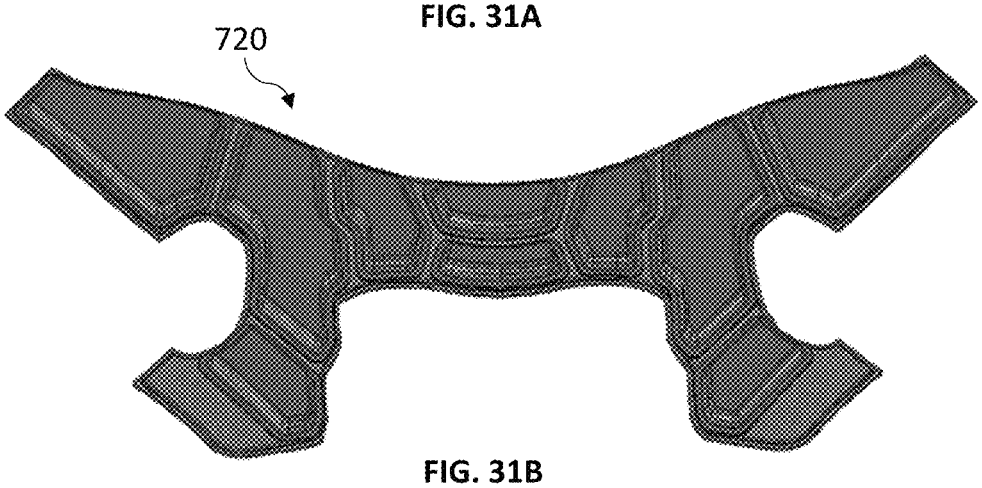
Figure 31C:
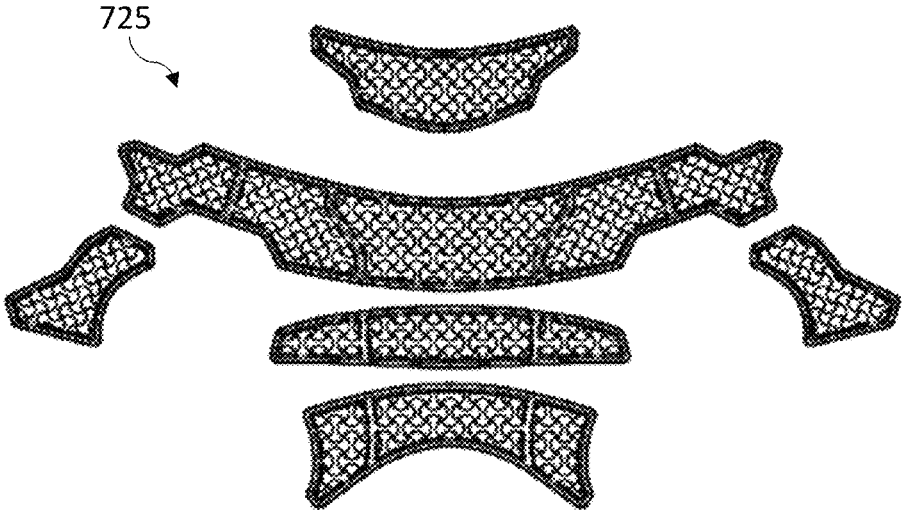
Figure 32:
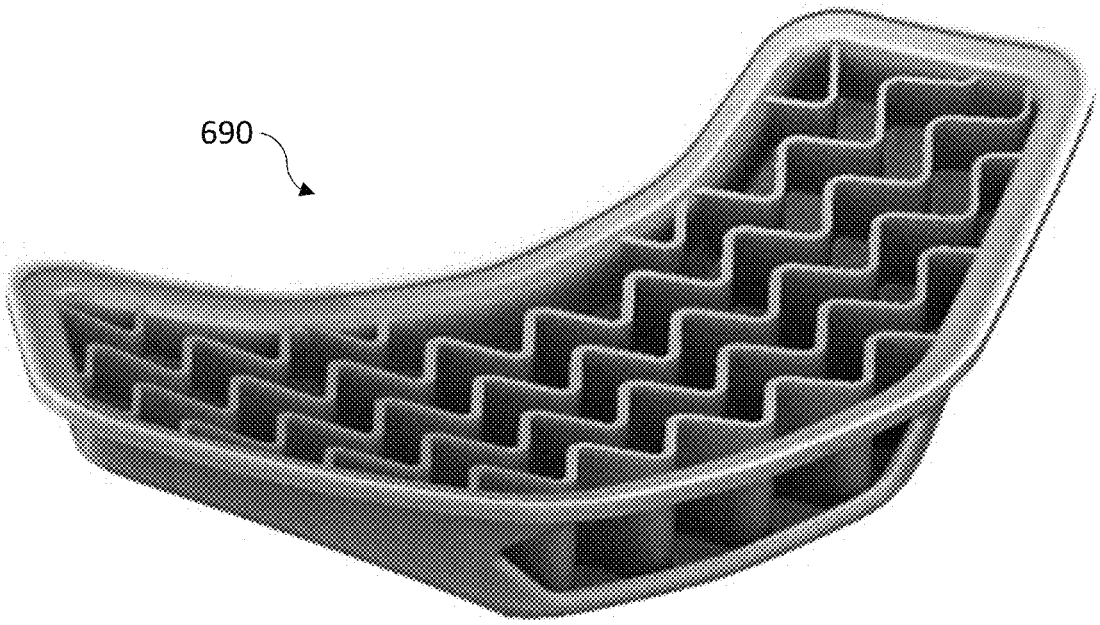
FIG. 32 depicts one exemplary embodiment of a supplemental impact element with an auxetic structure design.
Figure 33:
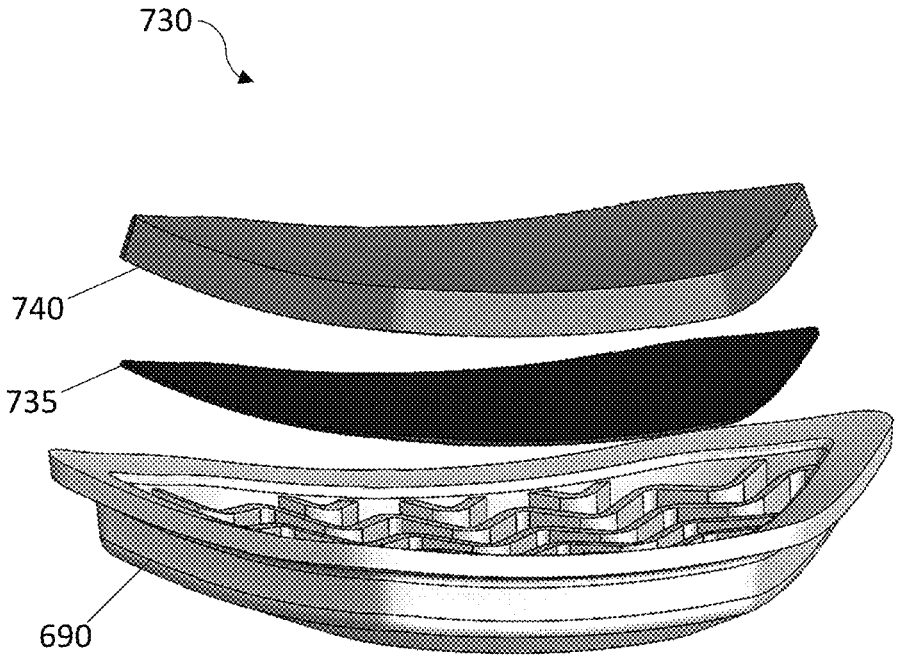
FIG. 33 depicts another exemplary embodiment of a supplemental impact element with a composite impact absorbing structure with auxetic components.

In another exemplary embodiment, a position-specific helmet may comprise an alternate embodiment of a flexible helmet assembly. The alternative flexible helmet assembly comprises a head cap 720 and one or more supplemental impact protective elements 725. The one or more supplemental impact protective element may comprise impact mitigation structures using auxetic structures. As best seen in FIGS. 31A-31C, the supplemental impact protective elements 725 may comprise impact mitigation structures. The impact mitigating structures may comprise an array of impact absorbing filaments, laterally supported filaments, zig-zag structures, chevron structures, herringbone structures, auxetic structures and/or any combination thereof. Each of the one or more supplemental impact protective elements 725 may be removably coupled to the head cap 720 and/or permanently coupled to the head cap 720. The supplemental impact protective elements 725 may further comprise a head cap 720. The head cap may comprise a 2-way-stretch material, a 4-way stretch material, a foam layer, an elastic layer and/or any combination thereof. For example, should the manufacturer desirably incorporate auxetic structures within the supplemental impact protective element, the auxetic structures can include a plurality of interconnected members forming an array of reentrant shapes positioned on the flexible head layer. The term "auxetic" generally refers to a material or structure that has a negative Poisson ratio, when stretched, auxetic materials or structures become thicker (as opposed to thinner) in a direction perpendicular to the applied force. Such auxetic structures results in high energy absorption and fracture resistance. In particular, when a force is applied to the auxetic material or structure, the impact causes it to expand (or contract) in one direction, resulting in associated expansion (or contraction) in a perpendicular direction. It will be recognized that those skilled in the art recognize that the auxetic structures may include differently shaped segments or other structural members and different shaped voids.

Alternatively, the supplemental impact mitigating structures may comprise filaments (longitudinally extending members that deform non-linearly in response to an impact source), polygonal structures (in an array or segmented), single-layered impact layers or multi-layered impact layers, and/or any combination thereof. Furthermore, the supplemental impact mitigating structures may be provided in a continuous array (not shown) or a segmented array (see FIG. 31C). For example, FIG. 31A shows the proposed regional location of the segmented arrays on the base layer that may be placed for a desired "position-specific" purpose. The segmented arrays may include regionally specific arrays, such as the front, jaw, midline (surrounding the majority of the circumference to include right side, mid-back and left side), top, lower back layer 1 and lower back layer 2.

The auxetic structures may be bonded to a base layer or head cap. The base layer or head cap may comprise a resilient fabric that may be a two-way or four-way stretch material. The auxetic layer and the head cap layer may be further coupled to the foam layer. Such coupling may include adhesives, molding, welding, sintering or any other method known in the art. The foam layer may be comprised of a single layer or multiple layers, which any of the layers may be comprised of various types of foam, such as TPU foam, Poron XRD foam, impact resistant foam, and/or any combination thereof. All of the segmented auxetic arrays may be coupled to the base layer or head cap or at least a portion of the segmented auxetic arrays may be coupled to the base layer.

Figure 34:
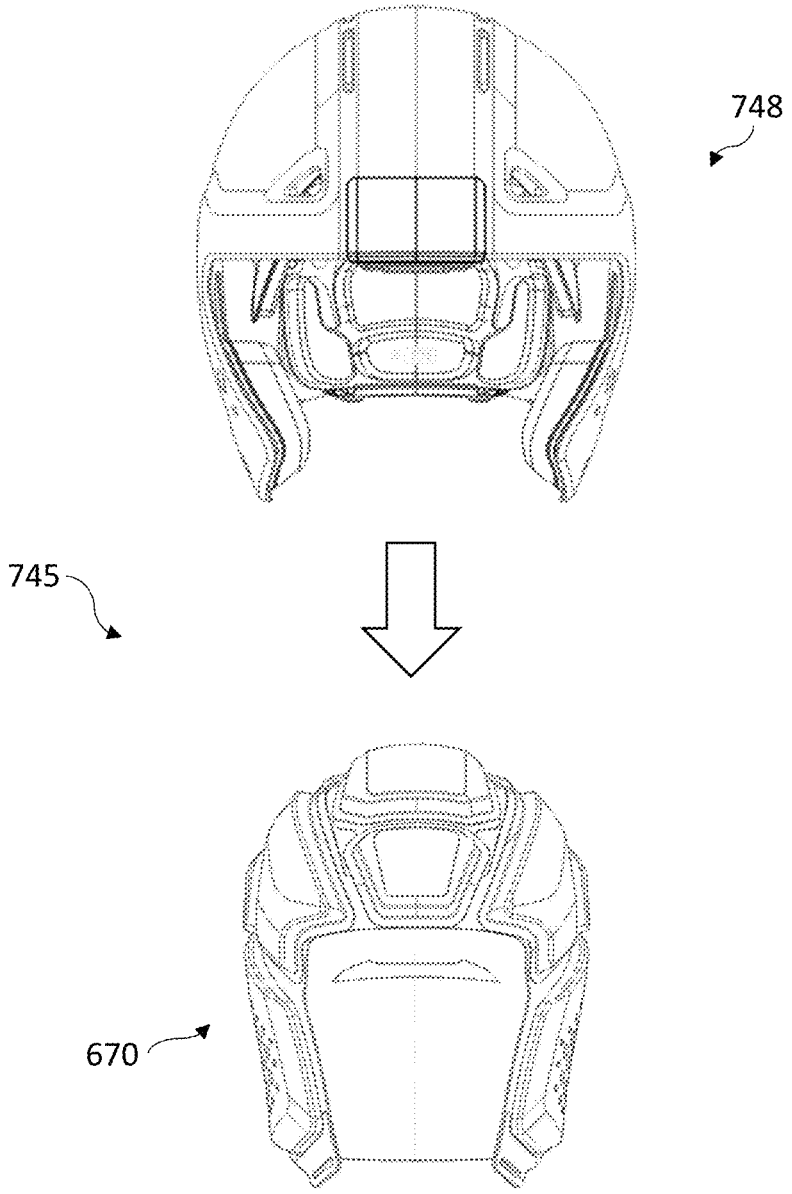
FIG. 34 depicts a commercially available (CA) helmet nesting over one embodiment of a head cap with auxetic structures to create a desired PS helmet design.

For example, FIG. 34 illustrates a position-specific helmet 745 that comprises a CA helmet and flexible helmet assembly 670. CA helmet that is positioned over the flexible helmet assembly 670, the flexible helmet assembly comprising a head cap with one or more supplemental impact mitigating protective elements of FIGS. 30A-30D and 31A-31C. In this specific embodiment, all the one or more supplemental impact protective elements are placed on the base layer or head cap. A sweat, wicking layer may be further positioned over the top of the one or more supplemental impact protective elements may be optionally excluded. Alternatively, a portion of the segmented supplemental impact protective elements may be placed onto at a base layer for a position-specific purpose. If desired, the player can place the head cap over the head until it comfortably and securely fits on the head. The CA helmet may include at least one of an outer layer, an inner layer, an impact absorbing layer between the inner and outer layer, and a padded liner. The CA helmet may be placed over the player's head to provide additional impact protection to a desired PS helmet. If desired, an alternative embodiment of the head cap may optionally incorporate a sweat, wicking layer covering (not shown), where the head cap with supplemental impact mitigating structures is disposed within.

In various alternative configurations, the head cap with supplemental impact mitigating structures may be sized and configured to the perimeter or outer dimensions of the CA helmet, with the head cap with supplemental mitigating structures placed over the CA helmet outer layer (not shown) as an outer covering or "skin."

Figure 35:
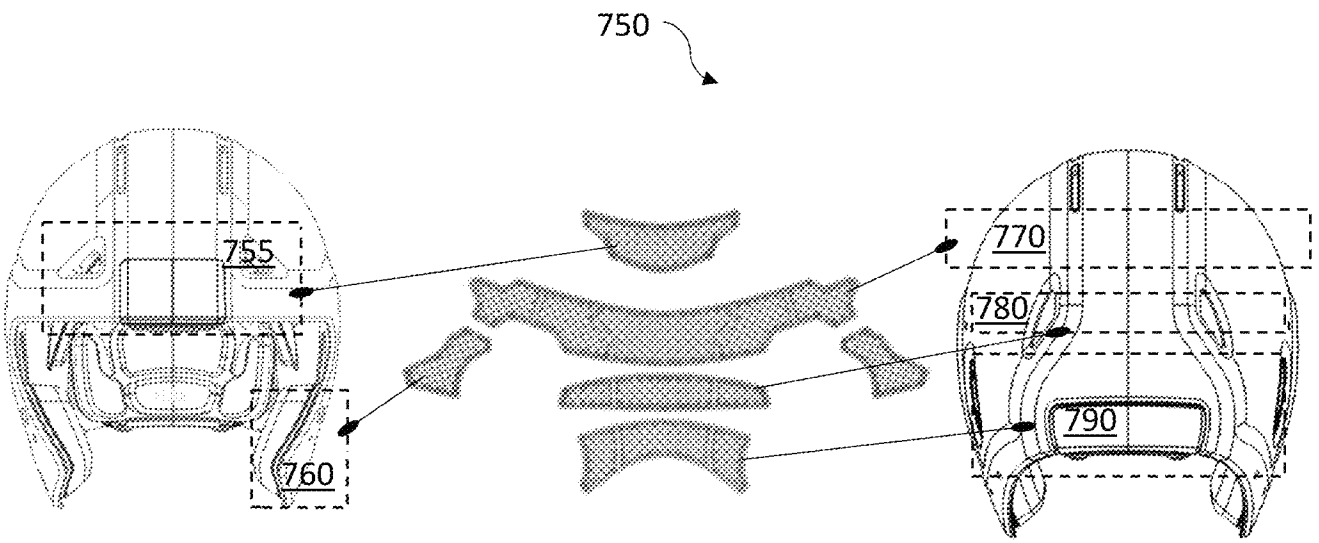
FIG. 35 depict one exemplary embodiment of segmented auxetic structures and suggested regional locations on different CA helmet layers.
Figure 36A:
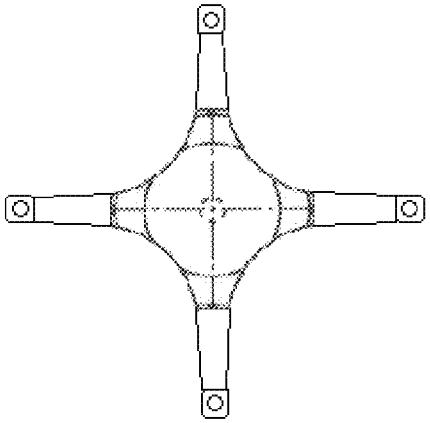
FIGS. 36A-36D depict various embodiments of impact protective dome structures that can be incorporated into a desired PS helmet design.
Figure 36B:
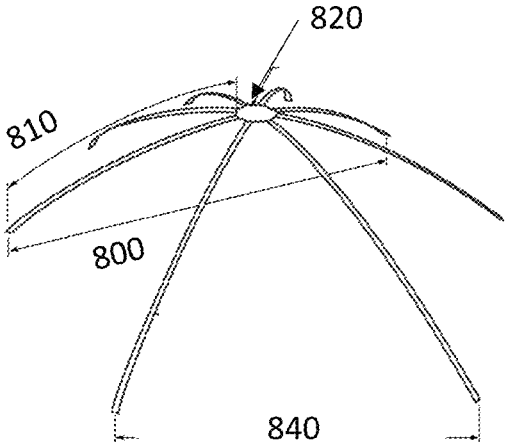
Figure 36C:
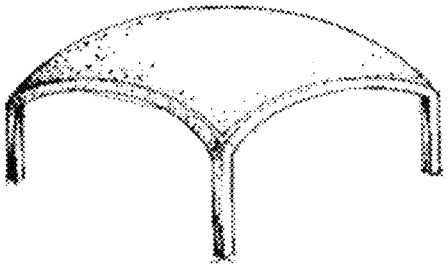
Figure 36D:
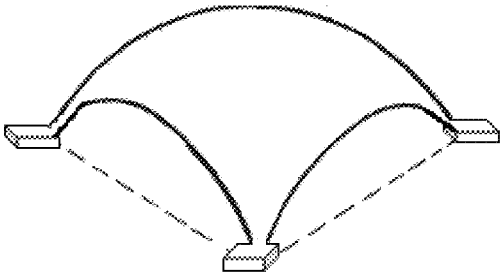

In another exemplary embodiment, the supplemental impact protective elements may include modular or segmented supplemental impact mitigating structures that can be affixed to the CA helmet outer layer, as shown in FIG. 35, to achieve a desired PS helmet 750. Such structures can include modules appropriate for attachment to and/or positioning proximate to the front 750, jaw 760, midline 770 and lower back 780 and 790 of the helmet. Conversely, the modular or segmented supplemental impact mitigating structures can be affixed to the CA helmet inner layer (not shown) for a desired "position-specific" purpose. At least a portion of the modular or segmented supplemental impact mitigating structures can be affixed directly to the CA helmet outer layer and/or CA helmet inner layer or have at least a portion of the supplemental impact mitigating structures coupled to a portion of a base layer, the at least a portion of base layer affixed to the CA helmet outer layer.

In another exemplary embodiment, the supplemental impact protective elements may include impact protective dome structures to achieve a desired PS helmet. FIGS. 36A-36D illustrate various embodiments of supplemental impact protective dome structures. Supplemental impact protective domes may be manufactured using spring metals or spring-tempered metals (carbon steels, alloy steels, phosphor bronze, beryllium copper, nickel alloy steels, titanium alloy steels, etc.), or other specialty metals such as Nitinol. The "spring" characteristic will desirably change the yield strength of the impact dome to prevent the player from receiving the direct impact force by dampening the impact force. Furthermore, supplemental impact domes manufactured with "spring" materials can also be bent, compressed, extended, or twisted continuously and they will return to their original shape without suffering any deformation.

Various design factors may be considered to adapt an impact dome to achieve a desired PS helmet. For example, referring to FIG. 36B, at least one of the factors can include: the location, shape and/or configuration of the hub 820, the dome diameter 800, the spoke shape and arc length 810, the distance between the spoke ends 840, the type of material, load distribution, and/or any combination(s) thereof. The hub shape and configuration may be a dome shape, geodesic dome shape, an arch shape, or any other shape known to person skilled in the art as a strong structural form, resistant to significant impact forces. Such design may facilitate the transfer of the load through the distribution of the spokes.

In various embodiments, supplemental impact protective domes could be positioned in one or more locations of the helmet, including at virtually any location on the inner and outer surfaces of the outer layer, inner or outer surfaces of the inner layer, the inner layers of the helmet, and/or inner or outer surfaces of the impact absorbing layer. In various embodiments, positioning could include locations at a front portion of the helmet, back portion, right and left sides, and/or ridge portion of a CA helmet. Other desirable locations could include being positioned at or near 5, 10, 15, 30, 45, 60 and/or 75-degree offsets from one of more of these locations. If desired, symmetric and/or asymmetric pairs (or other arrangements) of two, three, four or more supplemental impact absorbing structures could be positioned in various locations, which could include placement in areas of reduced and/or deficient impact protection, as well as in areas expected to receive increased impacts due to player techniques and/or position.

Figure 37A:
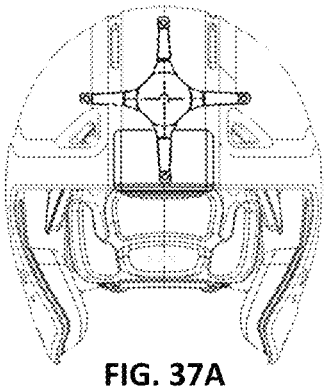
FIGS. 37A-37B depict various views of exemplary embodiments of impact protective dome structures that can be affixed on different CA helmet layers.
Figure 37B:
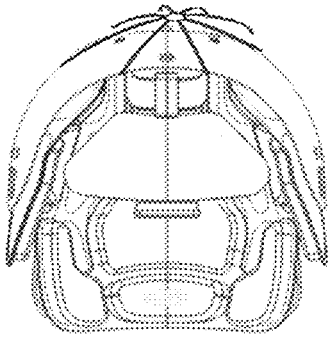

For example, FIGS. 37A and 37B illustrate various position-specific helmet embodiments of supplemental impact domes being affixed to a CA helmet outer layer or a CA helmet inner layer to achieve a desired PS helmet. FIG. 37A shows a CA helmet with an outer layer, an inner layer, an impact absorbing layer that is between the inner and outer layer, and a padded liner. The supplemental impact dome may be affixed to the CA helmet outer layer using existing features or may require some minor modifications. Alternatively, the supplemental impact dome may be affixed to the CA helmet inner layer with the padded liner disposed within using existing features or may require some minor modifications. This arrangement may allow the CA helmet outer layer to be positioned over the CA helmet inner layer and the affixed supplemental impact dome. The supplemental impact dome may also include a sweat, wicking layer covering and/or foam padding.

Retrofitting Commercially Available Helmets With Significant Modifications

Retrofitting a commercially available helmet (CA helmet) into a position-specific helmet (PS helmet) may be accomplished with significant CA helmet modifications. "Significant CA helmet modifications" can be defined as using methods or mechanisms that affix impact protection elements related to a "position-specific" factor (or combination of "position-specific" factors) to a CA helmet, which in various embodiments may require addition and/or removal of major structural elements of the helmet, including removing major structural portions of the helmet and/or making helmet modifications that significantly affect the durability and/or the performance of the CA helmet to a significant degree.

Figure 38A:
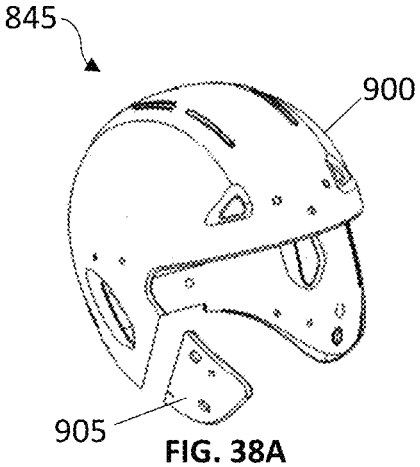
FIGS. 38A-38C depict view of one exemplary embodiment of a new PS helmet, illustrating modular jaw flaps that can be utilized with and/or without cavities formed therein.
Figure 38B:
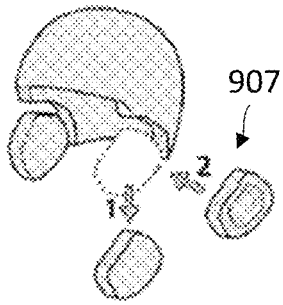
Figure 38C:
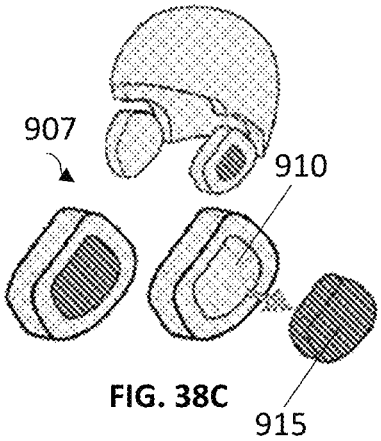

In an exemplary embodiment, removal of at least a portion of the CA helmet may be recommended to affix the impact protective elements to achieve a desired PS helmet. The removal of at least a portion of the CA helmet may include the CA helmet outer layer, the CA helmet inner layer, the CA helmet impact absorbing layer, the padded inner lining and/or any combination(s) thereof. For example, FIG. 38A-38C illustrates an exemplary removal of a jaw flap region 905 of an existing CA outer layer helmet 900. The jaw flap region 905 may be replaced with an adapted "position-specific" jaw flap 907 and affixed to the main CA helmet structure 900 permanently or temporarily (i.e., removably connected). One embodiment may include a strengthened jaw flap material with additional supplemental impact protection properties, where the jaw flap mimics the shape and configuration of the original jaw flap (noted as "1" under FIG. 38B). Alternatively, the jaw flap may be replaced with a jaw flap stock that is designed to receive supplemental impact mitigating elements and/or individual supplemental impact protection pads 915 (noted as "2" under FIG. 38B). The jaw flap stock can comprise an open cavity 910 that is sized and configured to receive modular or segmented supplemental impact protective elements, impact mitigating structures or individual supplemental impact protection pads 915. The modular or segmented impact mitigating structures or individual impact protection pads can be removed and replaced continuously until a desired PS helmet is achieved. The open cavity may face inwards towards the player's face or externally, on outside of helmet.

Figure 39:
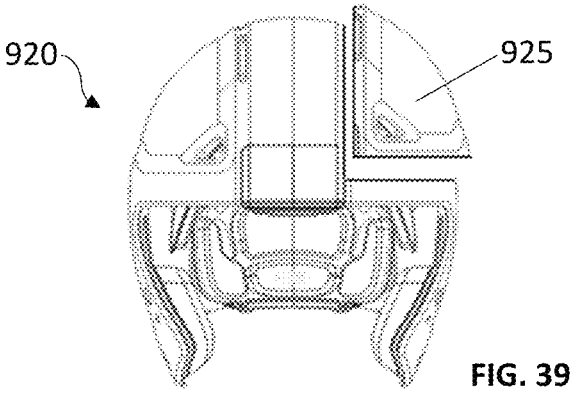
FIG. 39 depicts a view of one exemplary embodiment of a new PS helmet design having at least of portion of the helmet comprising modular components.

In another embodiment, FIG. 39 illustrates a modular position-specific helmet 920. The modular position-specific helmet 920 comprises at least a portion of the of the CA helmet having been removed. In this embodiment, the temporal section was removed, and the temporal section may be replaced with an adapted "position-specific" temporal segment and affixed to the main CA helmet structure permanently or temporarily (i.e., removably connected). The position-specific temporal segment may comprise one or more supplemental impact protective elements. Alternatively, one embodiment of a position-specific adaptation may include a strengthened and/or enhanced material with additional supplemental impact properties, where the PS temporal segment mimics the shape and configuration of the original temporal section. Alternatively, the PS temporal segment may be replaced with a PS temporal segment stock that is designed to receive supplemental impact mitigating structures or individual supplemental impact protection pads. The PS temporal segment stock can comprise an open cavity that is sized and configured to receive modular or segmented supplemental impact mitigating structures or individual supplemental impact protection pads. The modular or segmented supplemental impact mitigating structures or individual supplemental impact protection pads can be removed and replaced continuously until a desired PS helmet is achieved. The open cavity may face inwards towards the player's face or externally, on outside of helmet. Other regions may be removed, such as the jaw, front, back, right, left, and ridge.

In another exemplary embodiment, the supplemental impact protective elements may include replacement of the original padded liner with "position-specific" padded liner with supplemental impact protective elements to achieve a desired PS helmet (not shown). At least a portion of the original padded liner may be removed and replaced with a padded liner having at least one supplemental impact protective element(s). The supplemental impact protective elements may include supplemental impact mitigating structures. The supplemental impact mitigating structures may comprise filaments (i.e., longitudinally extending members that may deform non-linearly in response to an impact source), polygonal structures (in an array or segmented), single-layered impact layers or multi-layered impact layers, and/or any combination thereof. Furthermore, the supplemental impact mitigating structures may be provided in a continuous (not shown) or modular/segmented arrangement.

In another exemplary embodiment, one or more portions of a commercially available helmet may be intentionally weakened and/or otherwise modified to accommodate a desired purpose, with supplemental impact protection elements added thereto. For example, a portion of the forehead and/or crown of a helmet's outer surface may be cut, separated, weakened and/or partially severed to provide increased flexibility to the remaining helmet portion(s) (i.e., a forehead flap comprising a portion of the outer helmet surface), with a supplemental impact protection element that can be (1) added to the inside of the helmet proximate to the weakened portion, (2) added over the helmet proximate to the weakened portion, and/or (3) extending through the helmet proximate to the weakened portion.

New or Customized Position-Specific Helmet

Designing a new position-specific helmet (PS helmet) may be accomplished by using methods or mechanisms that affix or incorporate supplemental impact protection elements related to a "position-specific" factor (or combination of "position-specific" factors). The supplemental impact protection elements may be static, dynamic, permanent, detachable (connectedly removable) elements.

Figure 40A:
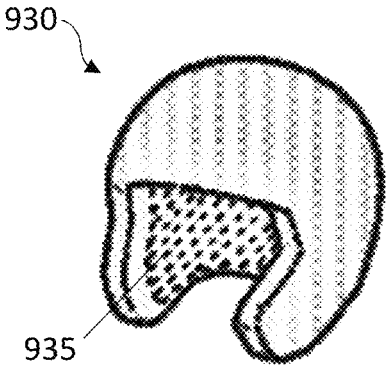
FIGS. 40A-40B depict various embodiments of the inner surface of different PS helmet layers with continuous or segmented cavities.
Figure 40B:
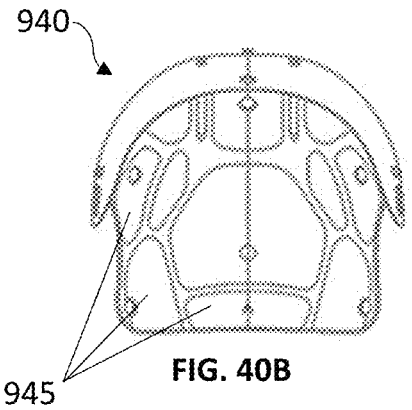
Figure 41A:
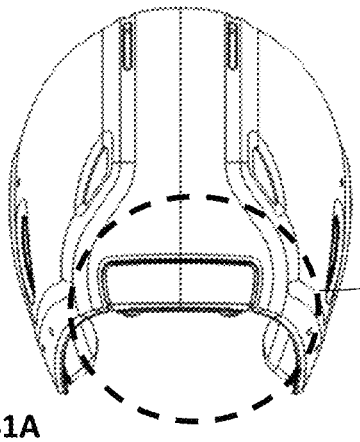
FIGS. 41A-41B depict various embodiments of an outer surface of a PS helmet outer layer with segmented cavities.
Figure 41B:
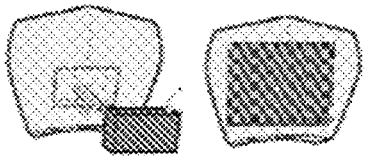
Figure 42A:
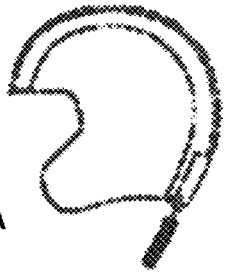
FIGS. 42A-42B depict various embodiments of a PS helmet impact absorbing layer with continuous cavities.
Figure 42B:
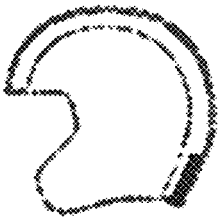

In another exemplary embodiment, a new PS helmet may be designed with cavities that are sized and/or configured to receive supplemental impact protective elements to achieve a desired PS helmet design. At least a portion of the internal surface of a PS helmet outer layer, the PS inner layer, the impact absorbing layer and/or any combination(s) thereof may have continuous or segmented cavities. FIG. 40A depicts a stock PS helmet outer layer (or PS helmet inner layer) that may include a large continuous cavity or recess disposed on the inner surface. The large continuous cavity or recess may be sized and configured to receive one or more supplemental impact protective elements for a desired "position-specific" purpose as shown in FIG. 41B. The supplemental impact protective elements may include supplemental impact mitigating structures or individual supplemental impact protection pads. The supplemental impact protective elements may be continuous or segmented and can be affixed within the large continuous cavity. The segmented supplemental impact protective elements may be coupled to the proximate segmented supplemental impact protective element, if desired. At least a portion of the modular or segmented supplemental impact protective elements can be removed and replaced continuously until a desired PS helmet is achieved or worn. Alternatively, FIG. 40B illustrates one or more segmented cavities or recesses disposed within the inner surface of a PS helmet inner layer (or a helmet outer layer) that is sized and configured to receive modular or segmented supplemental impact protective elements. Furthermore, the large continuous cavity or segmented cavities may be disposed on the external surface of the PS outer layer, PS inner layer impact absorbing layer, and/or any combination thereof, including embodiments where the supplemental impact absorbing layer extends through the helmet outer layer. FIGS. 41A-41B and 42A-42B shows alternate embodiments of cavities on the external surface of the PS outer layer (see FIGS. 41A-41B), and cavities disposed within the impact absorbing layer (see FIG. 42A-42B).

Figure 43A:
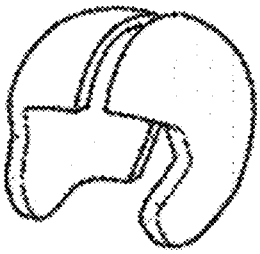
FIGS. 43A-43C depict various embodiments of a modular PS helmet.
Figure 43B:
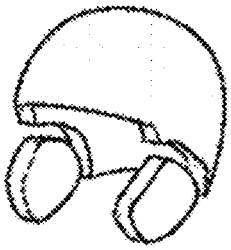
Figure 43C:
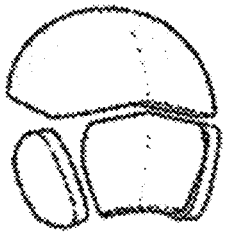

In another exemplary embodiment, a new PS helmet may be designed with modular or segmented sections. The position-specific helmet may comprise a plurality of modular helmet portions. Each of the plurality of modular helmet portions may be coupled to the adjacent modular helmet portions. At least a portion of the PS helmet outer layer, PS inner layer, impact absorbing layer and any combination thereof may be modular or segmented as shown in FIG. 43A-43C. For example, FIG. 43C illustrates on or more segmented helmet sections. The one or more segmented helmet sections may represent regions located on the front, ridge, right, left, jaw, back, and/or any combination thereof. At least one segment may be designed to achieve a "position-specific" purpose. Remaining pieces and/or portions may be designed with standard materials that meet standard testing. All segments may be mixed and matched with "position-specific" purpose segments and standard segments to create a new PS helmet design.

Figure 44A:
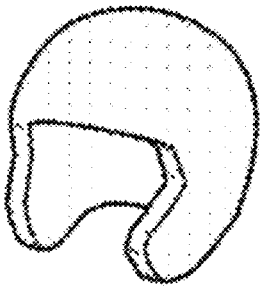
FIGS. 44A-44C depict various illustrations of an air expandable PS helmet.
Figure 44B:
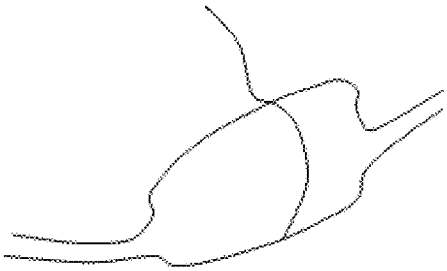
Figure 44C:
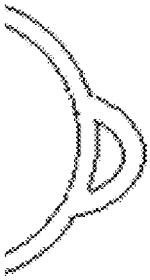

In another exemplary embodiment, a new PS helmet may be designed with modular or segmented air pockets. For example, FIGS. 44A-44C depicts one embodiment of a supplemental air pocket that may be inserted into at least a portion of the PS helmet outer layer, PS inner layer, impact absorbing layer and/or any combination thereof may include air pockets. The supplemental air pocket(s) may be designed to expand on the external or internal surface of the PS helmet outer layer or PS helmet inner layer. Alternatively, specific cavities may be disposed within the impact absorbing layer to allow controlled expansion/contraction of the air pockets. Standard access ports known in the art may be incorporated into the into at least a portion of the PS helmet outer layer, PS inner layer, impact absorbing layer and/or any combination thereof. Furthermore, an air pocket may include an air bladder.

Affixation Methods

The supplemental impact protection elements or structures may be affixed by a variety of methods and/or mechanisms for the embodiments disclosed herein. In one embodiment, affixation of the supplemental impact protection elements may include adhesives, shrink-wrap coverings or segmented coverings (using heat to contract the shrink-wrap over a specific area of the helmet, magnets, ultrasonic weld, off weld, hook & loop (Velcro), suction cups, sintering, and/or any other methods recognized by those ordinary skilled in the art.

Figure 45A:
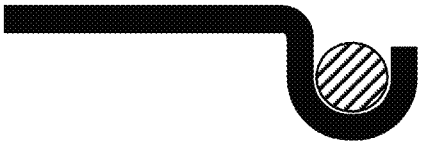
FIGS. 45A-45F depict views of various exemplary embodiments of mechanical affixations to CA helmets.
Figure 45B:
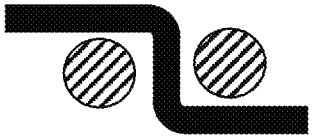
Figure 45C:
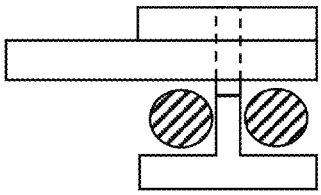
Figure 45D:
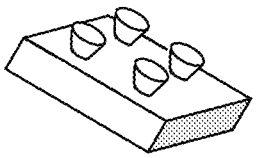
Figure 45E:
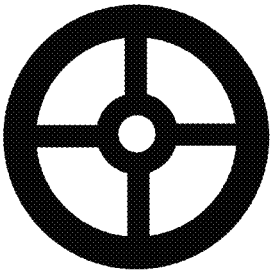
Figure 45F:
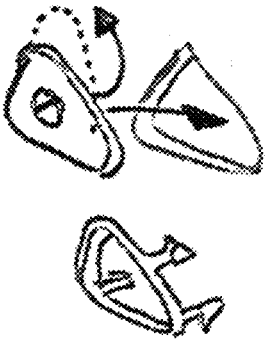

In another embodiment, affixation of the supplemental impact protection elements may include mechanical connections. Such mechanical connections may include a Z connection (FIG. 45B), a hook connection (FIG. 45B), barbell shaped grommet (FIG. 45C), suction cups (FIG. 45D), omni or flexible arm grommet (FIG. 45E), twist cam lock (FIG. 45F), collet connection, T-Nuts, T-shaped barbell, longitudinal extending members with locking cap ("fin" with lock cap), screws and bolts, interlocking protrusions, e.g. LEGOs (where the one part has "female" indentations on one surface and the "male" protrusions on the second part, allowing removable connections), quick disconnections, dovetail, and/or any combination thereof. Each of these mechanical connections may be inserted through any of the existing features of a CA helmet or may require minor modifications with penetration through at least one of the CA helmet outer layer, CA helmet inner layer, the CA impact absorbing layer, and/or any combination thereof.

Impact Absorbing/Mitigation Layer and Supplemental Impact Protective Elements

The CA helmet impact absorbing layer and/or the supplemental impact protective elements may include impact mitigating structures. Such impact mitigating structures will desirably help absorb and dissipate the impact forces. The supplemental impact mitigating structures may include the same impact mitigating structure for the CA helmet impact absorbing layer and/or for the supplemental impact protective elements. The impact absorbing layer may also have impact protective elements disposed within. Alternatively, the impact mitigating structures for the helmet impact absorbing layer may be different than the supplemental impact protective elements. The impact mitigation structures may comprise at least a portion of filaments, a portion of laterally supported filaments, auxetic structures, zig-zag structures, chevron structures, herringbone structures, one or more foam layers, and/or any combination(s) thereof.

Figure 46A:
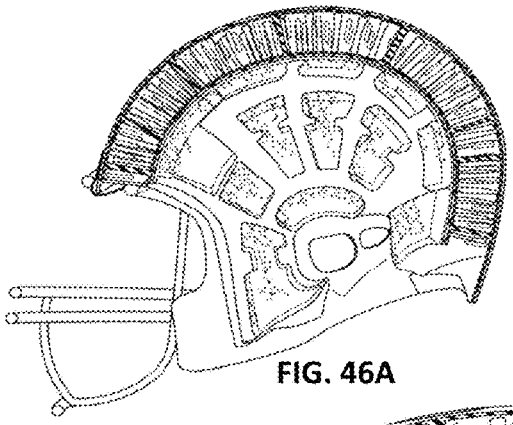
FIGS. 46A-46B depict cross-sectional views of one exemplary embodiment of an impact mitigating structure with filaments.
Figure 46B:
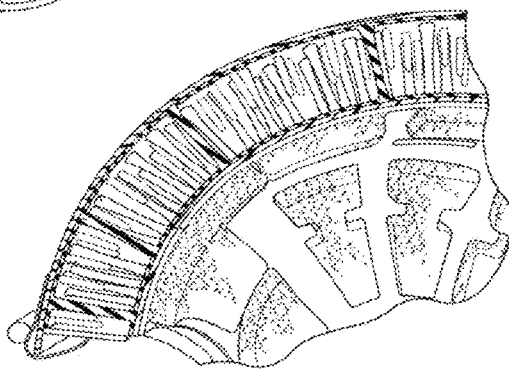

In one exemplary embodiment, the impact mitigating structures can comprise at least a portion of filaments. FIG. 46A-46B depicts at least a portion of filaments may be thin, longitudinally extending members or be shaped and configured to buckle and/or deform non-linearly in response to an impact force. The at least a portion of filaments having a cross-sectional shape selected from one of the following: circular, hexagonal, triangular, square, and rectangular.

The non-linear deformation behavior is expected to provide improved protection against high-impact forces, and/or oblique forces. The non-linear deformation behavior is described by at least a portion of the filaments stress-strain profile. The non-linear stress-strain profile illustrates that there is an initial rapid increase in force (region I) followed by a change in slope that may be flat, decreasing or increasing slope (region II), followed by a third region with a different slope (region III). In various embodiments, the change in slope may be an abrupt change, such as where the filament buckles under a compressive load, while in other embodiment the change in slope may be slower and/or "smoother" under filament loading. Such deformation behavior describes a single cycle of deformation and/or buckling.

Figure 47A:
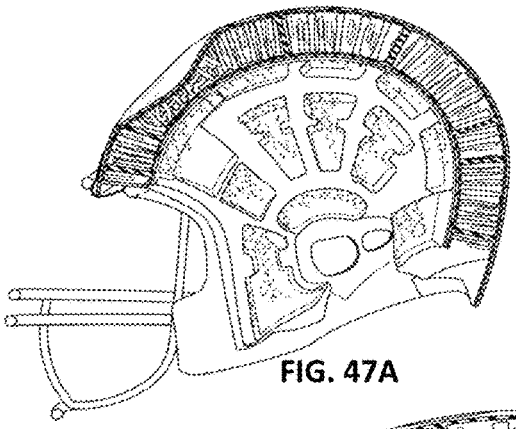
FIGS. 47A-47B depict cross-sectional views of one exemplary embodiment of an impact mitigating structure with filaments in response to an impact.
Figure 47B:
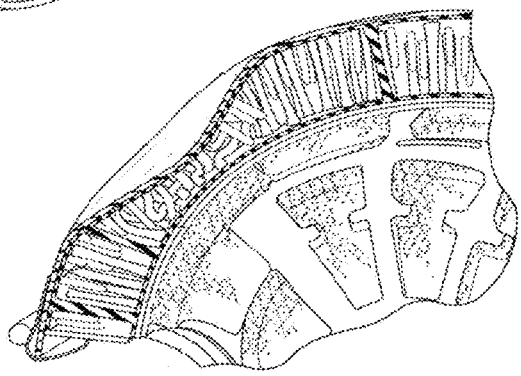
Figure 64A:
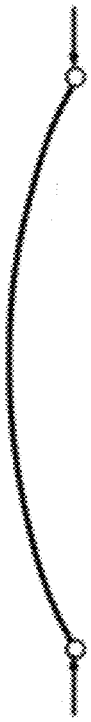
FIGS. 64A-64C depicts one embodiment of various buckling modes of a filament.
Figure 64B:
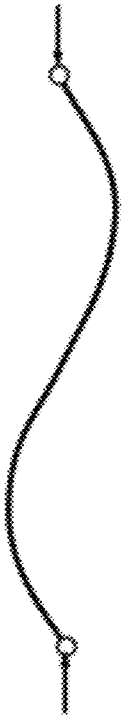
Figure 64C:
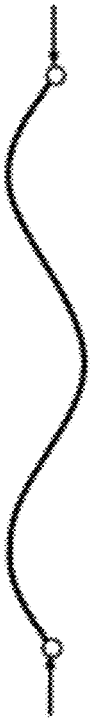

In another embodiment, the at least a portion of the filaments may comprise filaments that buckle in response to an incident force, where buckling may be characterized by a localized, sudden failure of the filament structure subjected to high compressive stress, where the actual compressive stress at the point of failure is less than the ultimate compressive stress that the material is capable of withstanding as shown in FIG. 47A-47B. In at least one exemplary embodiment, the buckling of the majority of the filaments will comprise single-mode buckling performance (see FIG. 64A), while in other embodiments the mode of buckling of some or all of the filaments could comprise second mode buckling (FIG. 64B), or third mode buckling (FIG. 64C), or higher modes of buckling, or various combination(s) thereof. Furthermore, the at least a portion of the filaments may be configured to deform elastically, allowing the at least a portion of the filaments to substantially return to their initial configuration once the external force is removed. The filaments may be coupled to the inner layer, the outer layer, and/or the inner layer and the outer layer.

Figure 48A:
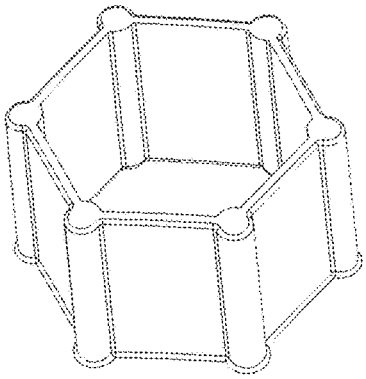
FIGS. 48A-48B depict a top perspective view of filaments with laterally positioned walls shaped into a polygonal structure.
Figure 48B:
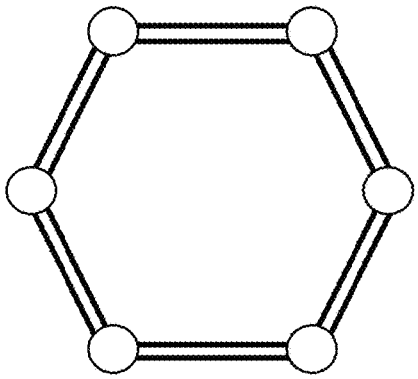
Figure 49A:
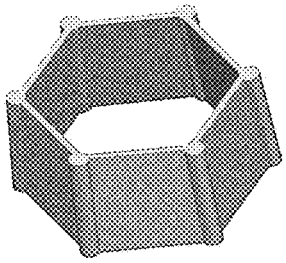
FIGS. 49A-49C depict top perspective views of various exemplary embodiments of individual filaments with laterally positioned walls.
Figure 49B:
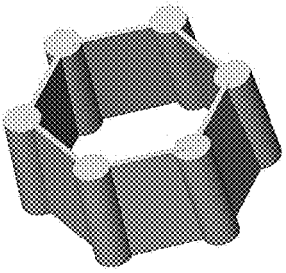
Figure 49C:
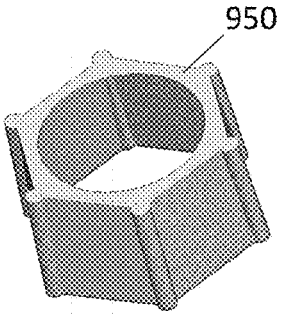

In another exemplary embodiment, the impact mitigating structures can comprise at least a portion of a plurality of filaments that are interconnected by laterally positioned walls or sheets in a polygonal configuration. FIGS. 48A-48B illustrates the at least a portion of the filaments arranged in a hexagonal pattern interconnected by laterally positioned walls. Alternatively, other polygonal structures known in the art may be contemplated, such as triangular, square, pentagonal, hexagonal, septagonal, octagonal, etc. A plurality of sheets or lateral walls can be secured between adjacent pairs of filaments with each filament having a pair of lateral walls attached thereto. In the disclosed embodiment, the lateral walls can be oriented approximately 120 degrees apart about the filament axis, with each lateral wall extending substantially along the longitudinal length of the filament. Alternatively, the hexagonal pattern may allow at least one lateral wall to be asymmetric, which the angle of the wall may be between 90 to 135 degrees. The shape, wall thickness or diameter, height, and configuration of the lateral walls and/or filaments may vary as shown in FIGS. 48A-48C to "tune" or "tailor" the structures to a desired performance. For example, one embodiment of a hexagonal structure may have a tapered configuration as shown in FIG. 49A-49C. The hexagonal structure can have a top surface and a bottom surface, with the bottom surface perimeter (and/or bottom surface thickness/diameter of the individual elements) may be larger than the corresponding top surface perimeter (and/or individual element thickness/diameter). In another example, the hexagonal structure can have an upper ridge 950 as shown in FIG. 49C. The upper ridge can also facilitate connection to another structure, such as an inner surface of a helmet, an item of protective clothing, and/or a mechanical connection (e.g., a grommet or plug having an enlarged tip that is desirably slightly larger than the opening in the upper ridge of the hexagonal element).

Figure 50A:
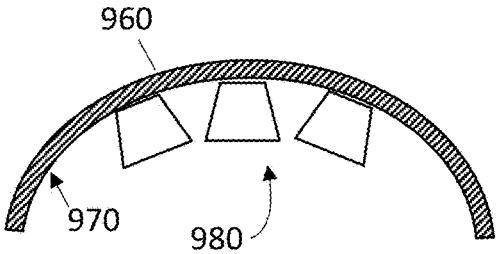
FIGS. 50A-50B illustrate cross-section views of individual polygonal or hexagonal structures affixed to the inner surface of the outer layer and/or the inner layer.
Figure 50B:
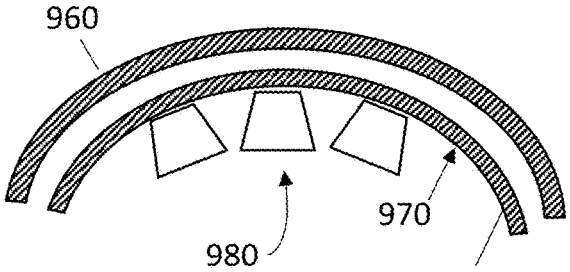

Furthermore, the polygonal or hexagonal structures may be manufactured as individual structures. The manufacturing individual polygonal or hexagonal structures may include extrusion, investment casting or injection molding process. Each individual polygonal or hexagonal structure may be affixed directly to the inner or outer surface of the helmet outer layer, inner or outer surface of the helmet inner layer, the inner or outer surface of the helmet impact absorbing layer, and/or any combination thereof. FIGS. 50A-50B illustrate individual polygonal or hexagonal structures 980 affixed to the inner surface 970 of the outer layer 960 and the inner layer 990, respectively. Affixing each individual polygonal or hexagonal structure 980 may be arranged in continuous or segmented array. Also, they may have the same shape and configuration with repeating symmetrical arrangement or asymmetrical arrangement and/or different shape and configurations with repeating symmetrical arrangement or asymmetrical arrangement.

Figure 51A:
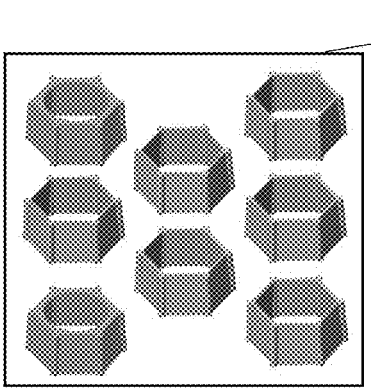
FIGS. 51A-51C depicts front perspective views of various different exemplary embodiments of polygonal and/or hexagonal filament structures in a patterned array affixed to at least one base membrane.
Figure 51B:
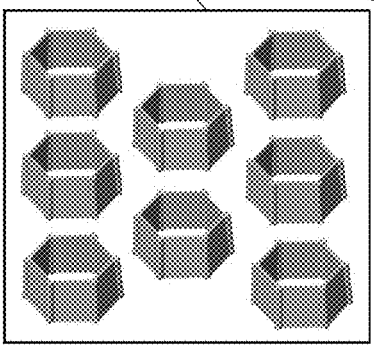
Figure 51C:
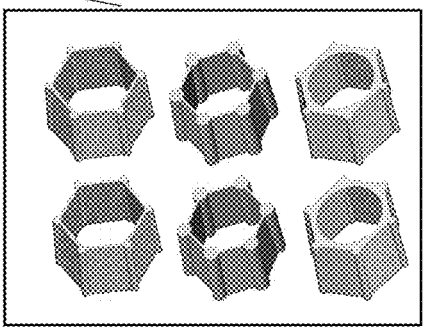
Figure 52A:
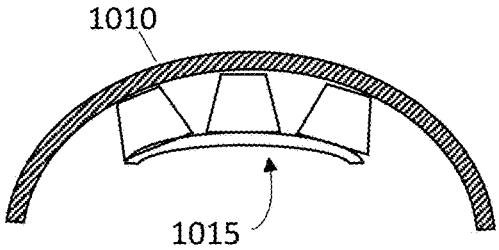
FIGS. 52A-52B illustrate cross-section views of patterned arrays of polygonal and/or hexagonal filament structures, with a base membrane affixed to the inner surface of the outer layer and the inner layer, respectively.
Figure 52B:
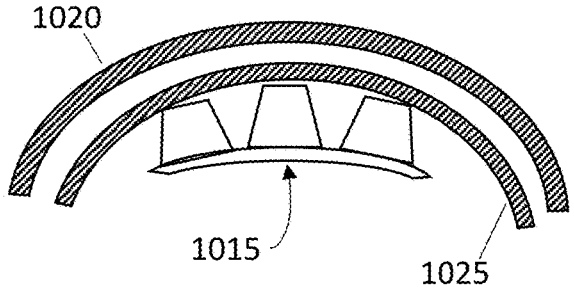

Conversely, the polygonal or hexagonal structures 980 may be manufactured directly into a patterned array affixed to at least one base membrane 1000 as shown in FIGS. 51A-51C. The base membrane 1000 may be manufactured with a polymeric or foam material. The polymeric or foam material may be elastic to allow it to be easily bent, twisted or flexed to conform to complex surfaces. Alternatively, the polymeric and/or foam material may be substantially rigid. The manufacturing of each patterned array of polygonal or hexagonal structures may include extrusion, investment casting or injection molding process. Each patterned array of polygonal or hexagonal structure and/or the base membrane may be affixed directly to the inner or outer surface of the helmet outer layer, inner or outer surface of the helmet inner layer, the inner or outer surface of the helmet impact absorbing layer, and/or any combination thereof. FIGS. 52A-52B illustrate patterned arrays of polygonal or hexagonal structures 1015 affixed to the inner surface of the outer layer 1010 and the inner layer 1025, respectively, the hexagonal structures may be further affixed to a base membrane 1000. Affixing each pattered array of polygonal or hexagonal structures 1015 may be arranged in continuous or segmented arrays. Also, the polygonal or hexagonal structures 1015 may have the same shape and configuration with repeating symmetrical arrangement or asymmetrical arrangement and/or different shape and configurations with repeating symmetrical arrangement or asymmetrical arrangement. The polygonal structures 1015 may be coupled to the inner layer, the outer layer, and/or the inner and outer layer.

In another exemplary embodiment, the supplemental impact mitigating structures may comprise auxetic structures. The auxetic structures can desirably include a plurality of interconnected members forming an array of reentrant shapes positioned on the flexible head layer. The term "auxetic" generally refers to a material or structure that has a negative Poisson's ratio, when stretched, auxetic materials or structures become thicker (as opposed to thinner) in a direction perpendicular to the applied force. Such auxetic structures can provide high energy absorption and fracture resistance. In particular, when a force is applied to the auxetic material or structure, the impact can cause it to expand (or contract) in one direction, resulting in associated expansion (or contraction in a perpendicular direction. It will be recognized that those skilled in the art recognize that the auxetic structures shown may include differently shaped segments or other structural members and different shaped voids.

The auxetic structures may be bonded to a base layer and/or a head cap. The base layer or head cap may be comprised of a resilient fabric that may be a two-way or four-way stretch material. The auxetic layer and the base layer may be coupled to the foam layer. Such coupling may include adhesives, molding, welding, sintering or any other method known in the art. The foam layer may be comprised of a single layer or multiple layers, which any of the layers may be comprised of various types of foam, such as TPU foam, Poron XRD foam, impact resistant foam, and/or any combination thereof. All of the segmented auxetic arrays may be coupled to the base layer or at least a portion of the segmented auxetic arrays may be coupled to the base layer.

Figure 53A:
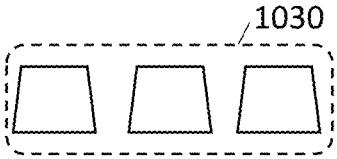
FIGS. 53A-53C depict various embodiments of hexagonal or polygonal filament structures to form pads.
Figure 53B:
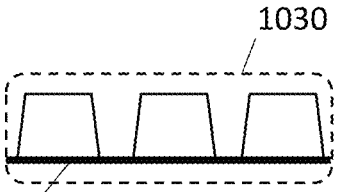
Figure 53C:
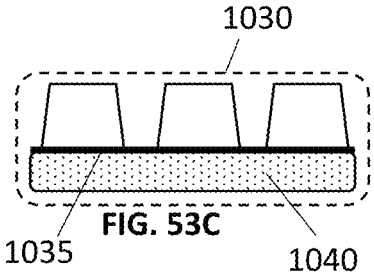
Figure 54A:
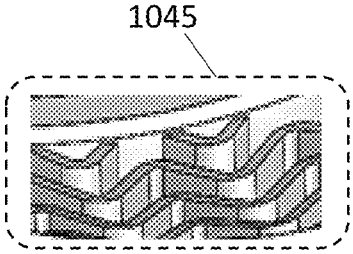
FIGS. 54A-54C depict various views of exemplary embodiments of auxetic structures to form pads.
Figure 54B:
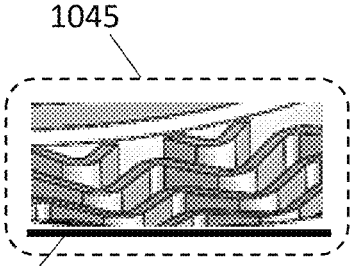
Figure 54C:
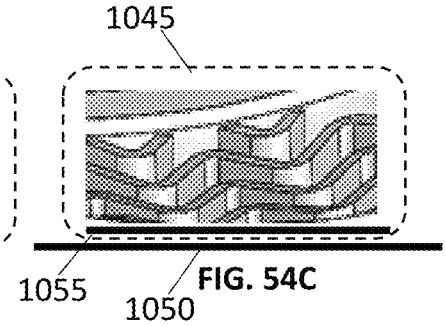
Figure 55A:
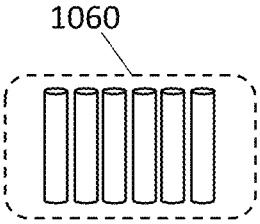
FIGS. 55A-55C depict various views of exemplary embodiments of filaments with coverings to form pads.
Figure 55B:
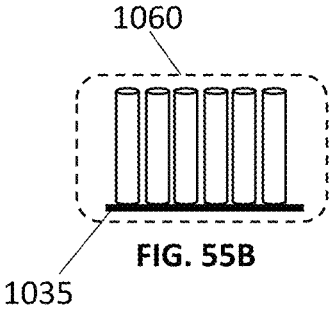
Figure 55C:
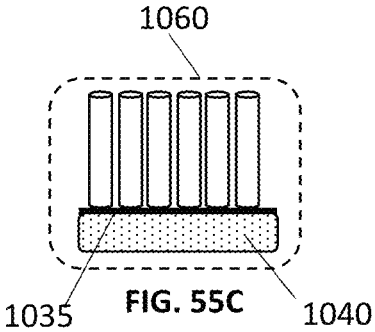

In another exemplary embodiment, each of the individual supplemental impact protective elements and/or impact mitigation layers may comprise mitigating structures or patterned array of mitigating structures which may optionally have at least one covering 1030 to form individual pads, pad assemblies or pad arrays as shown in FIGS. 53A-53C, 54A-54C, and 55A-55C, including individual hexagonal structures (FIG. 53A), hexagonal structures with a base membrane 1035 (FIG. 53B) and/or hexagonal structures with a base membrane 1035 and a foam layer 1040 (FIG. 53C). The at least one covering may be a loosely or tightly woven fabric. The fabric may be polymeric, such as polypropylene, polyethylene, polyester, nylon, PVC, PTFE, and/or any combination thereof. The fabric may be 2-way or 4-way stretch material. Furthermore, the at least one covering may be breathable and wick away moisture easily from the skin while carrying out various sporting and athletic activities. For example, the covering may completely or continually cover an entire array of impact mitigating structures (not shown). Conversely, the covering may cover at least a portion of an entire array of impact mitigating structures. Furthermore, the covering may cover segmented arrays of impact mitigating structures or individual impact mitigating structures (not shown). FIGS. 54A-54C (auxetic structures) and 55A-55C (filament structures) show additional alternative embodiments of various supplemental impact mitigating structures with exemplary coverings 1045, 1060, base membranes 1035, foam layers 1040 and/or any combinations thereof.

In another exemplary embodiment, each of the individual impact mitigation layers, supplemental impact elements or patterned array of mitigating elements may have at least one foam layer as shown in FIGS. 53C and/or 55C. The at least one foam layer can include polymeric foams, quantum foam, polyethylene foam, polyurethane foam (foam rubber), XPS foam, polystyrene, phenolic, memory foam (traditional, open cell, or gel), impact absorbing foam, latex rubber foam, convoluted foam ("egg create foam"), Evlon foam, impact hardening foam, and/or any combination thereof. The at least one foam layer may have an open-cell structure or closed-cell structure. The at least one foam layer can be further tailored to obtain specific characteristics, such as anti-static, breathable, conductive, hydrophyllic, high-tensile, high-tear, controlled elongation, and/or any combination thereof.

Figure 56:
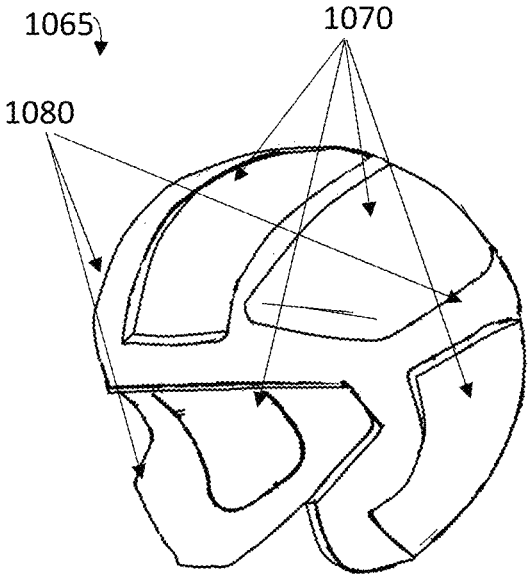
FIG. 56 depicts another exemplary embodiment of a player-specific helmet design.
Figure 57A:
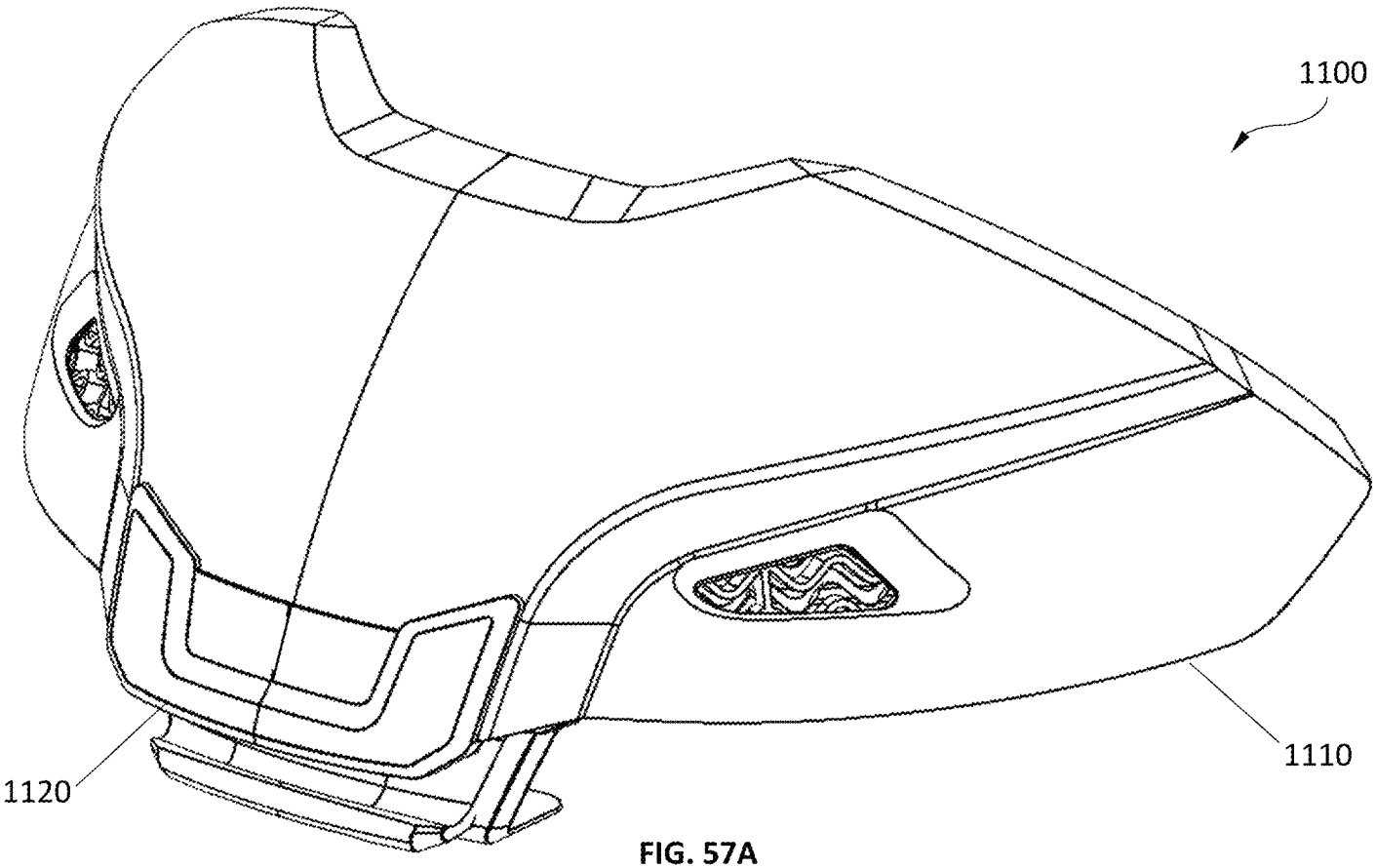
FIGS. 57A-57H depicts various views of one embodiment of a frontal supplemental impact element.
Figure 57B:
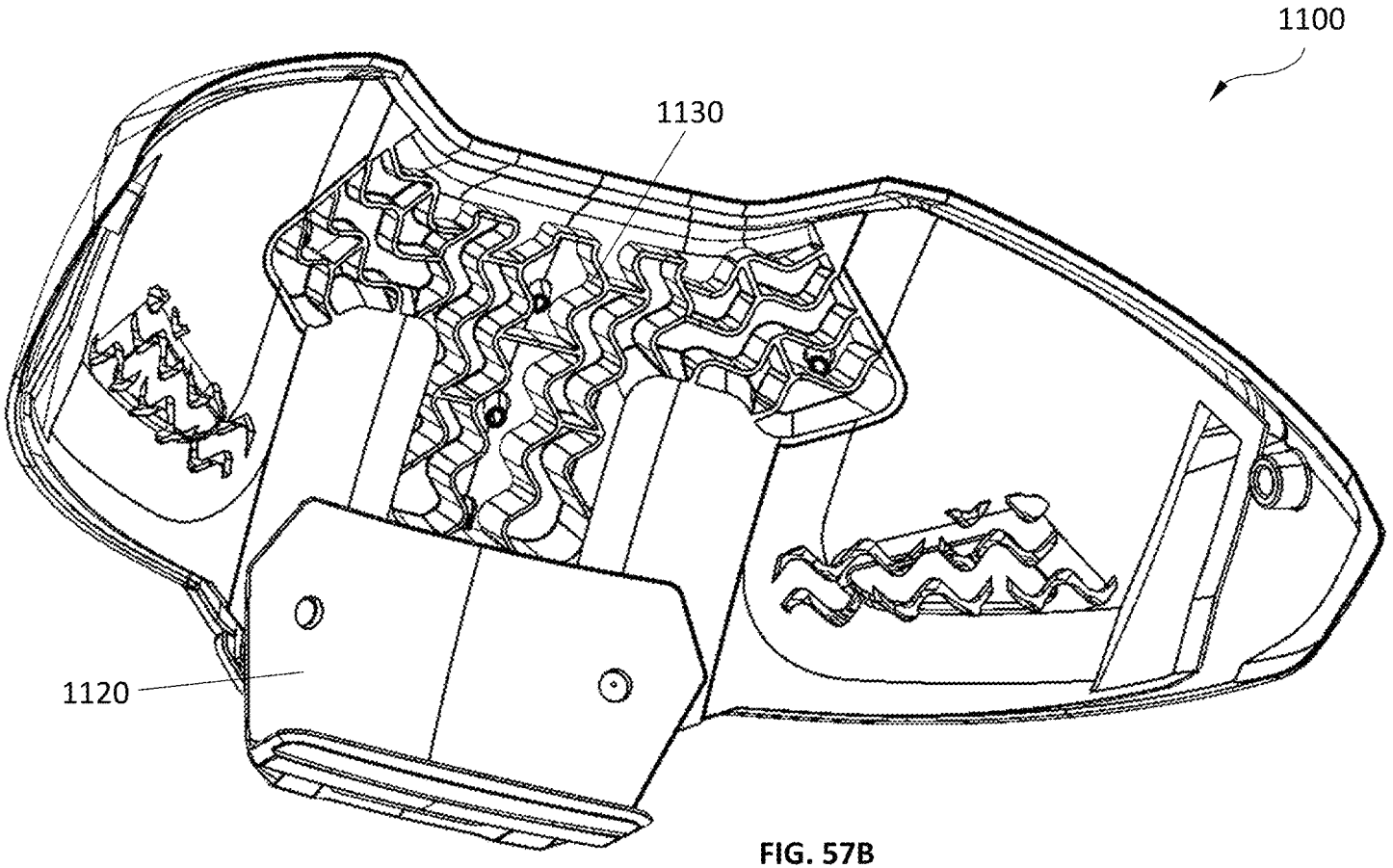
Figure 57D:
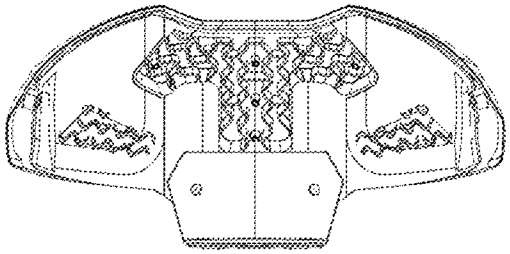
Figure 57E:
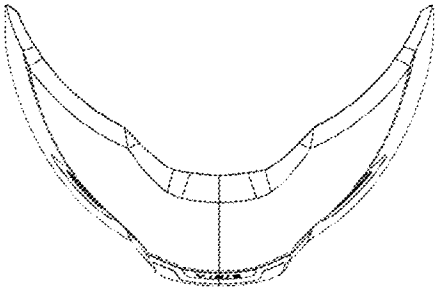
Figure 57C:
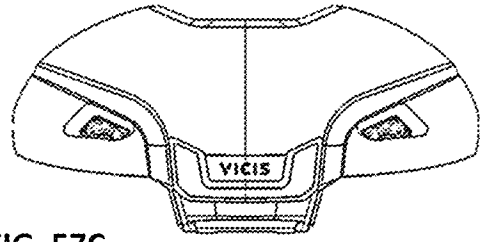
Figure 57F:
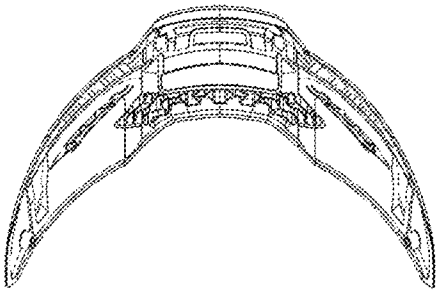
Figure 57G:
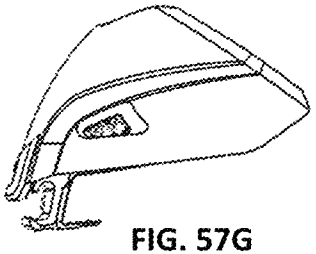
Figure 57H:
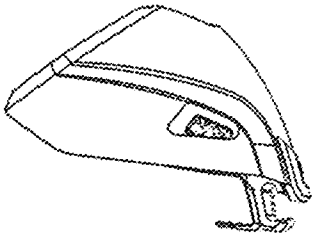
Figure 58:
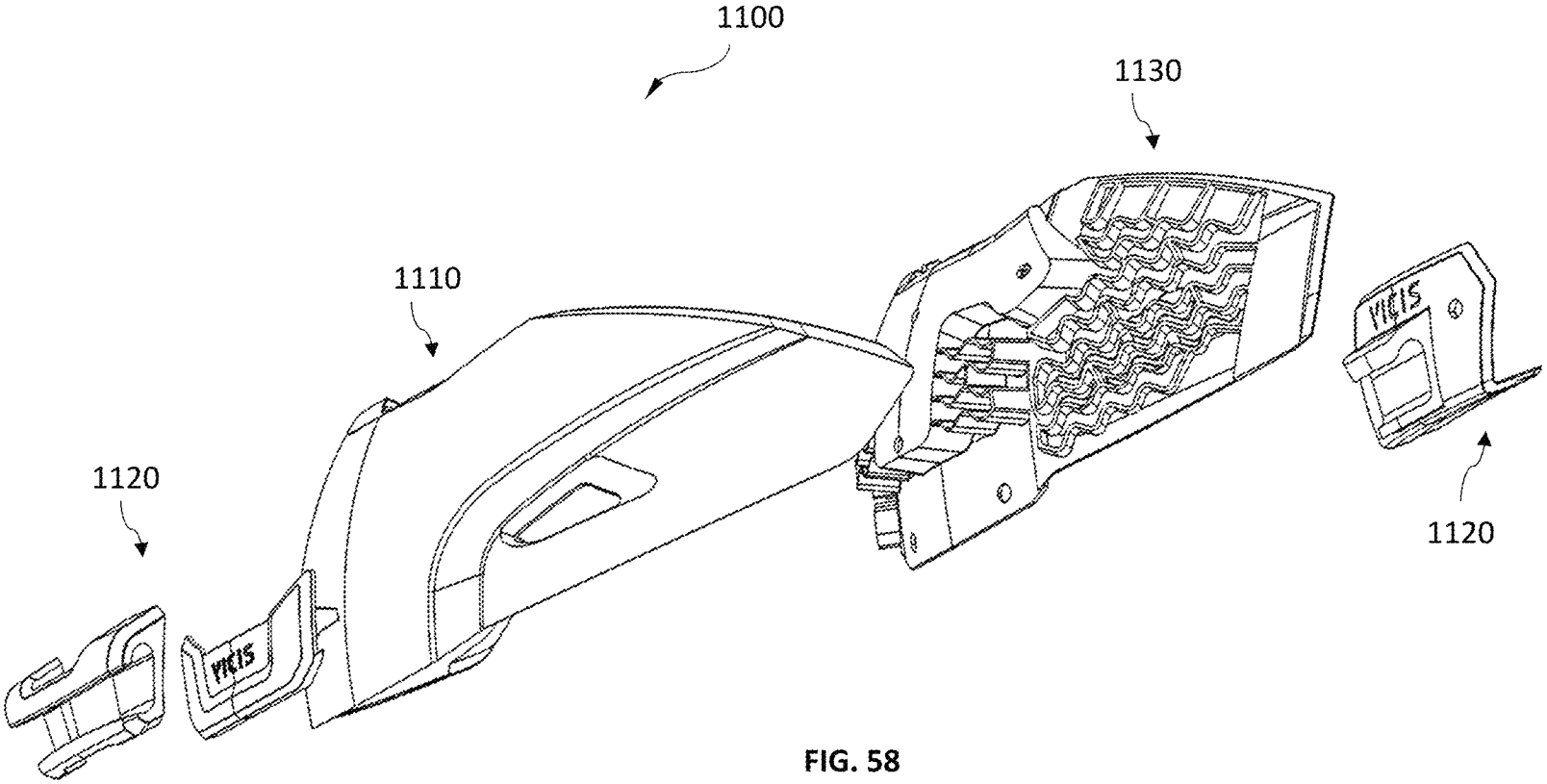
FIG. 58 depicts an exploded isometric view of one embodiment of a of a frontal supplemental impact element of FIG. 57A.
Figure 59A:
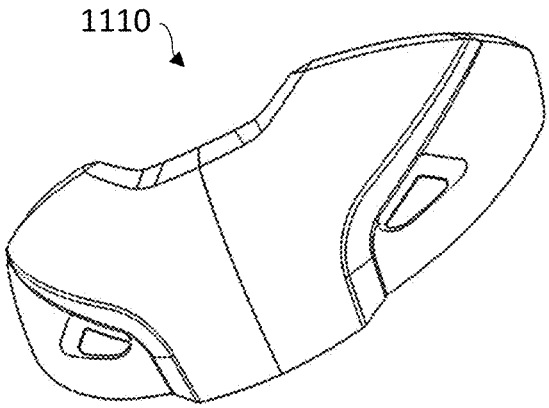
FIGS. 59A-59H depicts one embodiment of a first portion of a frontal supplemental impact protective element.
Figure 59B:
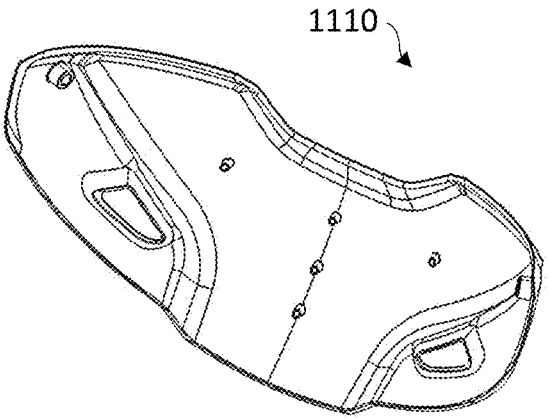
Figure 59C:
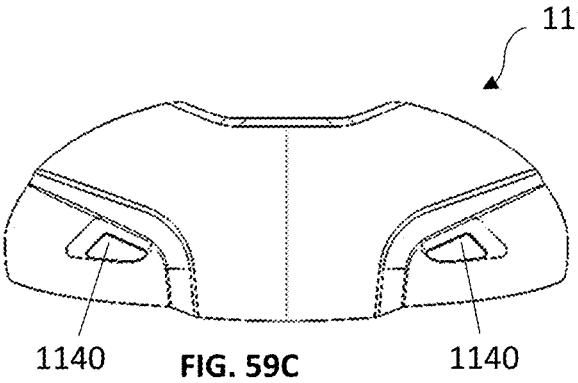
Figure 59D:
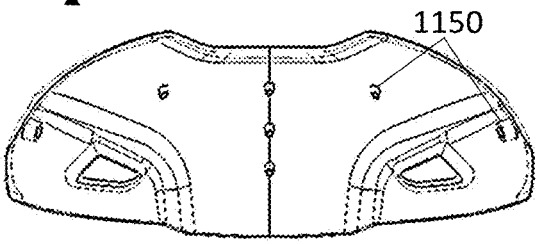
Figure 59E:
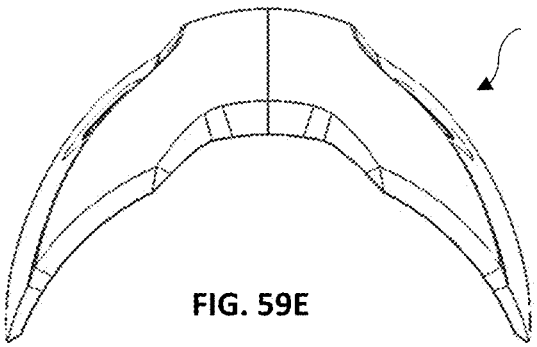
Figure 59F:
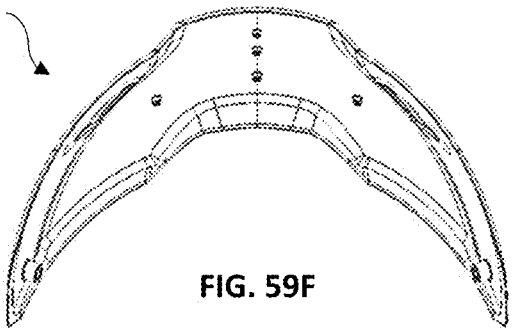
Figure 59G:
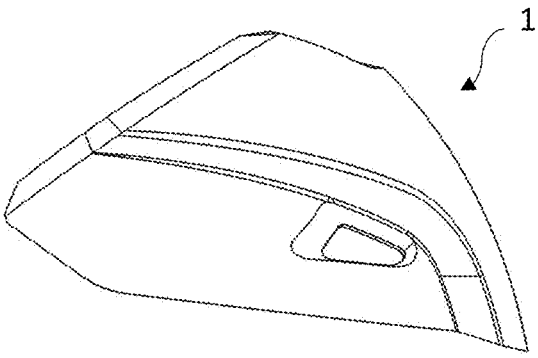
Figure 59H:
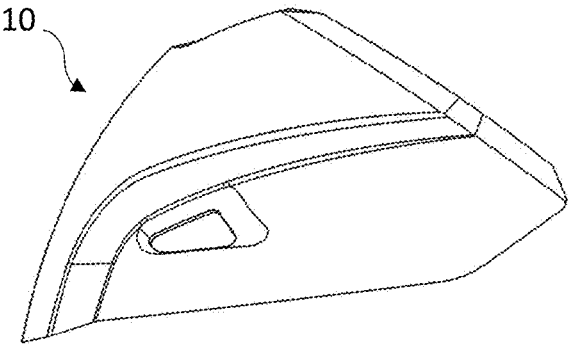
Figure 60:
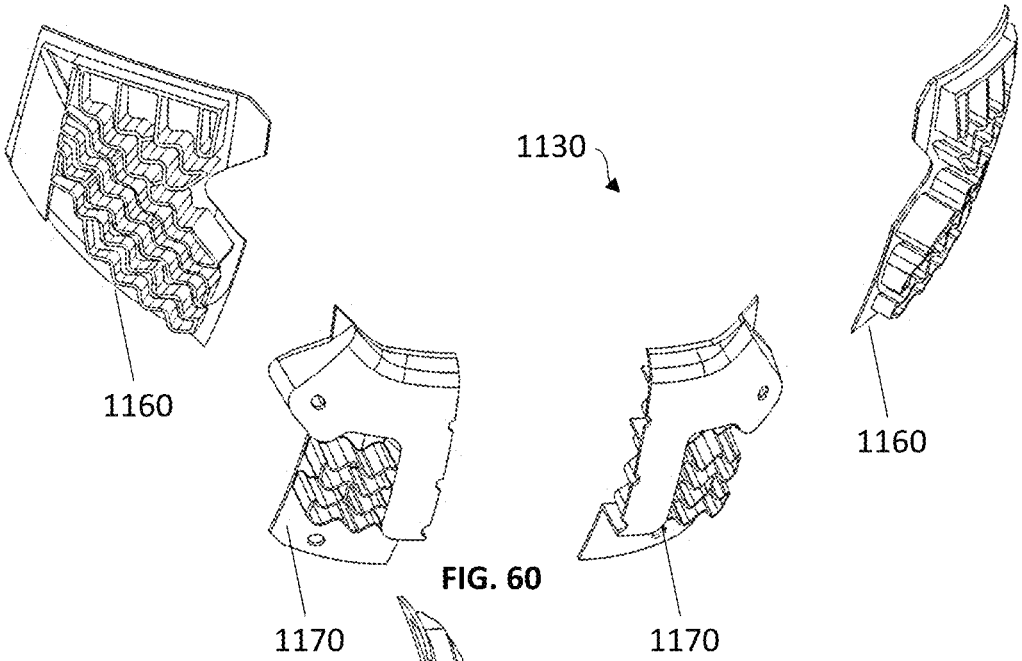
FIG. 60 depicts an exploded isometric view of one embodiment of a second portion of a frontal supplemental impact protective element.
Figure 61A:
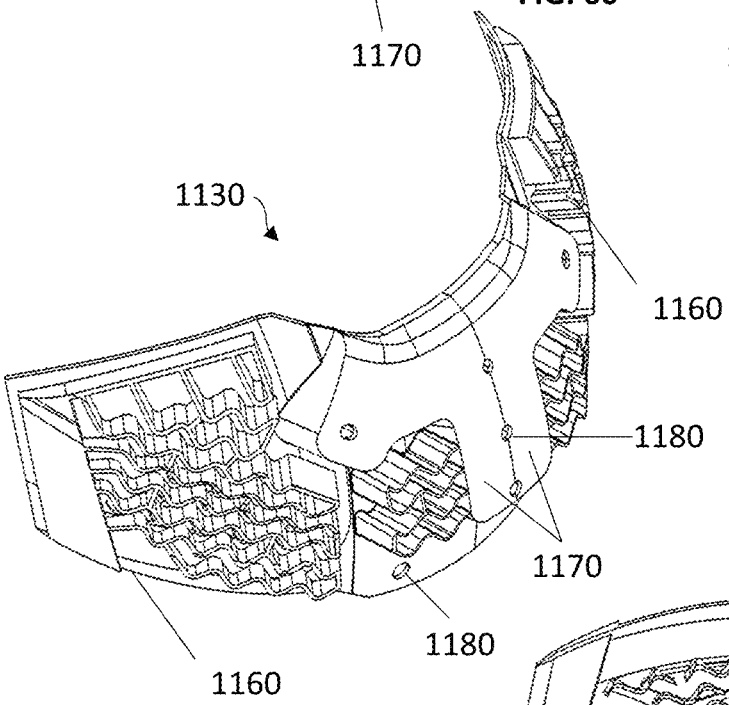
FIGS. 61A-61H depicts various views of one embodiment of a second portion of a supplemental frontal impact protective element.
Figure 61B:
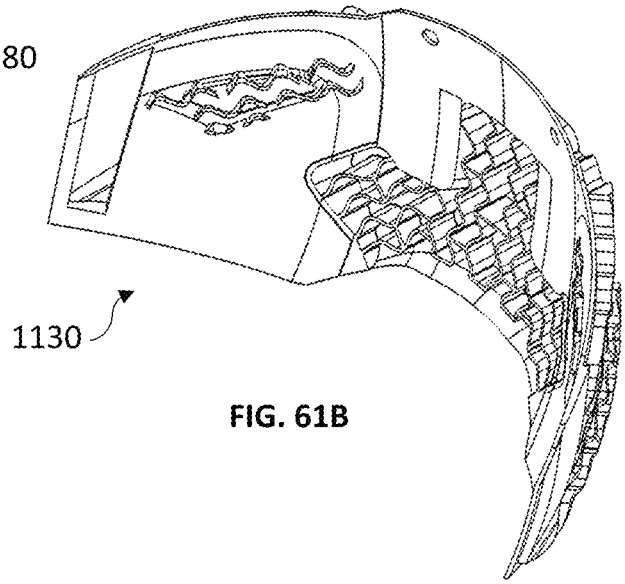
Figure 61C:
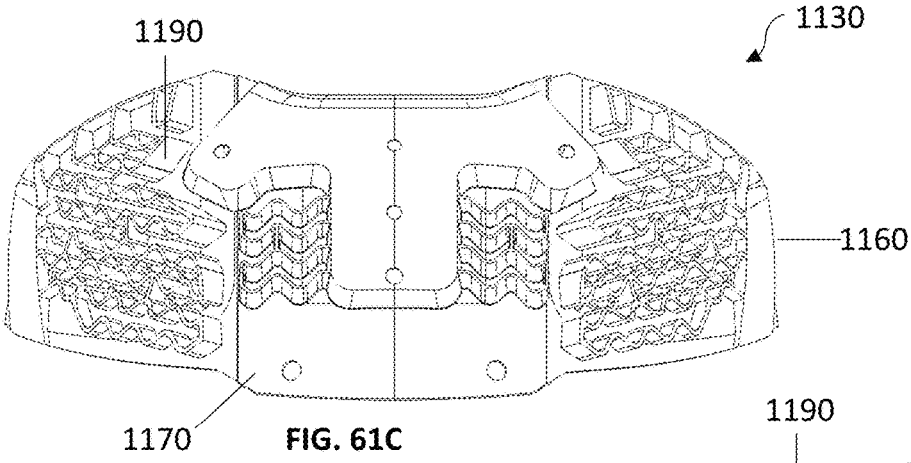
Figure 61D:
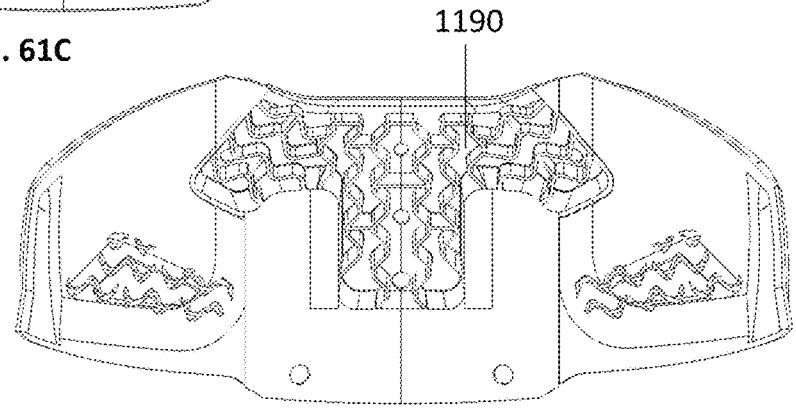
Figure 61E:
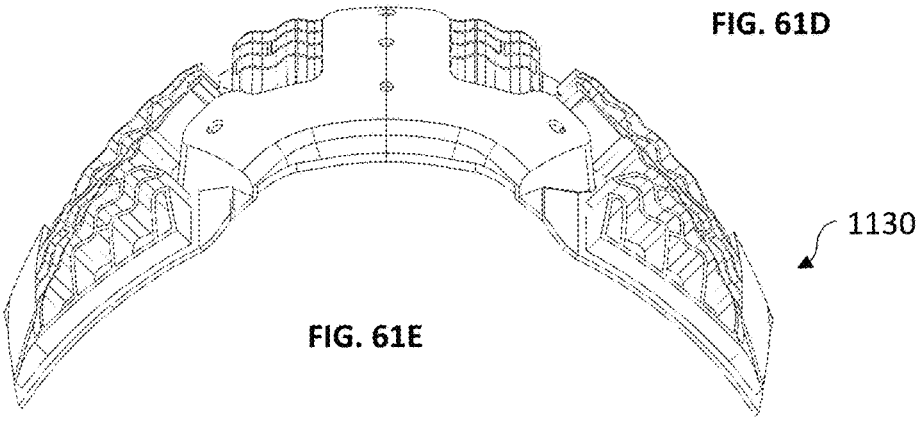
Figure 61F:
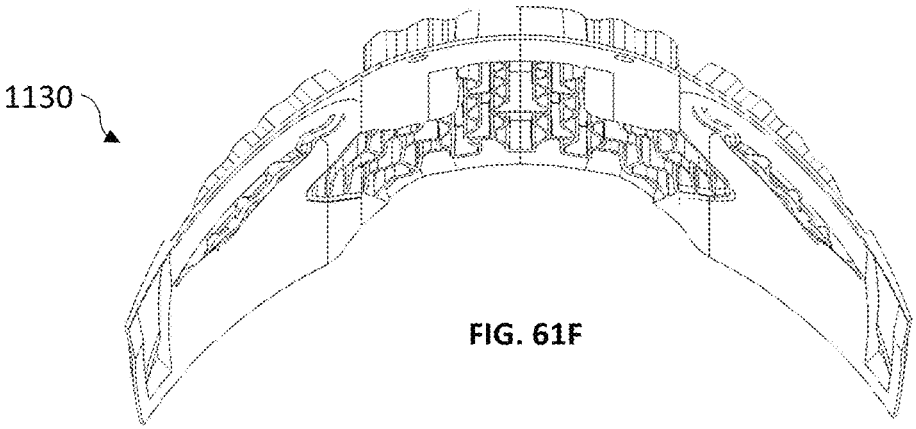
Figure 61G:
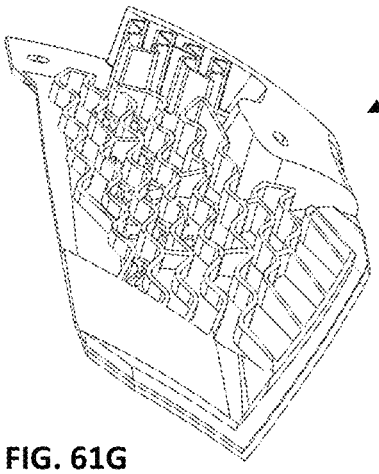
Figure 61H:
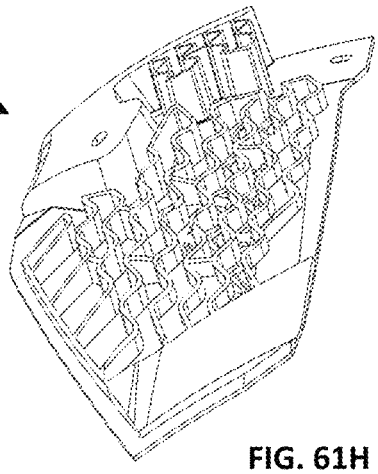

FIG. 56 depicts another exemplary embodiment of a player-specific helmet design 1065 incorporating supplemental impact absorbing elements. In this embodiment, the position-specific helmet 1065 may comprise at least a portion of a helmet with a first material 1070 and a second material 1080. The first 1070 and/or second material 1080 at least may comprise relatively rigid and/or hard components (i.e., "HARD" components). Alternatively, the first 1070 and/or second material 1080 may comprise a deformable, and/or flexible material. Such different types of first and second materials can be incorporated in a framework or "shell" configuration of less rigid and/or more flexible components (i.e., "HYTREL" components) for a position-specific purpose. For example, the helmet of FIG. 56 could comprise a base framework 1000 of Hytrel or similar materials, with plates or inserts 1010 of a harder and/or more rigid material. If desired, the various components could be co-molded and/or otherwise integrally formed (i.e., by injection molding of a skeletal frame, for example), while in other embodiments the various components could be modular and/or removable, as necessary and/or desired. Alternatively, the first and/or second materials may be recessed, the recesses sized and configured to receive a supplemental impact protective element. Accordingly, the first and/or second materials may be a raised surface.

FIGS. 57A through 57H depict various views of one exemplary embodiment of a supplemental impact protective element 1100 which can be utilized with a wide variety of helmet designs and/or sizes. The supplemental impact protective element can comprise a supplemental impact protective individual assembly. In this embodiment, the supplemental impact protective element can incorporate a curved body or base membrane 1110 having a lower attachment bumper assembly 1120. The supplemental impact protective individual assembly can comprise a base membrane 1110, a supplemental impact mitigation structure 1130, and/or a bumper attachment assembly 1120, such as shown in the exploded view within FIG. 58

FIGS. 59A-59H illustrate various views of one embodiment of a base membrane 1110. In one embodiment, the base membrane 1110 may comprise a first surface, a second surface and one or more vents 1140. The first surface can be shaped and/or configured to substantially match a portion of a commercially-available helmet. The first surface and/or second surface can further be shaped and/or configured to receive the supplemental impact mitigation structure, with the supplemental impact mitigation structure optionally removably coupled or permanently coupled to the first and/or second surface of the base membrane. The base membrane may further comprise one or more vents 1140. The one or more vents 1140 may be through-holes that extend through the first and second surface of the base membrane 110. The one or more vents 1140 may be concentrically aligned with the commercially-available vents (not shown) to allow continuous airflow. The base membrane may further comprise attachment posts 1150, the attachment posts 1150 that facilitate the attachment to the commercially-available (CA) helmet.

FIGS. 60 and 61A-61F depict various views of another alternative embodiment of a supplemental impact mitigation structure 1130. The supplemental impact mitigation structure 1130 may comprise a first structure 1160 and a second structure 1170. The first structure 1160 may be coupled to the second structure 1170. The impact mitigation structures for the first structure 1160 and/or the second structure 1170 may be the same or they may be different. The first structure 1160 and the second structure 1170 may comprise a first portion and a second portion. The first portion and/or second portion may comprise a more rigid material to facilitate attachment to the CA helmet and/or the base membrane. The first and/or second portions may comprise holes 1180, wherein the holes may further facilitate attachment to the CA helmet and/or base membrane.

Figure 62A:
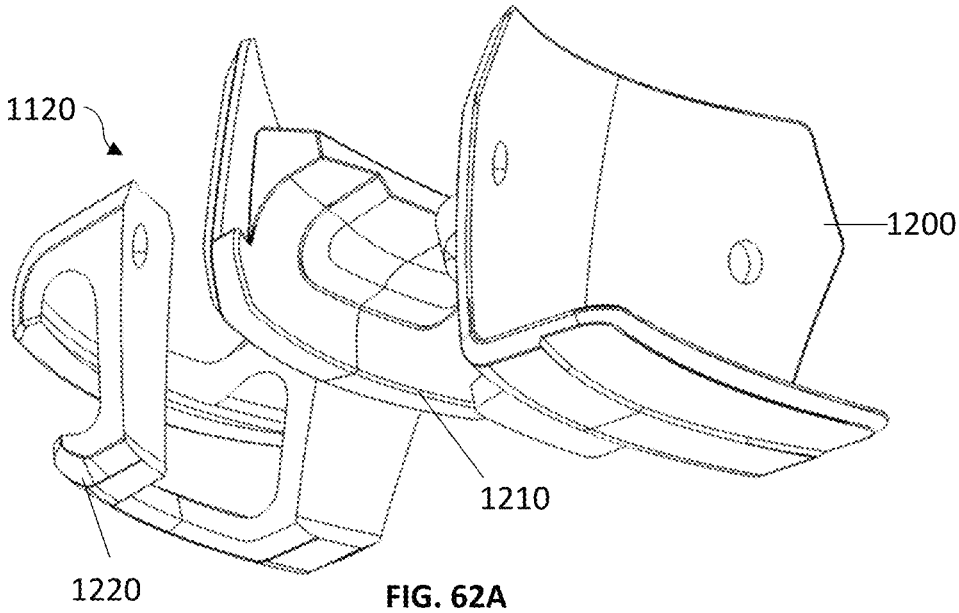
FIGS. 62A-62B depicts exploded isometric views of a bumper assembly of a supplemental frontal impact protective element.
Figure 62B:
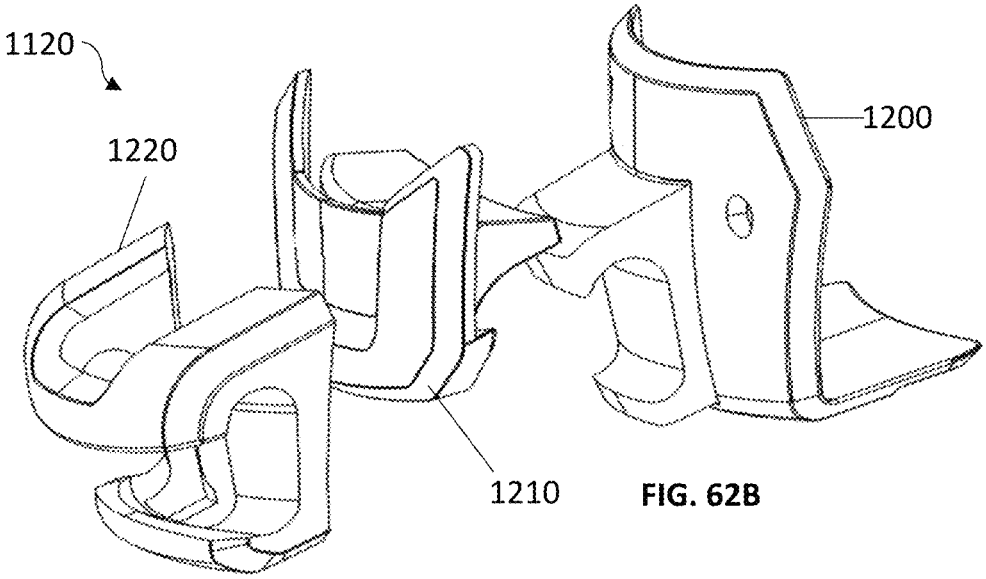
Figure 63A:
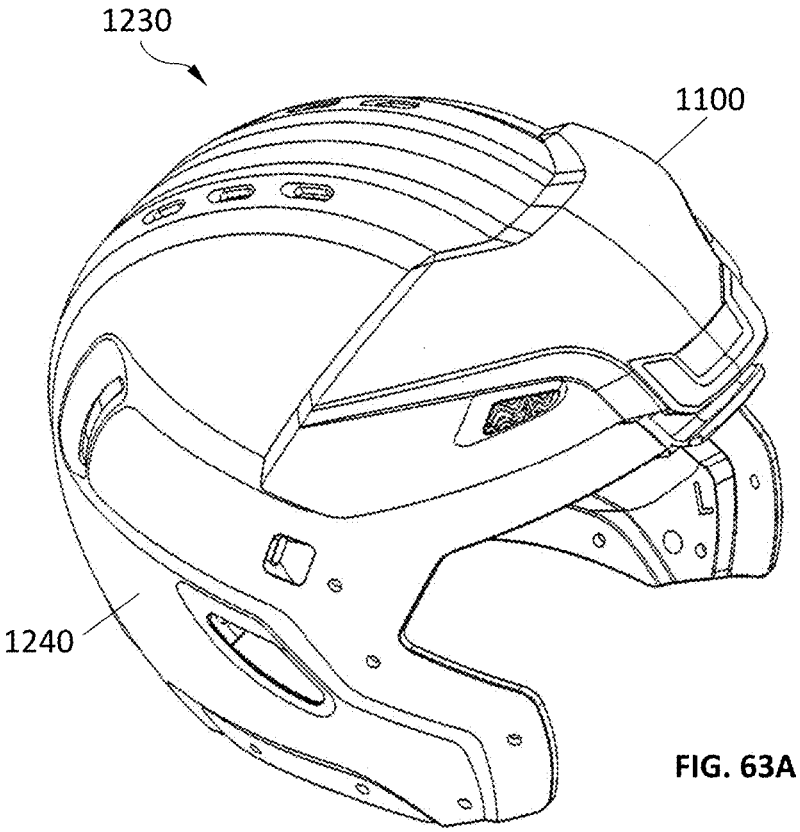
FIGS. 63A-63H depicts various views of an alternate embodiment of a position-specific helmet design.
Figure 63B:
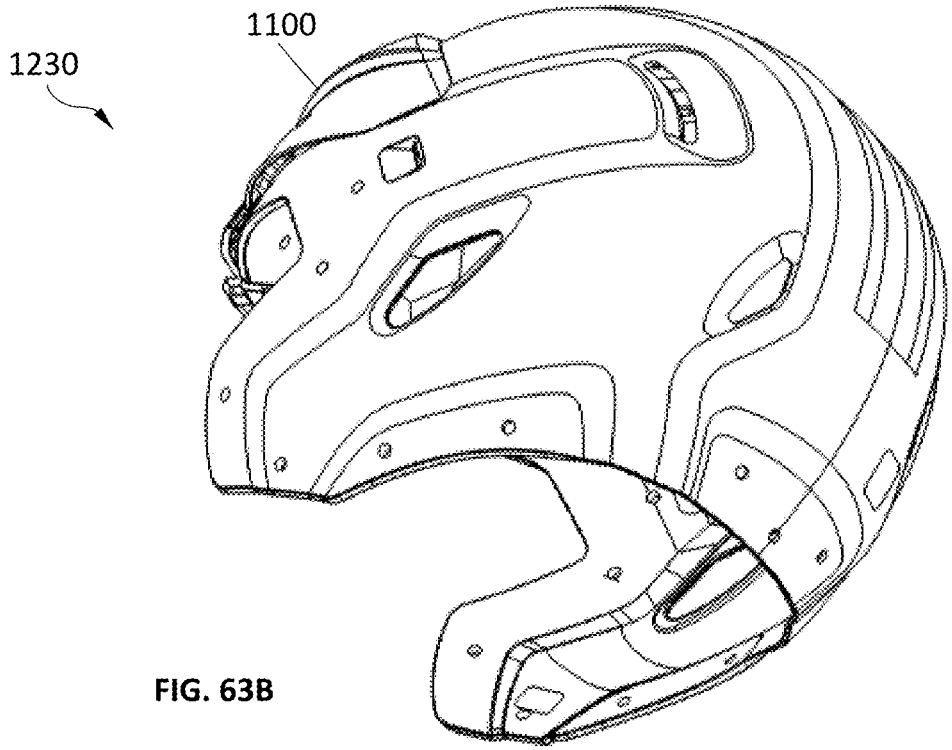
Figure 63C:
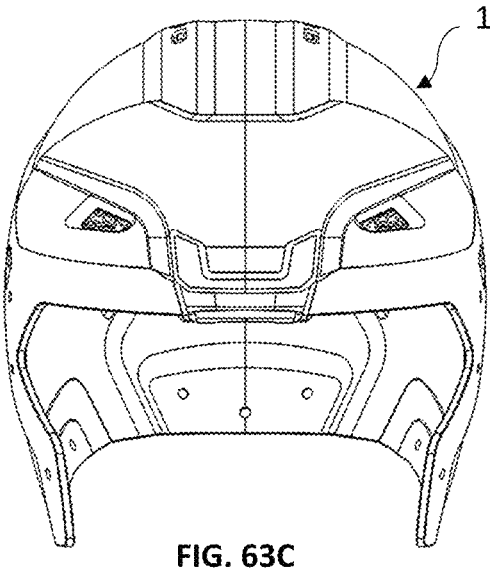
Figure 63D:
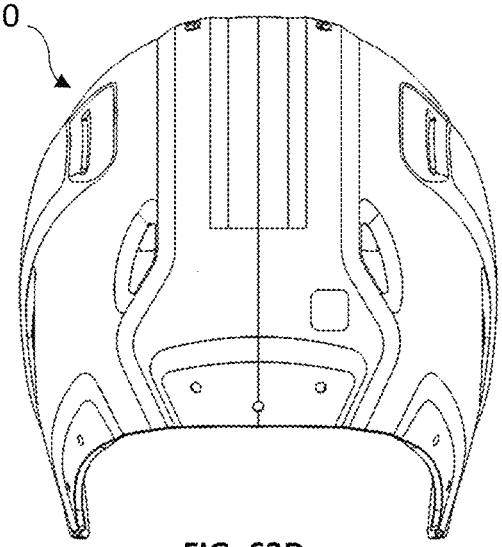
Figure 63E:
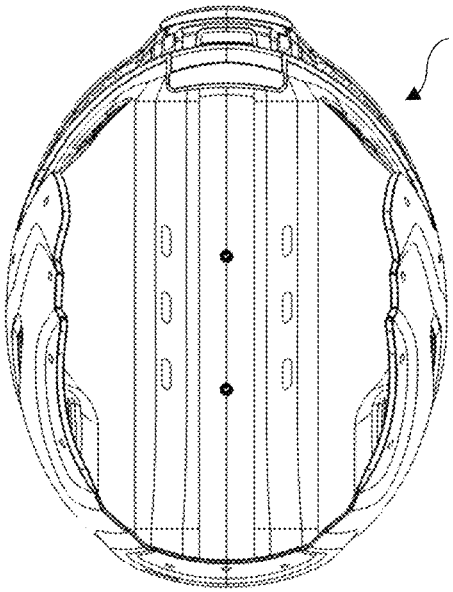
Figure 63F:
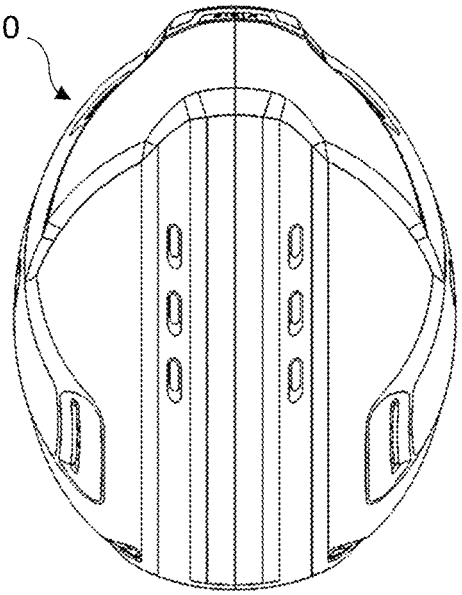
Figure 63G:
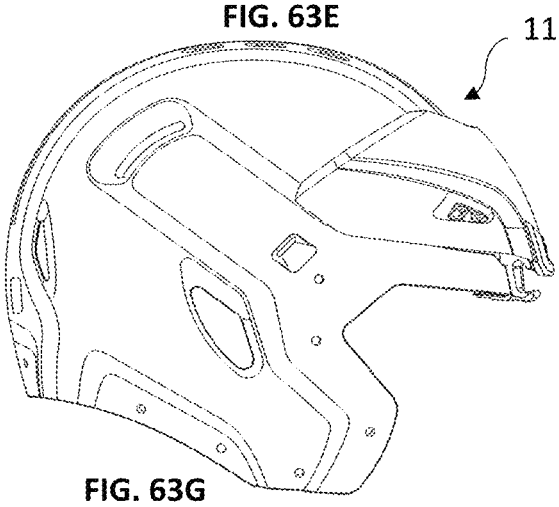
Figure 63H:
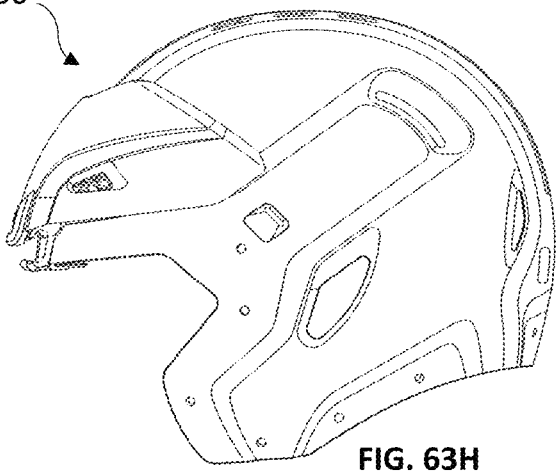

FIGS. 62A-62B illustrate different isometric views of the bumper attachment assembly 1120. The bumper attachment assembly 1120 in this embodiment desirably facilitates the attachment of the impact protective element individual assembly to the CA helmet. The bumper attachment assembly 1120 comprises a back bumper 1200, a central bumper 1210, and a facemask bumper 1220, and/or any combination(s) thereof. The central bumper 1210 is coupled to the base membrane, and the facemask bumper 1220 is coupled to the base membrane, the central bumper 1210, the back bumper 1200, and/or any combination thereof. The back bumper 1200 is coupled to base membrane, the CA helmet, the facemask bumper 1220, and/or any combination thereof. The facemask bumper 1220 comprises a channel, the channel is sized and configured to receive a portion of a facemask (not shown).

FIGS. 63A-63H illustrate various views of a position-specific helmet with one or more supplemental impact protection element individual assemblies. The supplemental impact protective element and/or the supplemental impact protection element assemblies may be coupled to one or more specific regions of the helmet. The regions may comprise a frontal region (or front), an occipital region (or lower-back), a mid-back region, a parietal region (or mid-line), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof.

The entire disclosure of each of the publications, patent documents, and other references referred to herein is incorporated herein by reference in its entirety for all purposes to the same extent as if each individual source were individually denoted as being incorporated by reference.

The invention may be embodied in other specific forms without departing from the spirit or essential characteristics thereof. The foregoing embodiments are therefore to be considered in all respects illustrative rather than limiting on the invention described herein. The scope of the invention is thus intended to include all changes that come within the meaning and range of equivalency of the descriptions provided herein.

Many of the aspects and advantages of the present invention may be more clearly understood and appreciated by reference to the accompanying drawings. The accompanying drawings are incorporated herein and form a part of the specification, illustrating embodiments of the present invention and together with the description, disclose the principles of the invention.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the disclosure herein.

What is claimed is:

1. A position-specific helmet comprising:

an outer layer, the outer layer comprising a position-specific region that includes an impact zone;

an impact mitigation layer; and a supplemental impact protective element, the supplemental impact protective element coupled to at least a portion of the position-specific region of the outer layer;

wherein the supplemental impact protective element comprises:

a curved body having edges sized and shaped to contact an external surface of the outer layer; and a supplemental impact mitigation structure positioned between the curved body and the external surface; and wherein the curved body comprises one or more apertures formed through the curved body from an outer surface to an inner surface.

2. The helmet of claim 1, wherein the helmet further comprises an inner layer, the impact mitigation layer disposed between the outer layer and the inner layer.

3. The helmet of claim 1, wherein the impact mitigation layer comprises a plurality of impact mitigation structures, the plurality of impact mitigation structures comprising a plurality of filaments or a plurality of laterally supported filament polygonal structures.

4. The helmet of claim 3, wherein the plurality of filaments or the plurality of laterally supported filament polygonal structures comprise single mode buckling structures.

5. The helmet of claim 2, wherein the inner layer is substantially more rigid than the outer layer.

6. The helmet of claim 3, wherein each of the plurality of filaments includes an upper and lower end, and at least one of the upper and lower ends of the plurality of filaments is secured to an inner layer and/or the outer layer of the helmet.

7. The helmet of claim 1, wherein the outer layer comprises a deformable material.

8. The helmet of claim 1, wherein the supplemental impact protective element comprises one or more supplemental impact protection individual assemblies or one or more supplemental impact protection pads.

9. The helmet of claim 1, wherein the position-specific region comprises a frontal region, a lower-back region, a mid-back region, a parietal region, a temporal region, an orbit region, a mandible region, a maxilla region, a nasal region, a zygomatic region, an ethmoid region, a lacrimal region, a sphenoid region and/or any combination thereof.

10. The helmet of claim 1, wherein the impact zone comprises the highest frequency of impacts, the most severe impacts, or the highest concussion rate and/or any combination thereof.

11. A helmet comprising:

an outer layer, the outer layer comprising an outer layer material and an outer surface, the outer surface comprising a position-specific region that includes an impact zone;

an inner layer spaced apart from the outer layer to define a space;

an impact mitigation layer disposed in the space between the inner layer and the outer layer; and a supplemental impact protective element having one or more impact mitigation structures and a base membrane, the base membrane including a base membrane material, the supplemental impact protective element coupled to at least a portion within the position-specific region;

wherein the supplemental impact protective element comprises:

a curved body having edges sized and shaped to contact an external surface of the outer layer; and a supplemental impact mitigation structure positioned between the curved body and the external surface; and wherein the curved body comprises one or more apertures formed through the curved body from an outer surface to an inner surface.

12. The helmet of claim 11, wherein the impact mitigation layer comprises a plurality of single mode buckling structures.

13. The helmet of claim 11, wherein the inner layer is substantially more rigid than the outer layer.

14. The helmet of claim 12, wherein the plurality of single mode buckling members comprises a plurality of filaments or a plurality of laterally supported polygonal structures.

15. The helmet of claim 11, wherein the outer layer material and the base membrane material is the same or different.

16. The helmet of claim 11, wherein the one or more impact mitigation structures of the supplemental impact protective element comprises zig-zag structures or laterally supported polygonal structures.

17. The helmet of claim 11, wherein the position-specific region comprises a frontal region, a lower-back region, a mid-back region, a parietal region, a temporal region, an orbit region, a mandible region, a maxilla region, a nasal region, a zygomatic region, an ethmoid region, a lacrimal region, a sphenoid region and/or any combination thereof.

18. The helmet of claim 1, wherein the supplemental impact protective element further comprises an attachment assembly configured to attach the curved body to the outer layer of the helmet.

* * * * *